US007222955B2

(12) United States Patent
Ohashi et al.

(10) Patent No.: US 7,222,955 B2
(45) Date of Patent: May 29, 2007

(54) BOTH-SIDE RECORDING APPARATUS

(75) Inventors: Tetsuyo Ohashi, Kanagawa (JP); Junichi Yoshikawa, Tokyo (JP); Masahiro Taniguro, Kanagawa (JP); Koya Iwakura, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/824,411

(22) Filed: Apr. 15, 2004

(65) Prior Publication Data

US 2004/0207708 A1 Oct. 21, 2004

(30) Foreign Application Priority Data

Apr. 18, 2003 (JP) ..... 2003-114062

(51) Int. Cl.
*B65H 9/00* (2006.01)

(52) U.S. Cl. ..... 347/104; 271/186; 271/225; 271/274

(58) Field of Classification Search ..... 271/272–274, 271/225, 186; 347/104
See application file for complete search history.

(56) References Cited

U.S. PATENT DOCUMENTS

| | | | | |
|---|---|---|---|---|
| 3,942,785 | A * | 3/1976 | Stange | 271/65 |
| 5,415,391 | A * | 5/1995 | Wong et al. | 271/225 |
| 5,580,042 | A | 12/1996 | Taniguro et al. | 271/274 |
| 5,620,174 | A | 4/1997 | Taniguro et al. | 271/10.12 |
| 5,672,019 | A | 9/1997 | Hiramatsu et al. | 400/624 |
| 5,725,319 | A | 3/1998 | Saito et al. | 400/629 |
| 5,808,647 | A * | 9/1998 | Kurata et al. | 347/104 |
| 5,984,305 | A * | 11/1999 | Inoue | 271/291 |
| 5,988,635 | A * | 11/1999 | Ohshima | 271/274 |
| 6,168,270 | B1 | 1/2001 | Saikawa et al. | 347/104 |
| 6,332,068 | B2 | 12/2001 | Blackman et al. | 399/364 |
| 6,343,787 | B1 * | 2/2002 | Kato et al. | 271/274 |
| 6,550,907 | B2 * | 4/2003 | Uchida | 347/104 |
| 2001/0000462 | A1 | 4/2001 | Blackman et al. | 399/13 |
| 2003/0143011 | A1 | 7/2003 | Yoshikawa et al. | 400/578 |

FOREIGN PATENT DOCUMENTS

| | | |
|---|---|---|
| EP | 0 785 079 A1 | 7/1997 |
| JP | 2002-67407 | 3/2002 |

OTHER PUBLICATIONS

Official Letter/Search Report, issued by the European Patent Office on Jul. 14, 2005, in European Patent Application No. 04009137.3.

* cited by examiner

*Primary Examiner*—Andrew H. Hirshfeld
*Assistant Examiner*—Jill E. Culler
(74) *Attorney, Agent, or Firm*—Fitzpatrick, Cella, Harper & Scinto

(57) ABSTRACT

The recording paper is transported to a paper inversion unit in such a manner that, when recording of a first surface of a recording paper is performed, the recording paper is transported to a position where a rear end of the recording paper is released from a pair of sheet transport rollers, the sheet transport roller and a pinch roller are released at the position, the recording paper is transported in a direction opposite to the direction in the first surface recording to the pair of sheet transport rollers by a pair of sheet discharge rollers, the sheet transport roller is pressed against the pinch roller again, and the transport of the recording paper in the reverse direction is further continued.

14 Claims, 23 Drawing Sheets

BOTH-SIDE RECORDING APPARATUS

BACKGROUND OF THE INVENTION

1. Field of the Invention

The present invention relates to a both-side recording apparatus in which both-side recording can be performed to a recording medium inverted by a sheet inversion unit, particularly to the both-side recording apparatus with a sheet transport mechanism having a pair of sheet transport rollers including a sheet transport roller and a pinch roller and a pair of sheet discharge roller arranged on the downstream side of the pair of sheet transport rollers in a transport direction.

2. Related Background Art

In an inkjet recording apparatus which can perform the both-side recording, some methods have been realized or proposed. In these methods, after the recording of the surface (front surface) of the recording paper is terminated, the transport direction of the recording paper is inverted, the recording paper is fed into an inversion device, the recording paper is transported again by the same sheet transport unit after termination of inversion operation, and the recording is performed to a reverse surface of the recording paper by the same recording unit.

In the invention disclosed in U.S. Pat. No. 6,332,068, the recording paper is supported by the sheet transport rollers while sandwiched by the sheet transport rollers when recording operation of the front surface of the recording paper is terminated, and a rotating direction of the sheet transport roller is directly reversed to transport the recording paper to the inversion unit. In the invention disclosed in Japanese Patent Application Laid-Open No. 2002-067407, after the recording operation of the front surface of the recording paper is performed while the recording paper is transported to the downstream side where the recording paper has already disengaged from the sheet transport roller, the transport direction of the recording paper is reversed, and the sheet transport rollers support the recording paper while sandwiching the recording paper again by utilizing a guide member. In both the methods, a region where the recording of the front surface is terminated and ink is fixed is supported by the sheet transport roller while sandwiched by the sheet transport roller again, and the recording paper is transported.

However, there are some restrictions in the above conventional examples. In the invention disclosed in U.S. Pat. No. 6,332,068, because a paper supporting and sandwiching space for the sheet transport rollers is required, it is impossible that an array of discharge ports of a recording head is arranged to proximity of a nip position. Therefore, a blank space where the recording operation cannot be performed is not prevented from remaining in a rear end portion of the recording paper. In the invention disclosed in Japanese Patent Application Laid-Open No. 2002-067407, the blank space in a rear end portion of the recording paper can be eliminated. However, in the case where the recording operation is performed by the inkjet recording, since deformation such as surface waviness influenced by swelling of the recording paper occurs, there is a possibility that paper jam is generated when the sheet transport rollers support the recording paper while sandwiching the recording paper. Further, since the sheet transport rollers support the region where the recording the ink is fixed while sandwiching the region again to transport, it is necessary to wait until the ink is completely dried to be fixed. In consideration of various kinds of conditions, it is necessary to secure sufficient dry standby time in order not to transfer the ink to the roller side in any case.

SUMMARY OF THE INVENTION

In view of the foregoing, it is an object of the invention to provide the both-side recording apparatus which can perform the recording without the blank space in an overall range of a recording medium, transport the recording medium to a gap between the sheet transport roller and a pinch roller before the recording medium absorbs the ink and the like to be deformed in transporting the recording paper, securely support the recording medium while sandwiching the recording medium again with the sheet transport roller and the pinch roller, and securely prevent the paper jam and the like.

In order to achieve the above object, the invention is a both-side recording apparatus with a sheet transport mechanism having a pair of sheet transport rollers including a sheet transport roller and a pinch roller pressed against the sheet transport roller, at least one pair of sheet discharge rollers arranged on the downstream side of the sheet transport roller in a transport direction, and a pair of sheet discharge rollers including a rotating body pressed against the roller, characterized in that a recording medium can be transported to a position where a rear end of the recording medium is released from the pair of sheet transport rollers when a first surface is recorded at first, and then the recording paper is transported to a paper inversion unit in such a manner that the sheet transport roller is pressed into contact with the pinch roller again to further continue the transport in the reverse direction after the sheet transport roller and the pinch roller are released to transport the recording medium toward a reverse direction of the first surface recording by the pair of sheet discharge rollers.

DESCRIPTION OF THE PREFERRED EMBODIMENTS

Figure 1:
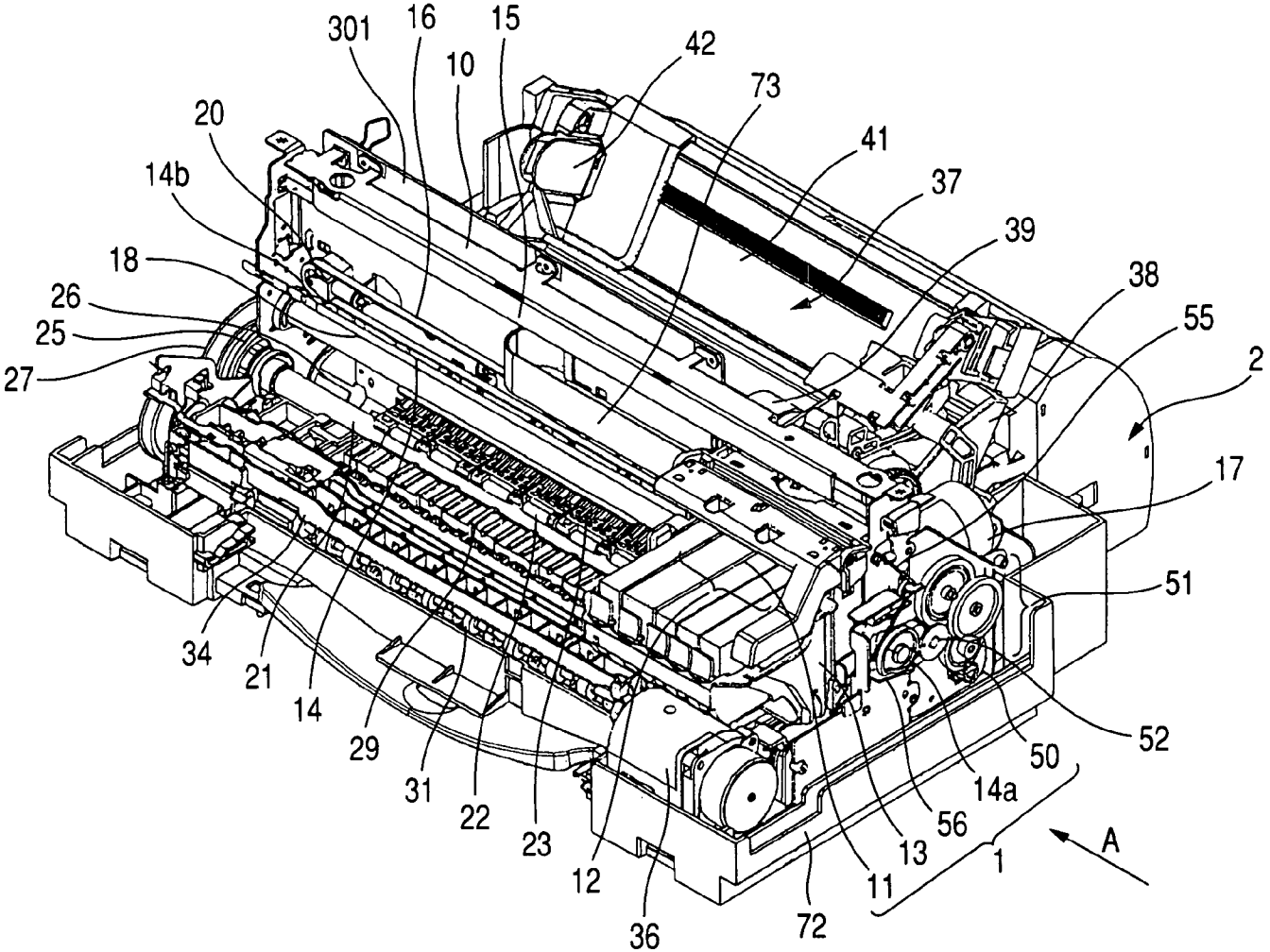
FIG. 1 is a schematic perspective view showing an overall configuration of a both-side recording apparatus according to an embodiment of the invention.
Figure 2:
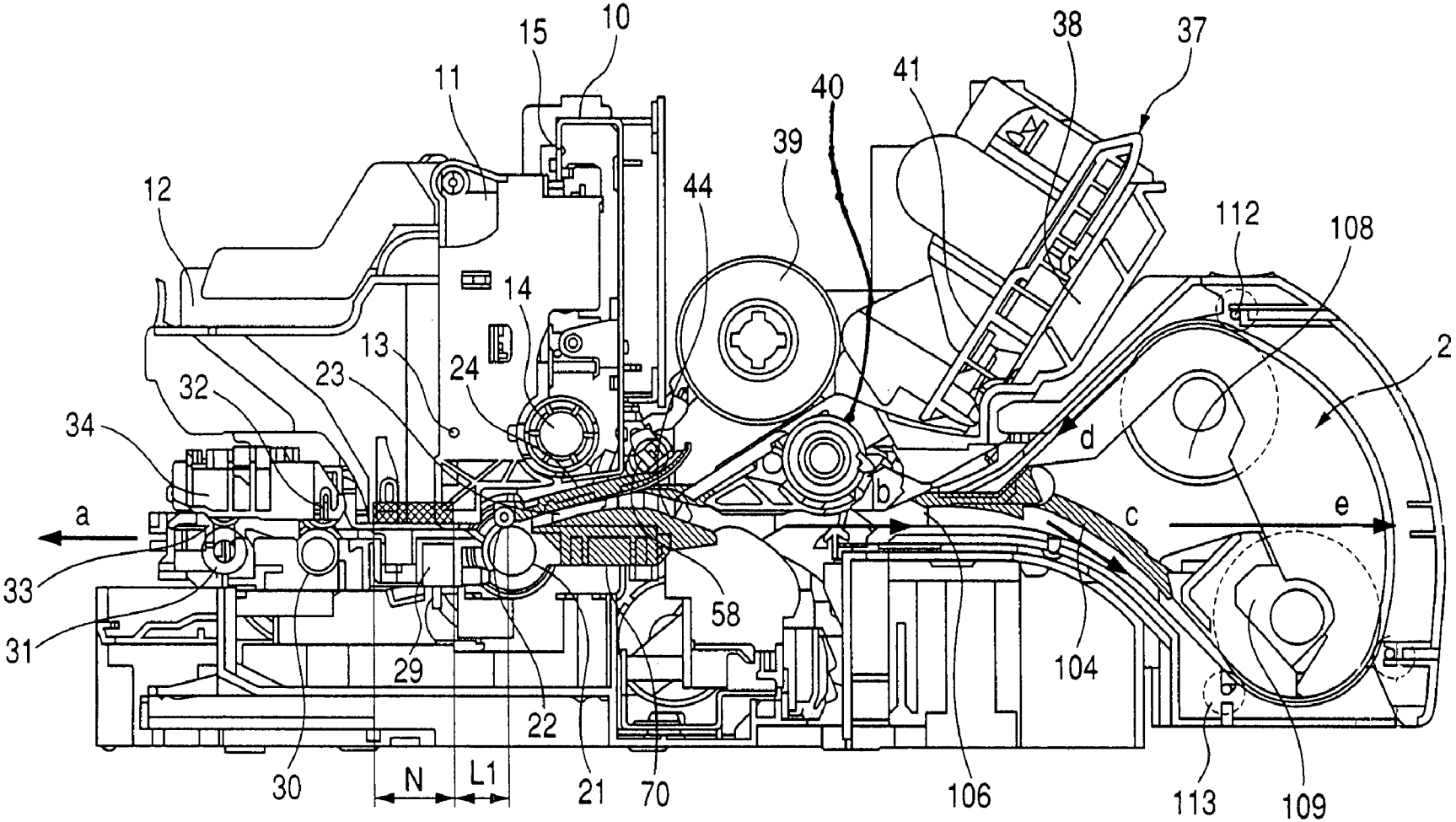
FIG. 2 is a schematic sectional side view showing the overall configuration of the both-side recording apparatus according to the embodiment of the invention.

A preferred embodiment of the invention will be specifically described below referring to the accompanying drawings. In each drawing, the same constituents and corresponding parts are indicated by the same reference numerals and signs. FIG. 1 is a schematic perspective view showing an overall configuration of an embodiment of the recording apparatus to which the invention is applied and FIG. 2 is a schematic sectional side view showing the overall configuration of the recording apparatus according to the embodiment, as viewed from a direction of an arrow A of FIG. 1. The recording apparatus shown in FIGS. 1 and 2 is the inkjet recording apparatus which discharges ink to perform the recording onto the recording medium. In the following description, since the recording paper is a representative example of the recording medium, sometimes the wording in which the recording medium in broad sense of the term should be used is expressed by the recording paper or the paper. However, scope of the recording medium is not limited to the paper (recording paper).

In FIGS. 1 and 2, the numeral 1 designates a main body of a recording unit, the numeral 2 designates an automatic both-side unit (paper inversion unit, automatic inversion unit), the numeral 10 designates a chassis which supports a structure of the recording unit 1, the numeral 11 designates a recording head which discharges the ink to perform the recording, the numeral 12 designates an ink tank storing the ink supplied to the recording head 11, the numeral 13 designates a carriage which perform scanning (main scanning) while holding the recording head 11 and the ink tank 12, the numeral 14 designates a guide shaft which guides and supports the carriage 13, the numeral 15 designates a guide rail which guides and supports the carriage 13 in parallel to the guide shaft 14, the numeral 16 designates a carriage belt (timing belt) which drives the carriage 13, the numeral 17 designates a carriage motor which drives carriage belt 16 through a pulley, the numeral 18 designates a code strip which detects a position of the carriage 13, and the numeral 20 designates an idler pulley which is opposed to the puller of the carriage motor 17 to tension the carriage belt 16.

The numeral 21 designates a sheet transport roller which transports the recording medium (recording paper), the numeral 22 designates a pinch roller which is driven by pressing the sheet transport roller 21 against the pinch roller, the numeral 23 designates a pinch roller holder which rotatably holds the pinch roller 22, the numeral 24 designates a pinch roller spring which presses the pinch roller 22 into contact with the sheet transport roller 21, the numeral 25 designates a sheet transport roller pulley which is fixed to the sheet transport roller 21, the numeral 26 designates an LF motor which drives the sheet transport roller 21, the numeral 27 designates a code wheel which detects a rotational angle of the sheet transport roller 21, and the numeral 29 designates a platen which is opposed to the recording head 11 to support the recording paper.

The numeral 30 designates a first sheet discharge roller which cooperated with the sheet transport roller 21 to transport the recording medium, the numeral 31 designates a second sheet discharge roller which is provided on the downstream side of the first sheet discharge roller 30, the numeral 32 designates a first star gear train which is of a rotating body being opposed to the first sheet discharge roller 30 to hold the recording medium, the numeral 33 designates a second star gear train which is of the rotating body being opposed to the second sheet discharge roller 31 to hold the recording medium, the numeral 34 designates a star gear base which rotatably holds the first start gear train 32 and the second star gear train 33, the numeral 36 designates a maintenance unit which prevents the recording head 11 from clogging.(clogging of a discharge port or nozzle) to maintain and recover ink discharge performance and is actuated when the ink is caused to run through ink channels of the recording head 11 in exchanging the ink tanks 12, and the numeral 37 designates a main ASF (Automatic Sheet Feeder) which is of an automatic sheet supply unit stacking the sheet of recording paper to supply the recording paper one by one to a recording unit during the recording operation.

In FIGS. 1 and 2, the numeral 38 designates an AFS base which becomes a foundation of the main ASF 37, the numeral 39 designates a sheet supply roller which supplies the stacked sheets of recording paper while abutting on the stacked sheets of recording paper, the numeral 40 designates a separation roller which separates the plurality of recording mediums one by one when the plurality of recording mediums are simultaneously supplied, the numeral 41 designates a pressing board which stores the recording medium to bias the recording medium toward the sheet supply roller 39, the numeral 42 designates a side guide which is provided on the pressing plate 41 and can be fixed at an arbitrary position in a width direction of the recording medium, and the numeral 44 designates an ASF flap which controls the paper passing direction of the recording medium into one direction from the main ASF 37.

The numeral 50 designates a lift input gear which engages an ASF planet gear 49, the numeral 51 designates a lift reduction gear train which conveys power from the lift input gear 50 while reducing speed, the numeral 52 designates a lift cam gear which is directly connected to a lift cam shaft, the numeral 55 designates a guide shaft spring which provides biasing force to move the guide shaft 14 to one side, the numeral 56 designates a guide oblique surface on which a cam of the guide shaft gear 53 slides, the numeral 58 designates a lift cam shaft which lifts the pinch roller holder 23 and the like, the numeral 70 designates a sheet passing guide which guides the front end of the recording medium to the nip portion between the sheet transport roller 21 and the pinch roller 22, the numeral 72 designates a base which supports the whole of the main body of the recording unit 1, and the numeral 301 designates a control board in which control units are combined.

Figure 21:
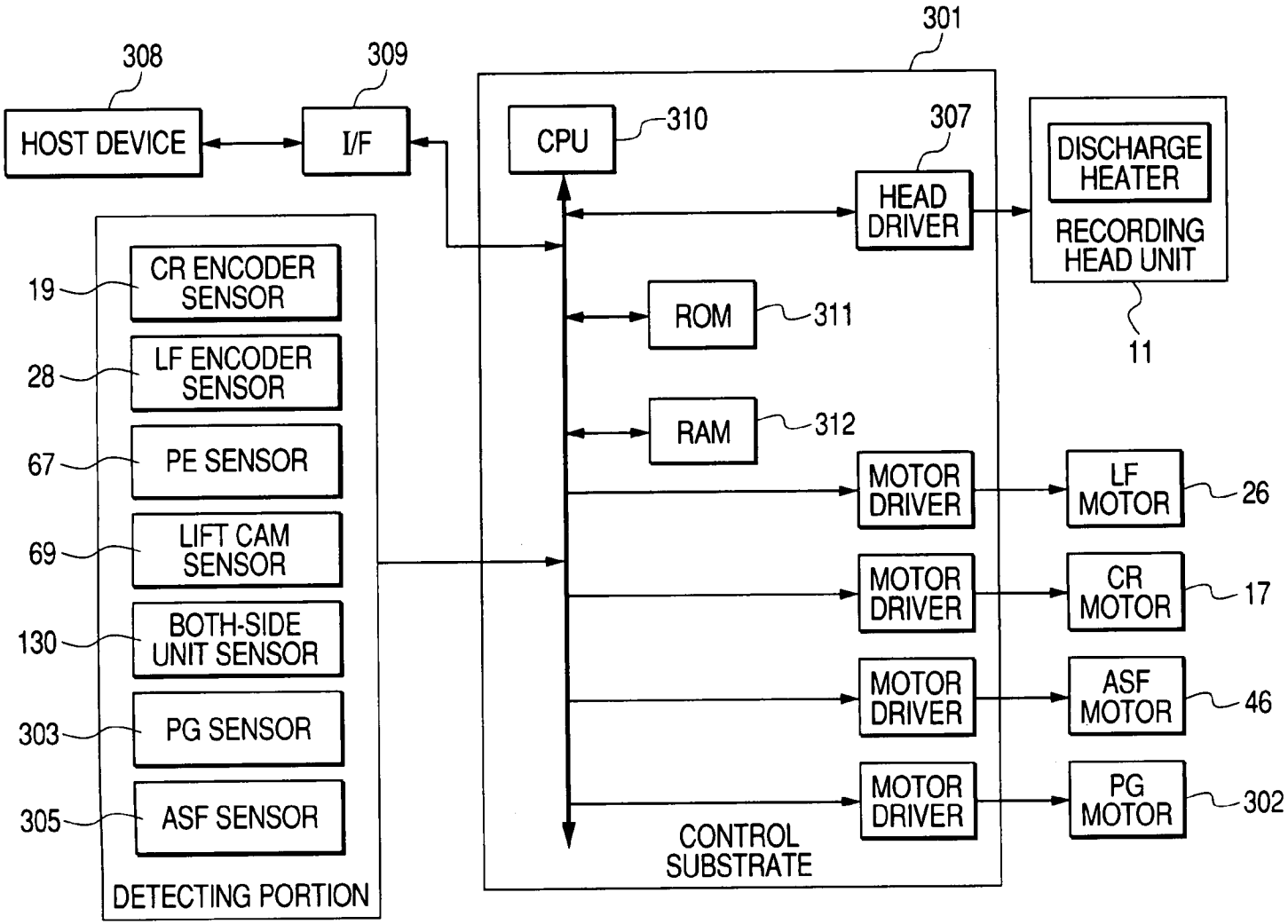
FIG. 21 is a block diagram showing a configuration of a control circuit of the both-side recording apparatus according to the embodiment of the invention.

FIG. 21 is a block diagram showing driving means for driving the whole of the recording apparatus to which the invention is applied. In FIG. 21, the numeral 19 designates a CR (carriage) encoder sensor which is mounted on the carriage 13 and reads the code strip 18, the numeral 28 designates an LF encoder sensor which reads the code wheel 27 attached to the chassis 1, the numeral 46 designates an ASF motor which drives the main ASF 37, the numeral 67 designates a PE sensor which detects the operation of a sensor lever 66, the numeral 69 designates a lift cam sensor which detects the operation of the lift cam shaft 58, and the numeral 130 designates a both-side unit sensor which detects attachment and detachment of the automatic both-side unit 2.

In FIG. 21, the numeral 302 designates a PG motor which drives the maintenance unit 36, the numeral 303 designates a PG sensor which detects the operation of the maintenance unit 36, the numeral 305 designates an ASF sensor which detects the operation of the main ASF 37, the numeral 307 designates a head driver which drives the recording head 11, the numeral 308 designates a host apparatus which transmits recording data to the recording apparatus, the numeral 309 designates an interface (I/F) which electrically interfaces between the host apparatus 308 and the recording apparatus, the numeral 310 designates CPU which control the recording apparatus and gives a control direction, the numeral 311 designates ROM in which control data and the like are written, and the numeral 312 designates RAM which becomes an area where recording data and the like are loaded.

Referring to FIG. 1, FIG. 2, and FIG. 21, the recording apparatus according to the invention will be briefly described, and then the operation of each unit will be described. At first, a configuration of the commonly used serial scan type of recording apparatus will be described. The recording apparatus according to the embodiment mainly includes a sheet supply unit, a recording medium transport unit (sheet transport unit), a recording unit, a recording means (recording head) maintenance unit, and an automatic inversion unit (automatic both-side unit). When the recording data is transmitted from the host apparatus 308 and stored in RAM 312 through I/F 309, CPU 310 gives a recording operation start direction to start the recording operation.

When the recording is started, the sheet supply operation is performed at first. The sheet supply unit is the main ASF. The sheet supply unit includes the automatic sheet supply unit which draws the recording medium one by one from the plurality of recording mediums (the plurality of sheets of recording paper) stacked on the pressing plate 41 in each recording operation and supplies the recording medium to the recording medium transport unit (sheet transport unit). When the sheet supply operation is started, the ASF motor 46 is rotated in a forward direction, and, the power of the ASF motor 46 rotates the cam holding the pressing plate 41 through the gear train. When the cam is disengaged by the rotation of the ASF motor 46, the pressing plate 41 is biased toward the sheet supply roller 39 by action of the pressing plate spring (not shown). At the same time, the sheet supply roller 39 is rotated in the direction in which the recording medium (paper) is transported, so that the uppermost recording medium of the plurality of recording mediums stacked on the pressing plate 41 is started to transport. Sometimes the plurality of sheets of paper is simultaneously supplied by conditions of friction force between the sheet supply roller 39 and the recording paper and the friction force between the sheets of paper.

In that case, the separation roller 40, which is pressed against the sheet supply roller 39 and has predetermined return running torque in the direction opposite to the recording sheet transport direction, acts so as to push back the sheets of recording paper except the recording paper located on the most sheet supply roller 39 side onto the original pressing plate. When the ASF sheet supply operation is terminated, the separation roller 40 is released from the state in which the separation roller 40 is pressed into contact with the sheet supply roller 39 by the operation of the cam, and the separation roller 40 is separated from the sheet supply roller 39 with a predetermined distance. At this point, in order to securely push back the recording paper to the predetermined position on the pressing plate, the return pawl 43 is rotated to push back the recording paper. Only one sheet of recording paper is supplied to the sheet transport unit in the above-described manner.

When one sheet of recording paper is supplied from the main ASF 37, the front end of the recording paper abuts on the ASF flap 44 biased in the direction in which the sheet passing path is blocked by the ASF flap 44. However, the recording paper pushes away the ASF flap 44 to pass through. When the recording operation of the recording paper is terminated and a rear end of the recording paper passes through the ASF flap 44, since the ASF flap 44 returns to the biased state to close the sheet passing path, even if the recording paper is supplied in the reverse direction, the recording paper never return to the main ASF 37 side.

The recording paper supplied from the sheet supply unit is transported toward the nip portion of the sheet transport roller (transport roller) 21 and the pinch roller 22 which are of the sheet transport unit. Because the center of the pinch roller 22 is attached so as to be slightly offset from the center of the sheet transport roller 21 toward the direction which comes close to the first sheet discharge roller 30, the angle of a tangential direction in which the recording paper is inserted is slightly declined from a horizontal direction. Therefore, in order that the front end of the recording paper is accurately guided into the nip portion, the recording paper is transported while the sheet passing path formed by the pinch roller holder 23 and the guide member (sheet passing guide) 70 is declined.

The paper (recording paper) supplied by ASF 37 abuts on the nip portion of the sheet transport roller 21 in the stop state. At this point, a loop of the paper is formed between the sheet supply roller 39 and the sheet transport roller 21 in such a manner that the main ASF 37 supplies the paper by an interval somewhat longer than the predetermined length of the sheet passing path. The force generated by returning the loop to the straight state presses the front end of the paper against the nip portion of the sheet transport roller 21, which allows the front end of the paper to be parallel along the line of the sheet transport roller 21, and the so-called registration operation is completed. After the registration operation is completed, the LF motor (transport motor) 26 is started to rotate in the direction in which the recording paper is moved toward the forward direction, i.e. in the direction in which the recording paper proceeds to the first sheet discharge roller 30. Then, the power of the sheet supply roller 39 is cut, and the sheet supply roller 39 is rotated with the paper. At this point, the recording paper is transported only by the sheet transport roller 21 and the pinch roller 22. The paper advances to the forward direction in every predetermined amount of linefeed and proceeds along a rib provided in the platen 29.

The front end of the paper engages the nip portion of the first sheet discharge roller 30 and the first star gear train 32 and the nip portion of the second sheet discharge roller 31 and the second star gear train 33. Circumferential speeds of the first sheet discharge roller 30 and the second sheet discharge roller 31 is set substantially equal to the circumferential speed of the sheet transport roller 21, and the sheet transport roller 21 is connected to the first sheet discharge roller 30 and the second sheet discharge roller 31 by the gear train, so that the first sheet discharge roller 30 and the second sheet discharge roller 31 are rotated while synchronizing with the sheet transport roller 21. Therefore, the paper is transported without loosening or tensioning the paper. The sheet transport roller 21 and the pinch roller 22 constitute a pair of sheet transport rollers. The first sheet discharge roller 30 and the first star gear train 32 constitute a first pair of sheet discharge rollers, the second sheet discharge roller 31 and the second star gear train 33 constitute a second pair of sheet discharge rollers, and the first pair of sheet discharge rollers and the second pair of sheet discharge rollers constitute a set of the pairs sheet discharge rollers.

The recording unit mainly includes the recording head 11 which is of the recording means performing the recording to the recording paper on the basis of the recording data and the carriage 13 which mounts the recording head 11 to perform the scanning in the direction usually orthogonal to the recording sheet transport direction. The carriage 13 is guided and supported by the guide shaft 14 fixed to the chassis 10 and the guide rail 15 which is a part of the chassis 10. The carriage 13 performs reciprocating motion (scanning) by transferring the driving force of the carriage motor 17 through the carriage belt 16 tensioned between the carriage motor 17 and the idler pulley 20.

The plurality of ink channels communicated with the ink tank 12 is formed in the recording head 11, and the ink channel is communicated to the discharge port provided in a surface (discharge port surface) opposite to the platen 29. An actuator for discharging the ink is arranged in the inside of the plurality of discharge ports forming an array of discharge ports. For example, the actuator utilizing film boiling pressure of liquid by electrothermal conversion material (heating element), electromechanical transducer (electro-pressure conversion element) such as piezoelectric element, or the like is used as the actuator for discharging the ink.

In the inkjet recording apparatus which is of the recording apparatus using the recording head 11, an ink droplet is discharged according to the recording data by transmitting the signal of the head driver 307 to the recording head through a flexible flat cable 73. The ink droplet can be discharged toward the recording paper at proper timing by reading the code strip 18 tensioned in the chassis 10 with the CR encoder 19 mounted on the carriage 13. When the recording of one line is terminated, the sheet transport unit (recording medium transport unit) transports the recording paper by the required amount. The recording operation can be performed over the surface of the recording medium by repeating the above operation.

The recording head maintenance unit maintains and recovers the recording operation of the recording head 11 in the normal state by preventing the clogging of the discharge port of the recording head 11 or by removing dirt caused by paper powders or the like on the discharge port surface of the recording head 11. A capping mechanism which covers the discharge ports, a suction recovery mechanism which sucks the ink from the discharge port in the capping state, a wiping mechanism which wipes off a periphery of the discharge port, and the like are used as the recovery mechanism for the recording head maintenance unit.

The maintenance unit 36 which is arranged at the standby position of the carriage while opposed to the recording head 11 includes the capping mechanism having a cap which abuts on the discharge port surface of the recording head 11 to protect the discharge ports, the wiping mechanism having a wiper which cleans the discharge port surface, the suction recovery mechanism having a suction pump which is connected to the cap to generate negative pressure in the cap, and the like. When the ink is sucked out in order to refresh the ink in the discharge port of the recording head 11, the ink is sucked and evacuated in such a manner that the cap is pressed against the discharge port surface and the suction pump is driven to generate the negative pressure in the cap. In the case where the ink adheres to the discharge port surface after the ink suction, or in the case where a foreign material such as the paper powder adheres to the discharge port surface, the ink adhesion and the foreign material are removed in such a manner that the discharge port surface is wiped by the wiper abuts on the discharge port surface to move the wiper in parallel to the discharge port surface.

The summary of the recording apparatus was described above. Then, the specific configuration of the embodiment including the configuration of the automatic both-side unit 2 for the purpose of the paper inversion unit or the automatic inversion unit will be described in detail. The recording apparatus according to the invention is characterized in that the recording is automatically performed to the front surface and reverse surface of the recording paper which is of the sheet-like cut paper without troubling an operator, i.e. the automatic both-side recording can be performed.

The sheet passing path of the recording paper will be described referring to FIG. 2. In FIG. 2, the numeral 104 designates a changeover flap including a movable flap which is rotatably supported and determines the direction of the sheet passing path of the recording paper, the numeral 106 designates an outlet flap which is rotatably supported and opens and closes when the recording paper is moved out from the both-side unit 2, the numeral 108 designates a both-side roller A which is of an inversion roller transporting the recording paper in the both-side unit 2, the numeral 109 designates a both-side roller B which is of the inversion roller transporting the recording paper in the both-side unit 2, the numeral 112 designates a both-side pinch roller A which is driven by pressing the both-side roller A 108 against the both-side pinch roller A, and the numeral 113 designates a both-side pinch roller B which is driven by pressing the both-side roller B 109 against the both-side pinch roller B.

When the recording operation is started, the recording paper the recording paper is supplied one by one from the plurality of sheets of the recording paper stacked in the main ASF 37 by the action of the sheet supply roller 39, and the recording paper is transported to the sheet transport roller 21. The recording paper sandwiched between the sheet transport roller 21 and the pinch roller 22 is transported toward the direction indicated by an arrow a in FIG. 2. In the case where the both-side recording is performed, after the recording of the front surface of the recording paper is terminated, the recording paper is transported toward the direction indicated by an arrow b in FIG. 2 through a horizontal path provided below the main ASF 37. Since the automatic both-side unit 2 which is of the automatic inversion unit is arranged in the rear direction of the main ASF 37, the recording paper is introduced from the horizontal path into the automatic both-side unit 2 and transported toward the direction indicated by an arrow c in FIG. 2.

In the both-side unit 2, the recording paper changes the proceeding direction while sandwiched between the both-side roller B 109 and the both-side pinch roller B 113, and then the recording paper is transported toward the direction indicated by an arrow d in FIG. 2 while sandwiched between the both-side roller A 108 and the both-side pinch roller A 112. Finally, the proceeding direction of the recording paper is changed to 180 degrees (inversion) to return to the horizontal direction. The recording paper transported toward the direction indicated by the arrow a in FIG. 2 through the horizontal path is sandwiched by the sheet transport roller 21 and the pinch roller 22 again, and the reverse surface of the recording paper is performed. As described above, after the recording of the front surface is terminated, the recording paper is inverted by the horizontal path provided below the main ASF 37 and the automatic both-side unit 2 provided in the rear direction of the main ASF 37, and the recording of the reverse surface is performed to automatically perform the recording to both the front surface and the reverse surface.

A recording range in recording the surface (first surface, front surface) will be described. The recording head 11 has a discharge port area (recording area, ink discharge area) N between the sheet transport roller 21 and the pinch roller 22. Usually it is very difficult that the discharge port area N is arranged close to the nip portion of the sheet transport roller 21, because of ink channel arrangement to the discharge port, an electric lead to the actuator (discharge energy generation means) which discharges the ink, or the like. Therefore, in the range where the recording paper is sandwiched by the sheet transport roller 21 and the pinch roller 22, the recording can be performed only up to the range separated from the nip portion of the sheet transport roller 21 by a length L1 as shown in FIG. 2.

In the recording apparatus according to the embodiment, in order to reduce a blank space of an lower end of the surface, the recording is continued up to the region where the recording paper is separated from the nip portion of the sheet transport roller 21 and transported while sandwiched only by the first sheet discharge roller 30 and the second sheet discharge roller 31. This allows the recording operation to be performed until the blank space of the lower end of the surface is eliminated. However, when the recording paper is transported from the state in which the blank space of the lower end of the surface is eliminated toward the direction indicated by the arrow b in FIG. 2, the recording paper can not be guided to the nip portion of the sheet transport roller 21 and the pinch roller 22, or it is difficult to guide the recording paper to the nip portion, and there is a possibility that the so-called paper jam is generated. In the embodiment, in order to avoid the paper jam, the pinch roller 22 is released from the sheet transport roller 21 by the means described below to make a predetermined gap, the end portion of the recording paper is brought into the gap, and then the pinch roller 22 is pressed against the sheet transport roller 21 again. This allows the recording paper to be transported toward the direction indicated by the arrow b in FIG. 2.

Then, a release mechanism of the pinch roller 22, the release mechanism of the paper sensor lever (PE sensor lever) 66, a pressure adjustment mechanism of the pinch roller spring 24, an up-and-down movement mechanism of the guide member 70, and the up-and down mechanism of the carriage 13 which are the characteristic configuration of the embodiment will be described. As described above, the pinch roller 22 is operated so as to be released from the sheet transport roller 21. Further, the recording apparatus of the embodiment also includes other mechanisms in order to inverse the recording paper after the recording paper is brought into again.

One of the mechanisms is the release mechanism of the PE sensor lever 66 as the paper sensor lever. The PE sensor lever 66 is rockably attached at a predetermined angle relative to the surface of the recording paper so that the position of the front end or the rear end of the recording paper is accurately detected when the recording paper proceeds in the forward direction. This results in the technical problem that the end portion of the recording paper is hooked when the recording paper proceeds in the reverse direction or the front end of the PE sensor lever 66 breaks into the recording paper in transportation. Therefore, in the embodiment, the PE sensor lever 66 is released from the paper pass surface part of the way of the recording paper inversion process so as not to abut on the recording paper.

It is not always necessary to form the release mechanism of the PE sensor lever 66, and it is also possible to substitute the release mechanism of the PE sensor lever 66 to another means or configuration. That is to say, it is also possible to form the means for solving the above technical problem, in which a roller or the like is provided at the front end of the PE sensor lever 66 and the above technical problem is solved by rotating the roller even if the recording paper proceeds toward the reverse direction. Further, it is also possible to form the means, in which the rocking angle of the PE sensor lever 66 is increased and the PE sensor lever 66 is rocked to the angle in the reverse direction when the recording paper is transported toward the reverse direction.

Another mechanism is the pressure adjustment mechanism of the pinch roller spring 24, namely the pressure adjustment mechanism for changing the pressure (spring force) which presses pinch roller 22 against the sheet transport roller 21. The embodiment is configured so as to rotate the whole of the pinch roller holder 23 to release the pinch roller 22. In the state in which the pinch roller 22 is pressed against the sheet transport roller 21, because the pinch roller spring 24 is pressed against the pinch roller holder 23, when the pinch roller holder 23 is rotated in the release direction, the pressure of the pinch roller spring 24 is increased, which results in an adverse effect such as the increase in load for releasing the pinch roller holder 23 and the increase in stress applied to the pinch roller holder 23 itself. The mechanism (pressure adjustment mechanism) which reduces the pressure of the pinch roller spring 24 in releasing the pinch roller holder 23 is provided in order to prevent the adverse effect.

Another mechanism is the up-and-down mechanism of the sheet passing guide. The guide member including the sheet passing guide 70 constitutes a first sheet passing path which guides the recording paper transported from the automatic sheet supply unit 37 and a part of a common portion of the first sheet passing path and a second sheet passing path which transports the recording paper to the automatic inversion unit including the both-side unit 2 or guides the recording paper supplied from the automatic inversion unit. As shown in FIG. 2, in order to guide the recording paper supplied from the main ASF 37 to the sheet transport roller 21, the sheet passing guide 70 is usually located at the position where the angle slightly rises from the horizontal path so that the recording paper is smoothly introduced to the nip portion of the LF roller 21. As described above, the LF roller 21 has slightly the angle relative to the horizon. However, in this case, when the recording paper is transported toward the direction indicated by the arrow b in FIG. 2, the recording paper is guided to toward the main ASF 37 again. Therefore, the configuration in which the angle of the sheet passing guide 70 is changed so that the sheet passing guide 70 becomes horizontal is more prefer in order to prevent this movement to smoothly guide the recording paper to the horizontal path. For this purpose, the up-and down mechanism which raises and lowers the sheet passing guide 70 as the guide member is provided.

Final one of the mechanisms is the up-and-down mechanism of the carriage 13. When the pinch roller holder 23 becomes the release state in which the pinch roller holder 23 is released from the sheet transport roller 21, the front end of the pinch roller holder 23 comes close to the carriage 13, and the front end of the pinch roller holder 23 abuts on the carriage 13 not to be moved in the main scanning direction. The up-and-down mechanism of the carriage 13 prevents the abutment of the front end of the pinch roller holder 23 on the carriage 13. Therefore, the up-and-down mechanism for raising the carriage 13 in synchronization with the release operation of the pinch roller holder 23 is provided. The up-and-down mechanism of the carriage 13 can be also applied to other uses. For example, the up-and-down mechanism of the carriage 13 can be also utilized when the recording head 11 is moved so as to be retracted, in order that the recording head 11 does not come into contact with the recording paper when the recording is performed to the thick recording paper.

Figure 3:
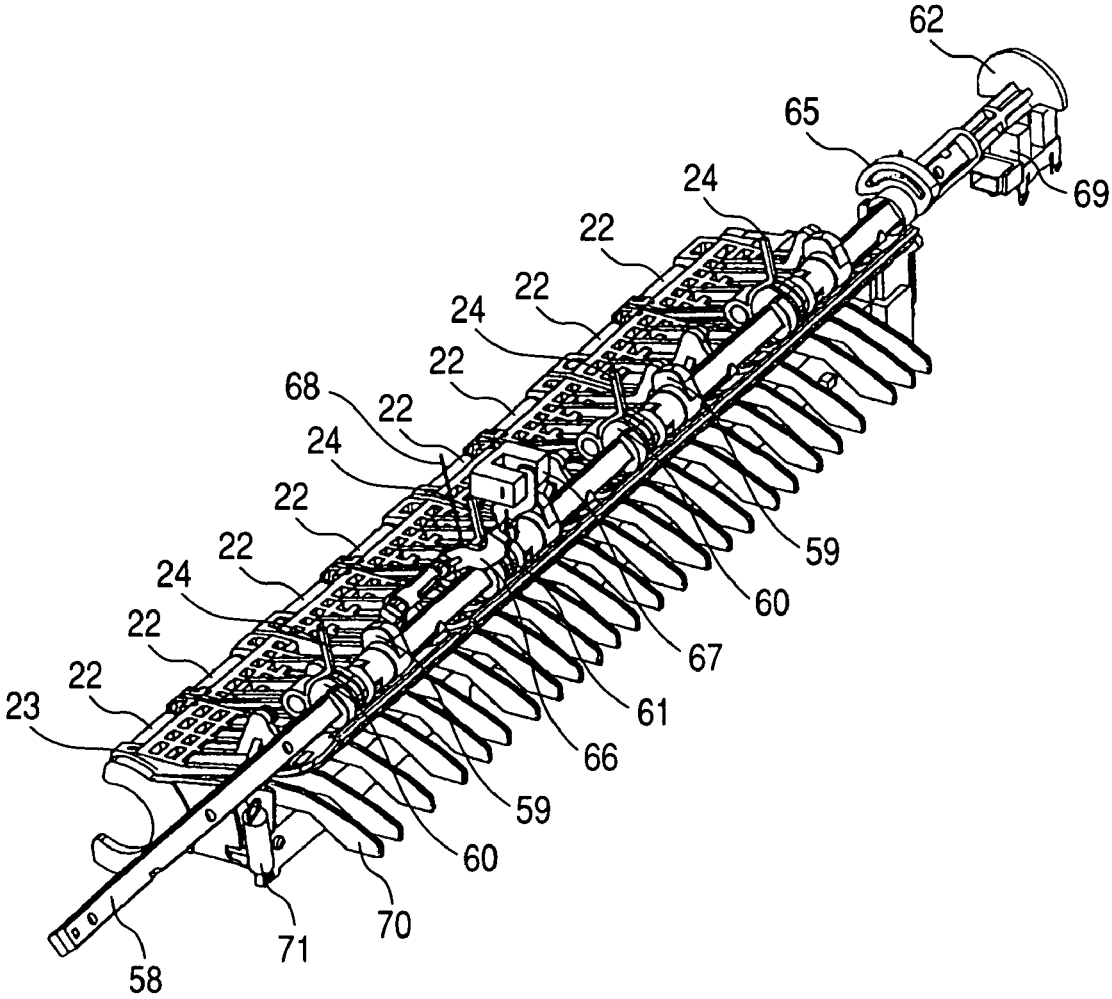
FIG. 3 is a schematic perspective view showing a pinch roller pressing and separating mechanism of the both-side recording apparatus according to the embodiment of the invention.

The above five mechanisms (the release mechanism of the pinch roller 22, the release mechanism of the PE sensor lever 66, the pressure adjustment mechanism of the pinch roller spring 24, the up-and-down mechanism of the sheet passing guide 70, and the up-and-down mechanism of the carriage 13) will be described in detail below. FIG. 3 is a schematic perspective view showing the outline configuration of the pinch roller release mechanism, the PE sensor lever release mechanism, the pinch roller spring pressure adjustment mechanism, and the sheet passing guide up-and-down mechanism.

In FIG. 3, the numeral 59 designates a pinch roller holder pressing cam which abuts on the pinch roller holder 23, the numeral 60 designates a pinch roller spring pressing cam which becomes a point of action of the pinch roller spring 24, the numeral 61 designates a PE sensor lever pressing cam which abuts on the PE sensor lever 66, the numeral 62 designates a lift cam shaft shielding plate which shows the angle of the lift cam shaft 58, the numeral 65 designates a sheet passing guide pressing cam which abuts on the sheet passing guide 70, the numeral 66 designates a PE sensor lever which comes into contact with the recording paper to detect the front end and rear end of the recording paper, the numeral 67 designates a PE sensor which light is permeated or transmitted and shielded by the PE sensor lever 66, the numeral 68 designates a PE sensor lever spring which biases the PE sensor lever 66 toward the predetermined direction, the numeral 69 designates a lift cam sensor in which the light is transmitted and shielded by the lift cam shaft shielding plate 62, and the numeral 71 designates a sheet passing guide spring which biases the sheet passing guide 70 toward the predetermined direction.

The pinch roller release mechanism, the PE sensor lever release mechanism, the pinch roller spring pressure adjustment mechanism, and the sheet passing guide up-and-down mechanism are operated by the rotation of the lift cam shaft 58. In the mechanisms of the embodiment, the pinch roller holder pressing cam 59, the pinch roller spring pressing cam 60, the PE sensor lever pressing cam 61, and the sheet passing guide pressing cam 65 are fixed to the lift cam shaft 58, so that each cam is formed to be operated in synchronization with one revolution of the lift cam shaft 58. At this point, the initial angle and the one revolution of the lift cam shaft 58 are recognized in such a manner that the lift cam shielding plate 62 transmits and shields the light of the lift cam sensor 69. The effect of the invention is not limited to the above configuration, and it is also possible to use the mechanism which independently drives each cam if necessary.

Figure 4A:
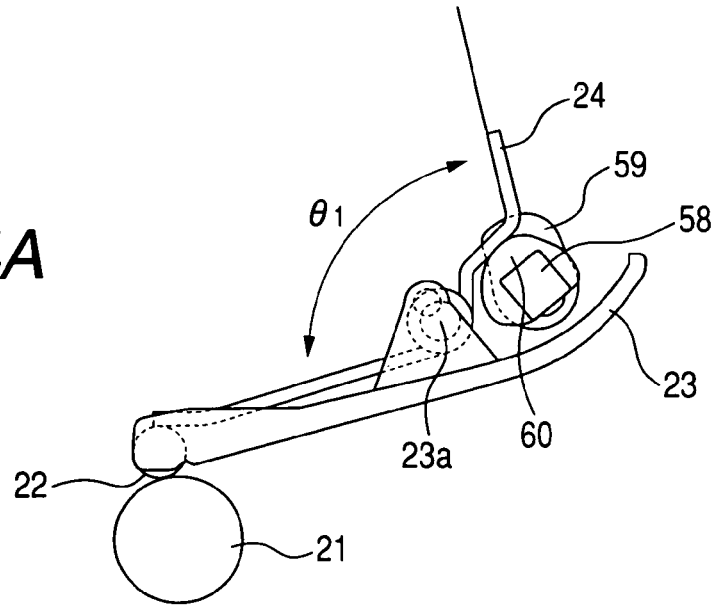
FIGS. 4A, 4B, and 4C are a schematic sectional side view showing the pinch roller pressing and separating mechanism of the both-side recording apparatus according to the embodiment of the invention.
Figure 4B:
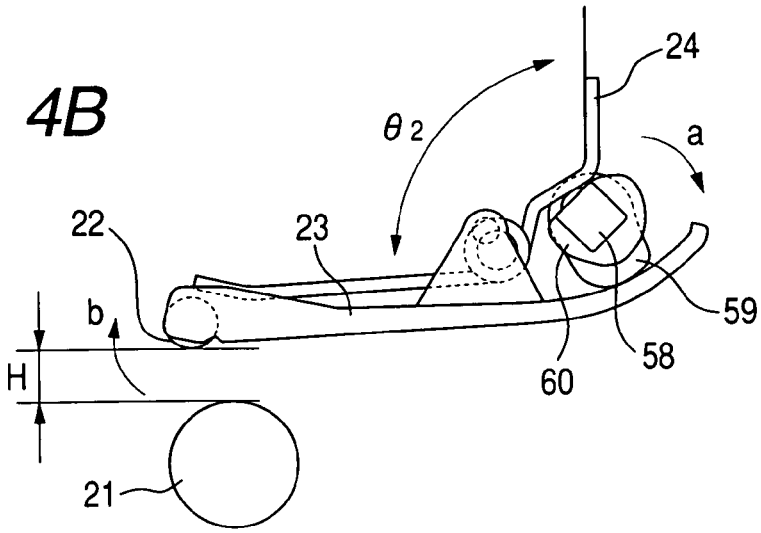
Figure 4C:
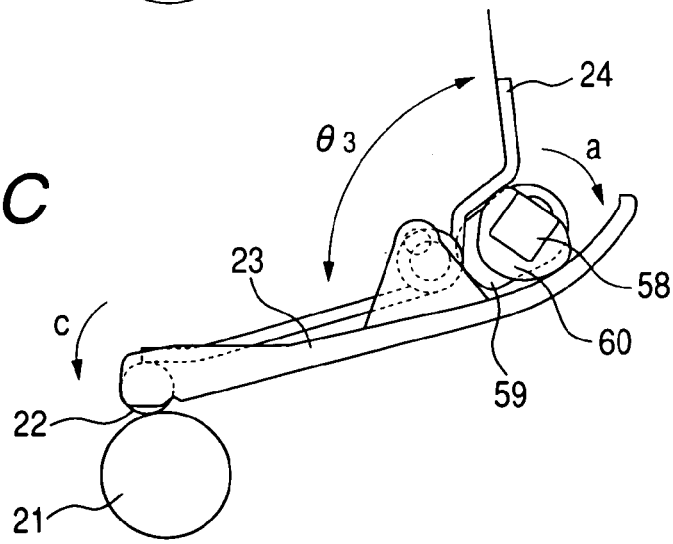

The operation of each mechanism will be described. FIGS. 4A to 4C are a partially side view showing schematically the operations of the pinch roller release mechanism and the pinch roller spring pressure adjustment mechanism. FIG. 4A shows the case in which the pinch roller holder pressing cam 59 is located in the initial position, the pinch roller 22 is pressed against the sheet transport roller 21, and the pressure of the pinch roller spring 24 is in a standard state. The pinch roller holder 23 is journaled in a bearing portion of the chassis 10 by a pinch roller holder shaft 23*a*, and the pinch roller holder 23 is formed to be rocked over the range of the predetermined angle. The pinch roller 22 is journaled in one end of the pinch roller holder 23, an area abutting on the pinch roller holder pressing cam 59 is provided in the other end of the pinch roller holder 23.

In FIG. 4A, the pinch roller spring 24 is a helical torsion coil spring in which one end of the pinch roller spring 24 is caused to abut on the pinch roller 22 side as a power point, the other end is supported by the pinch roller spring pressing cam 60, an intermediate part is supported by a support portion of the chassis 10. The pinch roller 22 is pressed against the sheet transport roller 21 with the predetermined pressure in the above-described manner. At this point, when the rotation driving mechanism of the sheet transport roller 21 is operated, the recording paper which is supported while sandwiched by the nip portion of the sheet transport roller 21 and the pinch roller 22 can be transported.

FIG. 4B shows the case in which the pinch roller 22 is released and the pinch roller spring 24 releases the force. Namely, when the lift cam shaft 58 is rotated in the direction of an arrow a in FIGS. 4A to 4C, the pinch roller holder pressing cam 59 abuts on the pinch roller holder 23 to gradually rotate the pinch roller holder 23 in the direction of an arrow b in FIGS. 4A to 4C, which allows the pinch roller 22 to be released from the sheet transport roller 21. In the state shown in FIG. 4B, the abutment surface of the pinch roller spring pressing cam 60 on the pinch roller spring 24 becomes a smaller diameter portion, and a twist angle $\theta_2$ of the pinch roller spring 24 is larger than a twist angle $\theta_1$ in FIG. 4A, so that the spring weight is decreased and the weight is not substantially applied to the pinch roller holder 23. Therefore, the stress is not substantially applied to the pinch roller holder 23. In this state, a predetermined gap H is formed between the sheet transport roller 21 and the pinch roller 22, even if the recording paper is roughly guided, the front end of the recording paper can be easily inserted into the nip portion.

FIG. 4C shows the light contact state in which, similarly to FIG. 4A, the pinch roller 22 is pressed against the sheet transport roller 21 but the pressing force is weak. In FIG. 4C, When the lift cam shaft 58 is further rotated in the direction of the arrow a in FIG. 4, the abutment between the pinch roller holder pressing cam 59 and the pinch roller holder 23 is gradually released, and the pinch roller holder 23 is rotated in the direction of an arrow c in FIG. 4 to return to the original state. The abutment surface of the pinch roller spring pressing cam 60 on the pinch roller spring 24 has an intermediate diameter between the case shown in FIG. 4A and the case shown in FIG. 4B.

Accordingly, a twist angle $\theta_3$ of the pinch roller spring 24 is slightly smaller than the twist angle $\theta_1$ in FIG. 4A, so that the force pressing the pinch roller 22 against the sheet transport roller 21 is slightly decreased. According to the above configuration, in the case where the thick recording paper is supported while sandwiched between the sheet transport roller 21 and the pinch roller 22, the twist angle of the pinch roller spring 24 becomes larger than normal, which allows the generation weight to the pinch roller holder 23 to be prevented from increasing. Therefore, in the case of both the recording paper having the normal thickness and the thick recording paper, rotational load caused by shaft loss of the sheet transport roller 21 can be leveled. When the one revolution of the lift cam shaft 58 is performed through the above-described states, the pinch roller release mechanism and the pinch roller spring pressure adjustment mechanism return to the state shown in FIG. 4A to become the standard state.

Figure 5A:
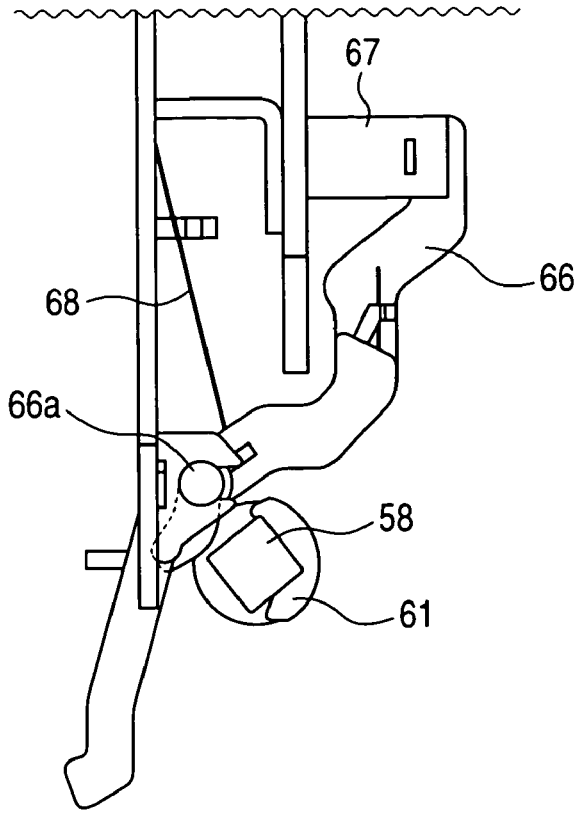
FIGS. 5A and 5B are a schematic sectional side view showing a PE sensor of the both-side recording apparatus according to the embodiment of the invention.
Figure 5B:
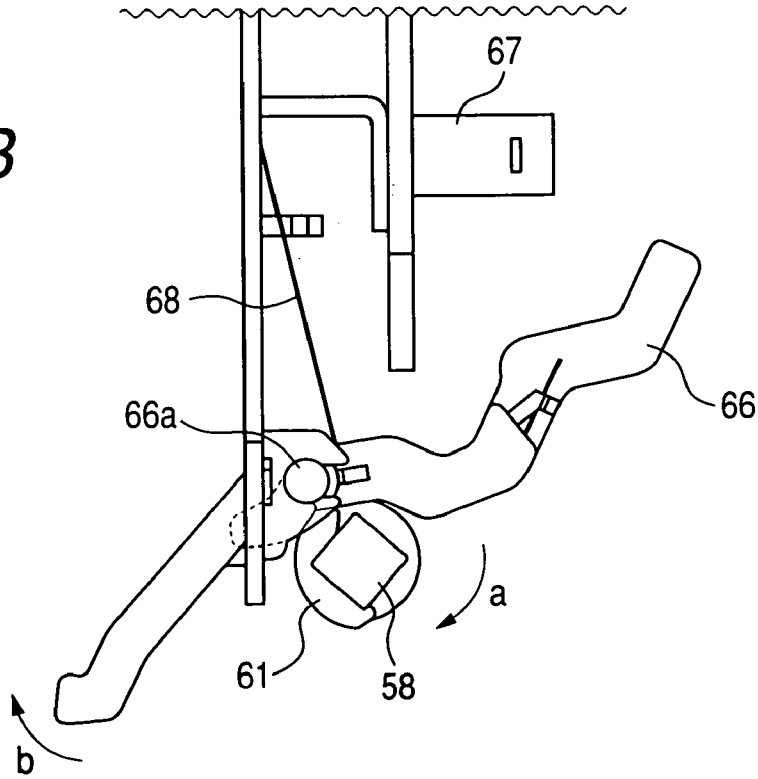

FIGS. 5A and 5B show the partially side view showing schematically the operation of the PE sensor lever up-and-down mechanism. FIG. 5A shows the case in which the PE sensor lever pressing cam 61 is located in the initial position and the PE sensor lever (paper detecting lever) 66 is free. The PE sensor lever 66 is journaled by supporting a PE sensor lever shaft 66*a* with the bearing portion of the chassis 10. In the state shown in FIG. 5A, the PE sensor lever 66 is biased to the position shown in FIG. 5A by the action of the PE sensor lever spring 68, and the shielding plate portion of the PE sensor lever 66 shields the PE sensor 67. When the recording paper passes through the region of the PE sensor lever 66, the PE sensor lever 66 is rotated in the clockwise direction in FIGS. 5A and 5B to become the state in which the PE sensor lever 66 transmits the light of the PE sensor 67, which enables the PE sensor 67 to detect the presence of the recording paper. The front end and the rear end of the recording paper can be sensed by the light shielding state or the light transmission state.

FIG. 5B is the partially side view showing schematically the state in which the PE sensor lever 66 as the paper detecting lever is locked. In FIG. 5B, When the PE sensor lever pressing cam 61 is rotated in the direction of an arrow a, a can follower portion of the PE sensor lever 66 is raised, and the PE sensor lever 66 is rotated in the direction of an arrow b. In this state, the paper detecting portion of the PE sensor lever 66 is hidden in the inside of the pinch roller holder 23. Even if the recording paper passes through, the recording paper never abuts on the PE sensor lever 66. Therefore, in this state, even if the recording paper is transported in the direction of the arrow b, the recording paper never collides with the PE sensor lever 66 to become the jam state.

Figure 6A:
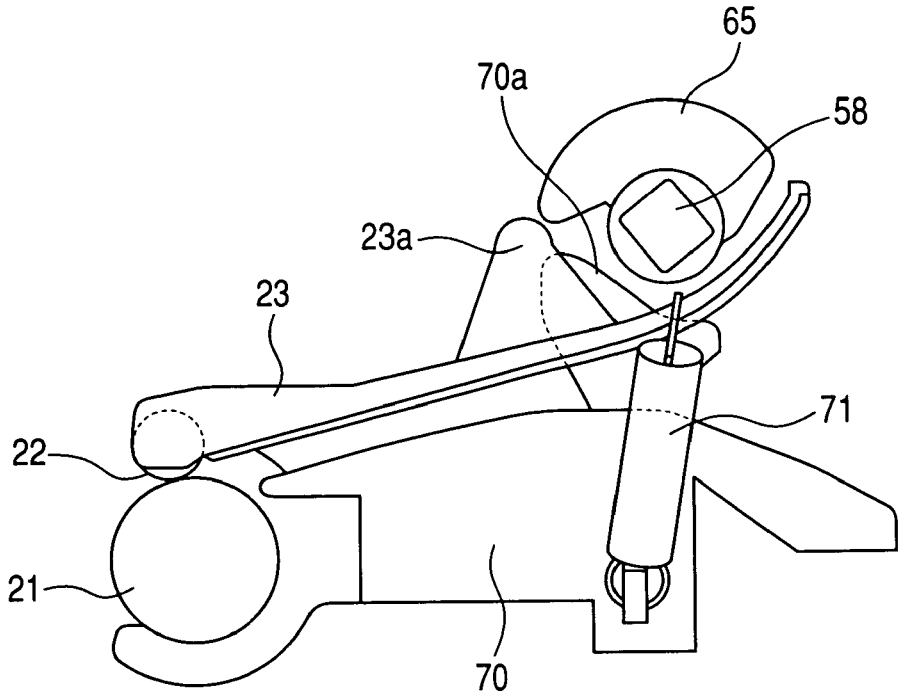
FIGS. 6A and 6B are a schematic sectional side view showing a sheet passing guide up-and-down movement mechanism of the both-side recording apparatus according to the embodiment of the invention.
Figure 6B:
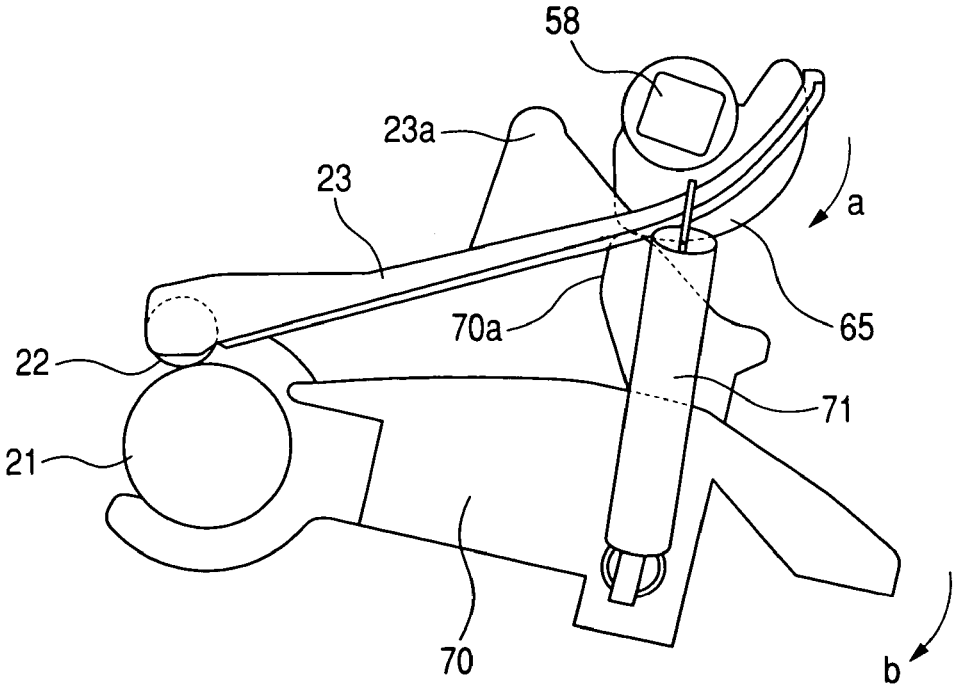

FIGS. 6A and 6B are the partially side view showing schematically the operation of the sheet passing guide up-and-down mechanism. FIG. 6A shows the case in which the sheet passing guide 70 as the guide member is in an up-state. In FIG. 6A, the sheet passing guide 70 is usually biased toward the direction in which the sheet passing guide 70 is raised by the sheet passing guide spring 71, the sheet passing guide 70 abuts on a stopper (not shown) to determined the position (raised position, up-position). In the case where the recording paper supplied from the main ASF passes through, the sheet passing guide 70 is held at the up-state by the action of the sheet passing guide spring 71 as the elastic member. However, in the case where the force larger than normal acts on the sheet passing guide 70, the sheet passing guide 70 is configured so as to be able to be lowered (become a down-state) against the biasing force of the sheet passing guide spring 71.

FIG. 6B shows the case in which the sheet passing guide 70 is in the down-state. In FIG. 6B, when the sheet passing guide pressing cam 65 fixed to the lift cam shaft 58 is rotated in the direction of an arrow a in FIGS. 6A and 6B, the sheet passing guide pressing cam 65 abuts on the sheet passing guide follower portion 70*a* which is a part of the sheet passing guide 70 to gradually press the sheet passing guide follower portion 70*a*. This allows the sheet passing guide 70 to be rotated in the direction of an arrow b in FIGS. 6A and 6B to be lowered against the biasing force of the sheet passing guide spring 71. In this state, a portion which faces the sheet passing path of the sheet passing guide 70 substantially becomes even, and the sheet passing path substantially completely becomes straight. Therefore, when the recording paper is transported toward the direction of the arrow b in FIG. 2 by the sheet transport roller 21, the recording paper is horizontally transported, and a part where the recording has been already performed on the surface of the recording paper is never pressed in the upward direction of the sheet passing path.

Figure 7:
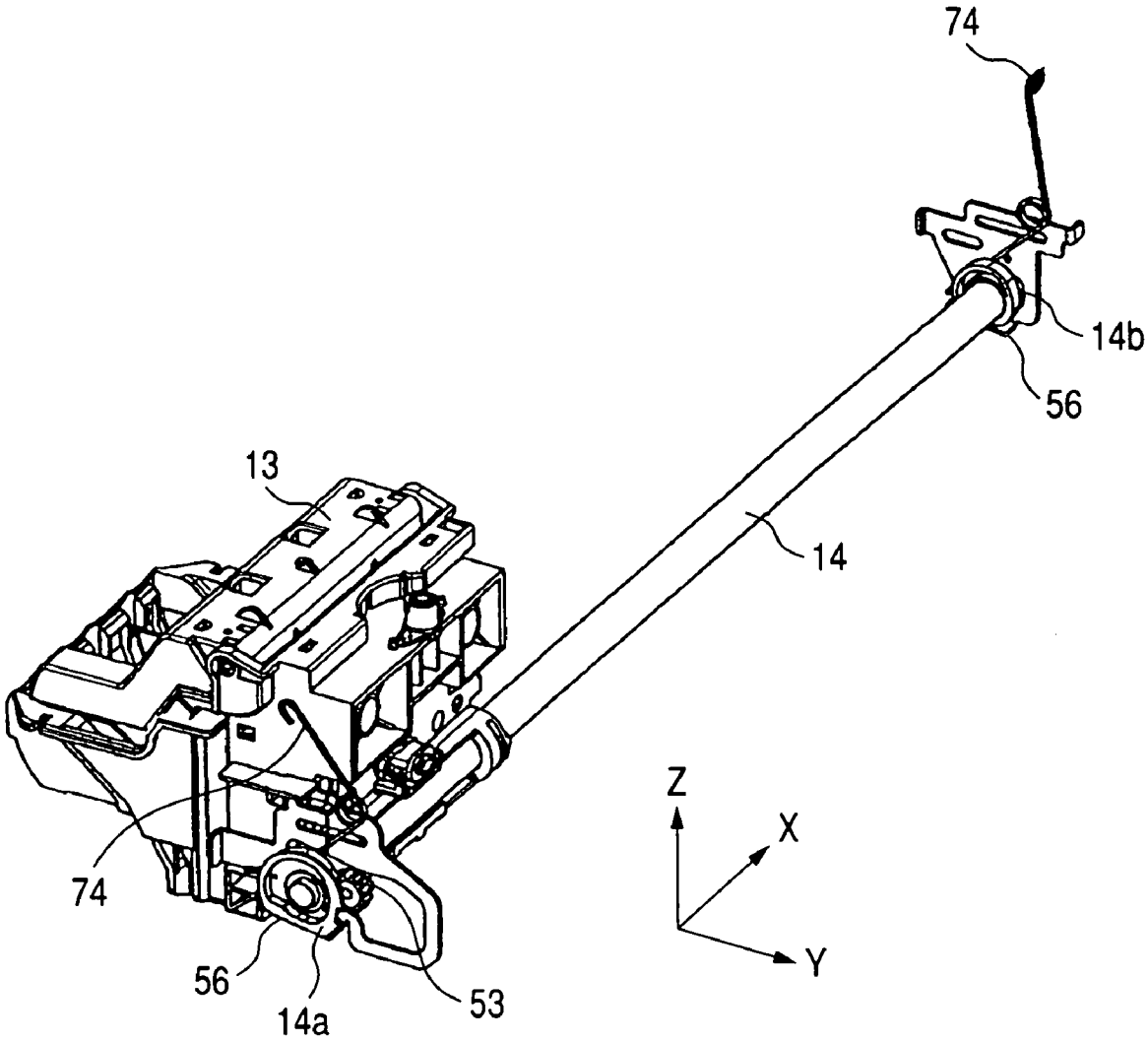
FIG. 7 is a schematic perspective view showing a guide shaft up-and-down movement mechanism of the both-side recording apparatus according to the embodiment of the invention.

FIG. 7 is the schematic perspective view showing the carriage up-and-down mechanism. In FIG. 7, the numeral 14*a* designates a right guide shaft cam attached to the guide shaft 14, the numeral 14*b* designates a left guide shaft cam attached to the guide shaft 14, and the numeral 53 designates a cam idler gear which integrally connects the lift cam gear 52 and the right guide shaft cam 14*a*. As shown in FIG. 1, the guide shaft 14 is supported by the both side surfaces of the chassis 10, and the guide shaft 14 is fitted in a guide long hole in vertical direction (not shown), so that the guide shaft 14 can be freely moved in the direction of an arrow Z in FIG. 7 but the movement in the directions of an arrow X and an arrow Y in FIG. 7 is controlled.

In the configuration of the mechanism shown in FIG. 7, the guide shaft 14 is usually biased in the downward direction (direction opposite to the arrow Z) by the guide shaft spring 74. When the cam idler gear 53 is rotated, the right guide shaft cam 14*a* and the left guide shaft cam 14*b* abut on the guide oblique surface 56, which allows the guide shaft 14 to move in the vertical direction while the guide shaft is rotated.

Figure 8A:
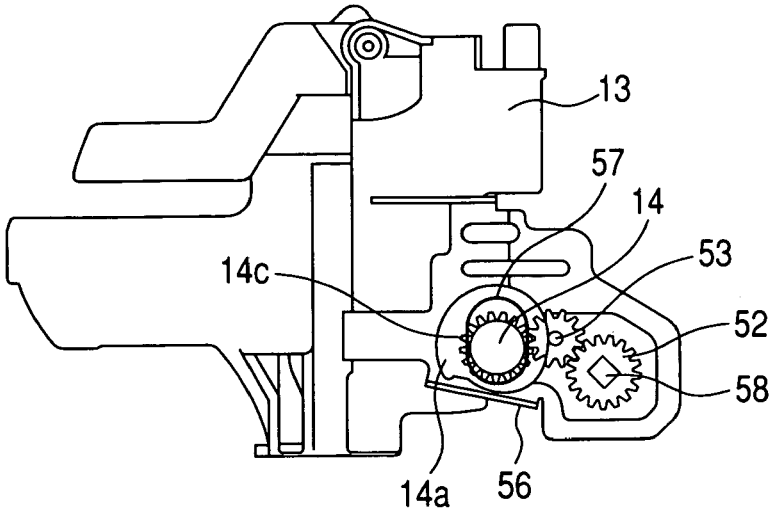
FIGS. 8A, 8B, and 8C are a schematic sectional side view showing the guide shaft up-and-down movement mechanism of the both-side recording apparatus according to the embodiment of the invention.
Figure 8B:
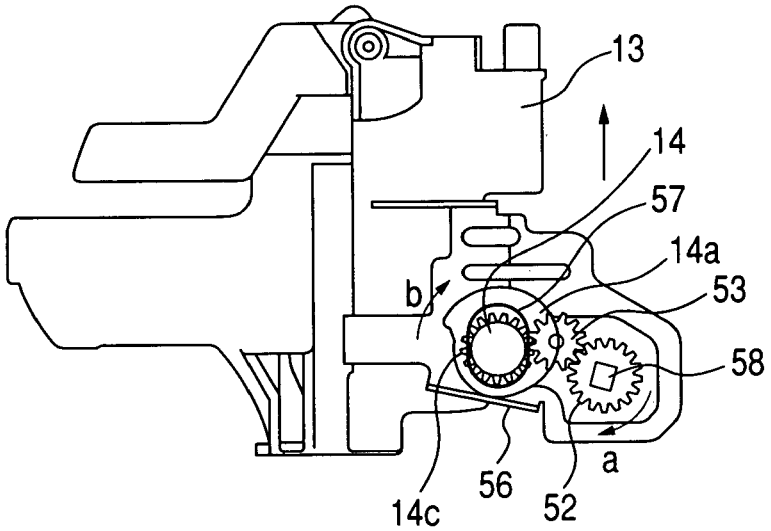
Figure 8C:
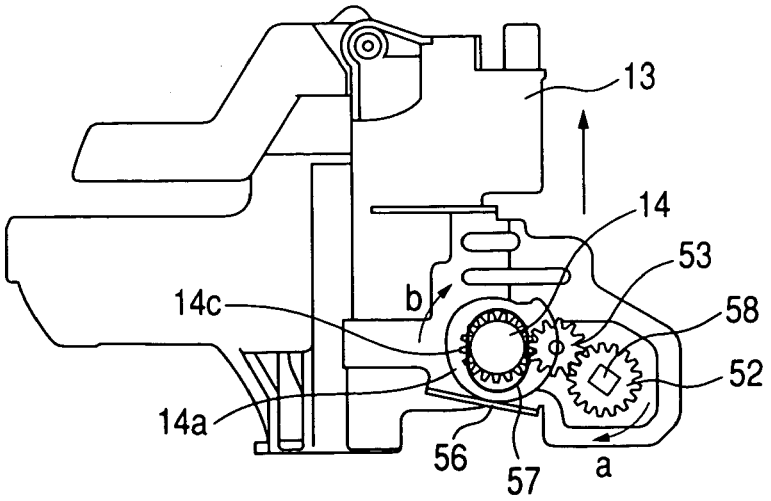

FIGS. 8A to 8C show the partially side view showing schematically the operation of the carriage up-and-down mechanism. FIG. 8A shows the case in which the carriage 13 is located in a first carriage position which is of the standard position. In this state, the guide shaft 14 is positioned by abutting the lowermost of the guide long hole 57 in the chassis 10, and the guide shaft cam 14*a* does not cone into contact with the guide oblique surface 56.

FIG. 8B shows the state in which the carriage 13 is moved to a second carriage position slightly higher than the first carriage position. When the lift cam gear 52 fixed to the lift cam shaft 58 is rotated by the rotation of the lift cam shaft 58, a guide shaft cam 14*c* is rotated through the cam idler gear 53 engaging the lift cam gear 52. The carriage 13 which is guided and supported by the guide shaft 14 is moved from the first carriage position to the second carriage position. At this point, when the number of teeth of the lift cam gear 52 is set to the same number of teeth of the guide shaft cam gear 14*c*, the lift cam shaft 58 and the guide shaft 14 are rotated by the substantially same angle in the same direction. The reason why the lift cam shaft 58 and the guide shaft 14 are not rotated by just the same angle is that, while the rotational shafts of the lift cam gear 52 and the cam idler gear 53 are fixed, the distance between the gears in the guide shaft cam gear 14*c* is fluctuated by the vertical movement of the guide shaft 14 itself which is of the rotational shaft.

When the lift cam shaft 58 is rotated in the direction of an arrow a in FIGS. 8A to 8C, the guide shaft 14 is rotated in the direction of an arrow b in FIGS. 8A to 8C. The guide shaft cams 14*a* and 14*b* abut on the fixed guide oblique surface 56 by the rotation of the guide shaft 14. As described above, since the moving direction of the guide shaft 14 is controlled only in the vertical direction of the guide long hole 57 in the chassis 10, the guide shaft 14 is moved to the second carriage position. In the case where the deformation of the recording paper is large and the recording paper collides with the recording head 11 in the first carriage position, it is preferable to set the carriage 13 to the second carriage position.

FIG. 8C shows the case in which the carriage 13 is located in the highest third carriage position. When the lift cam shaft 58 is further rotated from the second carriage position, radiuses of cam surfaces of the guide shaft cams 14*a* and 14*b* are increased, and the guide shaft 14 is moved to the further higher position. The third carriage position is preferable to the case in which the thick recording paper is used. The details of the five mechanisms, namely the pinch roller release mechanism, the PE sensor lever release mechanism, the pinch roller spring pressure adjustment mechanism, the sheet passing guide up-and-down mechanism, and the carriage up-and-down mechanism were described above.

Figure 9:
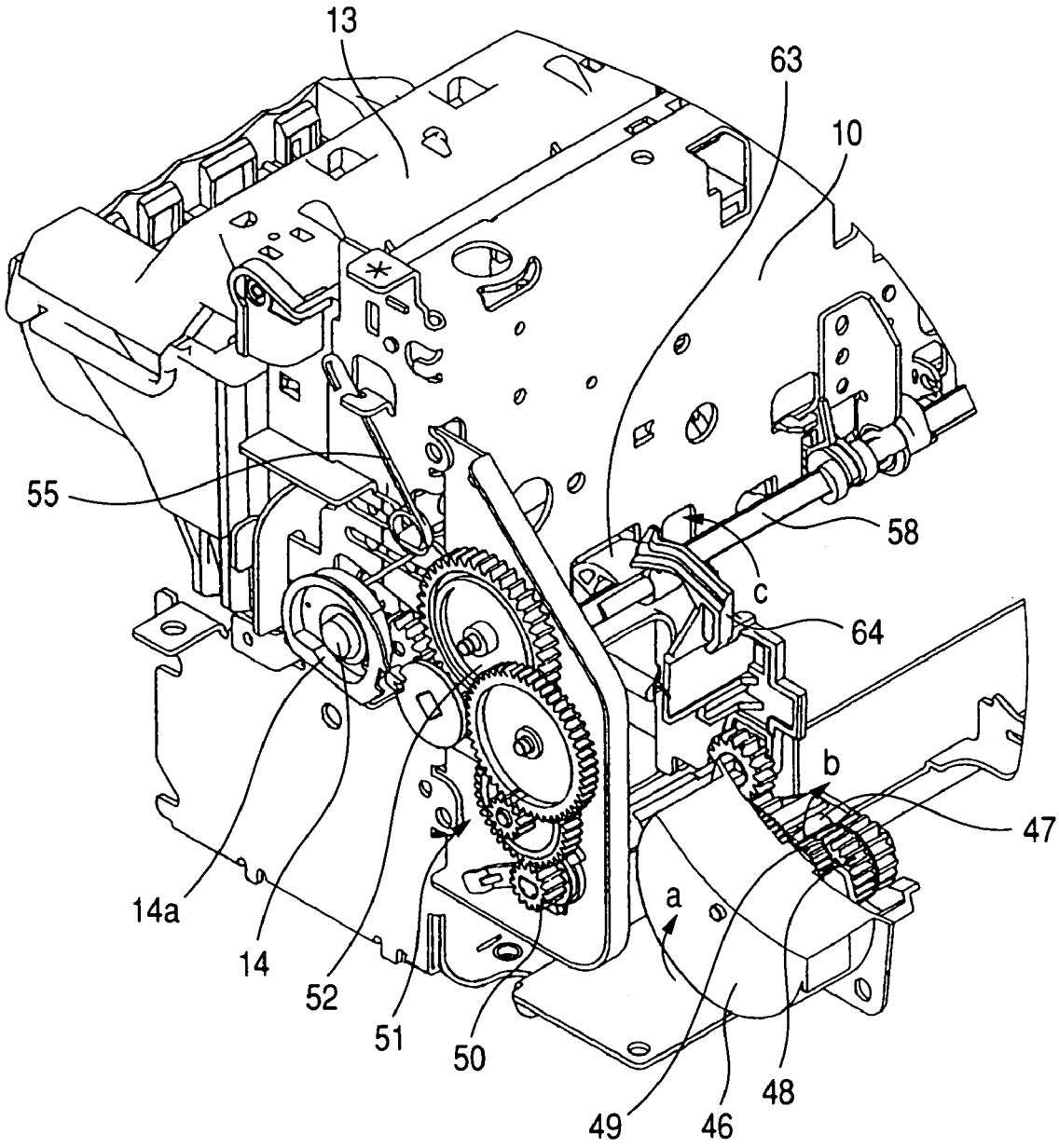
FIG. 9 is a schematic perspective view showing a driving mechanism of a cam lift shaft of the both-side recording apparatus according to the embodiment of the invention.

Then, the driving mechanism of the lift cam shaft 58 will be described below. FIG. 9 shows the schematic perspective view showing the driving mechanism of the lift cam shaft. In the embodiment, the driving source of the lift cam shaft 58 is the ASF motor 46 which also drives the main ASF 37. The proper control of the rotating direction and the amount of rotation of the ASF motor 46 can operate the main ASF 37 or the lift cam shaft 58. In FIG. 9, the numeral 46 designates the ASF motor which is of the driving source (upper half of the ASF motor is cut in order to show the gears), the numeral 47 designates an ASF pendulum arm which is located in the next stage of the gear attached to the ASF motor 46, the numeral 48 designates an ASF sun gear which is attached to the center of the ASF pendulum arm 47, the numeral 49 designates an ASF planet gear which is attached to the end portion of the ASF pendulum arm 47 to engage the ASF sun gear 48, the numeral 63 designates a pendulum lock cam fixed to the lift cam shaft 58, and the numeral 64 designates a pendulum lock lever which acts to the pendulum lock cam 63 to be rocked.

As described above, the driving force transfer direction is determined by the rotating direction of the ASF motor 46. In order to operate the lift cam shaft 58, the ASF motor 46 is rotated in the direction of an arrow a in FIG. 9. Then, the gear attached to the ASF motor 46 rotates the ASF sun gear 48. Because the ASF sun gear 48 and the ASF pendulum arm 47 rotatably engaged with each other with predetermined frictional force, the ASF pendulum arm 47 swings to the rotating direction (direction of an arrow b in FIG. 9) of the ASF sun gear 48. Then, the ASG planet gear 49 engages the lift input gear 50 of the next stage. This allows the driving force of the ASF motor 46 to be transferred to the lift cam gear 52 through the lift reduction gear train 51. At this point, the driving force to the gear train driving the main ASF 37 as the automatic sheet supply unit is cut, because the ASF pendulum arm 47 swings to the direction of the arrow b.

On the contrary, in the case where the ASF motor 46 drives the main ASF 37 of the automatic sheet supply unit, the ASF pendulum arm 47 swings to the direction opposite to the arrow b in FIG. 9 by rotating the ASF motor 46 in the direction opposite to the arrow a in FIG. 9. Therefore, the engagement between the ASF planet gear 49 and the lift input gear 50 is released, and the other ASF planet gear 49 provided in the ASF pendulum arm 47 engages the gear train on the main ASF 37 side to drive the main ASF 37. In the embodiment, a stepping motor is used as the ASF motor 46 and the stepping motor is controlled by open loop. Needless to say, it is also possible that an encoder is used in the DC motor to drive the ASF motor 46 by closed loop control.

In the case where the planet gear mechanism is used for the driving force transfer, when the load of the driven side becomes negative, the pendulum lock lever 64 is moved to remove the engagement of the gears and the phase of the driven side goes ahead of the driving source, and there is a possibility that the so-called ahead rotation occurs. In order to prevent the ahead rotation, the pendulum lock cam 63 and the pendulum lock lever 64 are provided in the embodiment. In the case where the lift cam shaft 58 is in the predetermined angle range, the pendulum lock lever 64 is rocked in the direction of an arrow c in FIG. 9 by the cam surface shape of the pendulum lock cam 63, and the pendulum lock lever 64 engages the ASF pendulum arm 47 to fix the main ASF 37 so that the main ASF 37 does not return to the driving side. Therefore, the ASF planet gear 49 always engages the lift input gear 50, so that the ASG motor 46 and the lift cam shaft 58 are always synchronously rotated.

When the pendulum lock cam 63 return to the predetermined angle range, the pendulum lock lever 64 returns to the direction opposite to the arrow c in FIG. 9, and the lock of the ASF pendulum arm 47 is released to return to the state in which the drive can be transferred to the main ASF side when the ASF motor 46 is reversely rotated. The release of the pinch roller 22, the lock of the PE sensor lever 66, pressure adjustment of the pinch roller spring 24, the vertical operation of the sheet passing guide 70, and the vertical operation of the carriage 13 can be performed by the driving mechanism of the lift cam shaft 58 described above. The above five movable mechanisms are collectively called a lift mechanism.

Figure 10A:
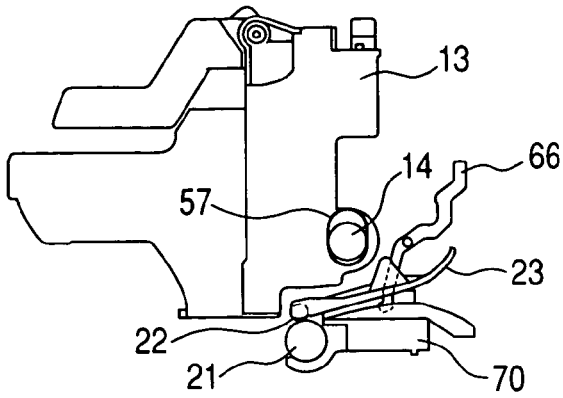
FIGS. 10A, 10B, 10C, and 10D are a schematic sectional side view showing a state at each position of a lift mechanism of the both-side recording apparatus according to the embodiment of the invention.

How these five movable mechanisms (lift mechanism) cooperate with one another to operate will be described below. FIGS. 10A to 10D are the schematic partially side view showing the operations of the carriage 13, pinch roller 22, the PE sensor lever 66, and the sheet passing guide 70. FIG. 10A shows the case in which the lift mechanism is located in a first position. In this state, the pinch roller 22 is pressed against the sheet transport roller 21, the PE sensor lever 66 is free, the pinch roller spring 24 (FIG. 4) is pressed with the normal pressure, the sheet passing guide 70 is in the up-state, and the carriage 13 is located in the first carriage position.

The state shown in FIG. 10A is the position utilized for the recording operation in which the normal recording paper is used or for the registration after the inversion of the recording paper in the automatic both-side unit 2. The carriage 13 is movably guided and supported along the guide shaft 14, and the carriage 13 is configured to be vertically moved by moving vertically the guide shaft 14 along the guide long hole 57 made in the chassis 10.

Figure 10B:
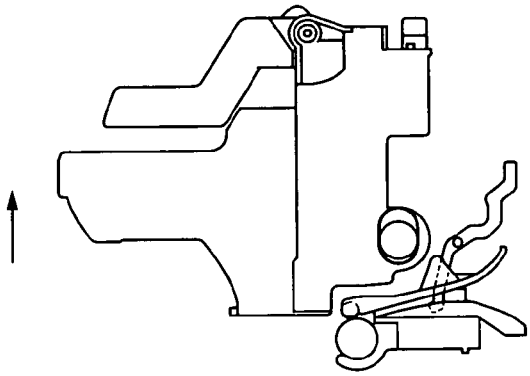

FIG. 10B shows the case in which the lift mechanism is located in a second position. In this state, the pinch roller 22 is pressed against the sheet transport roller 21, the PE sensor lever 66 is free, the pinch roller spring 24 (FIG. 4) is pressed with the normal pressure, the sheet passing guide 70 is in the up-state, and the carriage 13 is located in the second carriage position. The second position of the lift mechanism differs from the first position of the lift mechanism only in the height position of the carriage 13. The state shown in FIG. 10B is the position utilized in order to eliminate scraping between the recording paper and the recording head 11 due to the large deformation of the recording paper or to use the slightly thick recording paper.

Figure 10C:
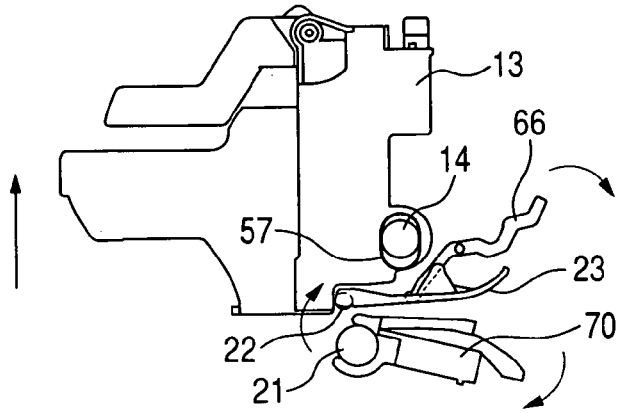

FIG. 10C shows the case in which the lift mechanism is located in a third position. In this state, the pinch roller 22 is released from the sheet transport roller 21 to make the predetermined gap, the PE sensor lever 66 is retracted upward to be locked, the pressing force of the pinch roller spring 24 (FIG. 4) is weakened, the sheet passing guide 70 is lowered, and the carriage 13 is located in the highest third carriage position. Compared with the second position of the lift mechanism, all the states are changed, and the sheet passing path is opened straight, the recording paper can be retracted. The state shown in FIG. 10C is the position utilized in order to transport the recording paper toward the direction of the arrow b in FIG. 2 after the front surface recording of the recording paper is terminated or to insert the thick recording paper.

Figure 10D:
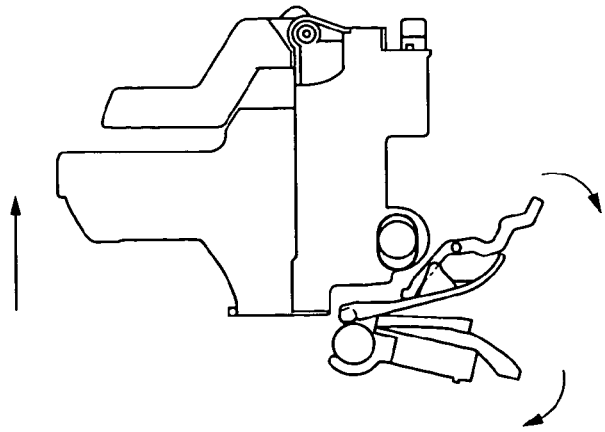

FIG. 10D shows the case in which the lift mechanism is located in a fourth position. In this state, the pinch roller 22 is pressed against the sheet transport roller 21, the PE sensor lever 66 is retracted upward to be locked, the pinch roller spring 24 (FIG. 4) is pressed with slightly weak pressure, the sheet passing guide 70 is lowered, and the carriage 13 is located in the highest third carriage position. Compared with the third position of the lift mechanism, the pinch roller 22 is returned to the state in which the pinch roller 22 is pressed against the sheet transport roller 21 and the pinch roller spring 24 is changed so as to be pressed with slightly weak pressure. The state shown in FIG. 10D is the position utilized for the case in which the recording paper is transported toward the automatic both-side unit 2 after re-retracting the recording paper during the automatic both-side recording or the case in which the recording is performed to the thick recording paper.

In the embodiment, in consideration of the operation of the recording apparatus, the mechanism is simplified by restricting the four positions of the lift mechanism shown in FIGS. 10A to 10D. Namely, the position is changed by circulating through the first position, the second position, the third position, the fourth position, and the first position. The invention is not limited to the above mechanism, and it is also possible that each mechanism element is configured to be properly independently moved. The pressure adjustment mechanism of the pinch roller spring 24 is not always necessary. In the case where the pinch roller holder 23 has sufficiently high rigidity, or in the case where the fluctuation in load of the LF motor 26 does not become problematic, the pressure adjustment mechanism of the pinch roller spring 24 can be omitted. Even if the sheet passing guide 70 is even by the arrangement of the main ASF 37 and the like, it is possible that the up-and-down mechanism of the sheet passing guide 70 can be removed, as long as the mechanism can well guide the front end of the recording paper into the nip portion of the sheet transport roller 21.

Figure 11:
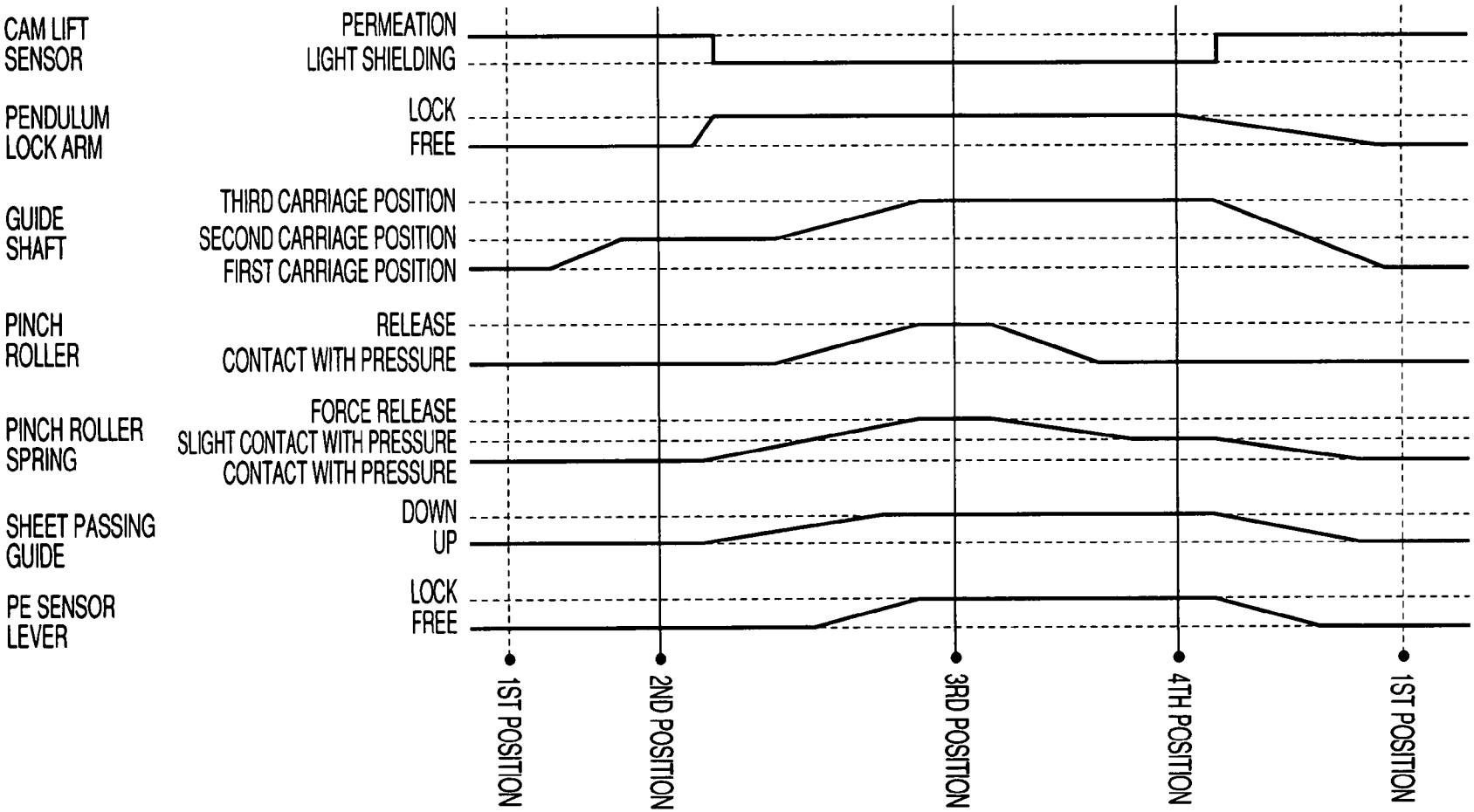
FIG. 11 is a timing chart showing an operational state of the lift mechanism of the both-side recording apparatus according to the embodiment of the invention.

FIG. 11 is a timing chart showing the operational state of the lift mechanism. In order to further easily recognize the contents described in FIGS. 4A to 10D, the description is performed again by the timing chart shown in FIG. 11. A horizontal axis of FIG. 11 shows the angle of the lift cam shaft 58 in the range of 360 degrees, a longitudinal axis shows the position of each mechanism element. In FIG. 11, the angle of the lift cam shaft 58 is detected with the lift cam sensor 69 (FIG. 3) by operating synchronously the lift cam shaft 58 and the guide shaft 14 and the rotational angle of the ASF motor 46 (FIG. 21) is controlled, which allows the plurality of mechanisms to be simultaneously operated. Up to this point the operation of the lift mechanism was described.

Figure 12A:
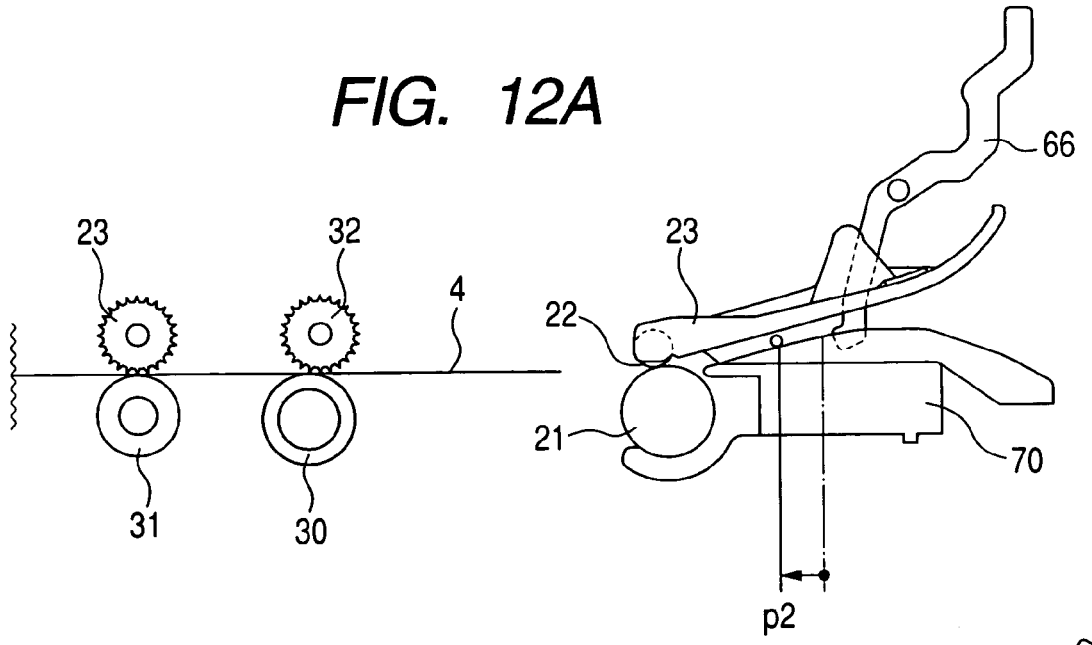
FIGS. 12A, 12B, and 12C are a schematic sectional side view showing an operational state of the lift mechanism of the both-side recording apparatus according to the embodiment of the invention.
Figure 12B:
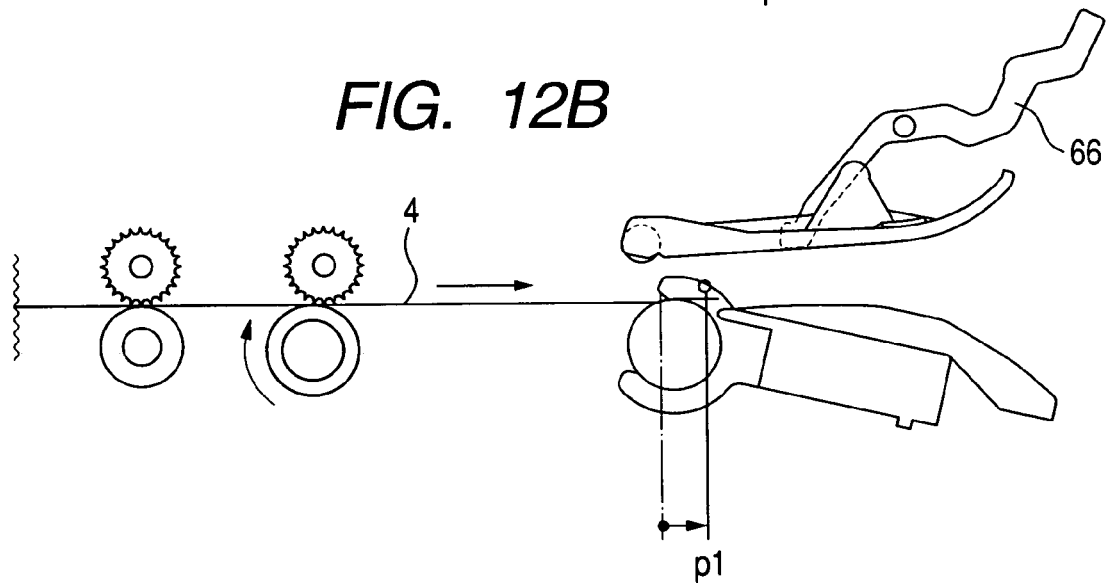
Figure 12C:
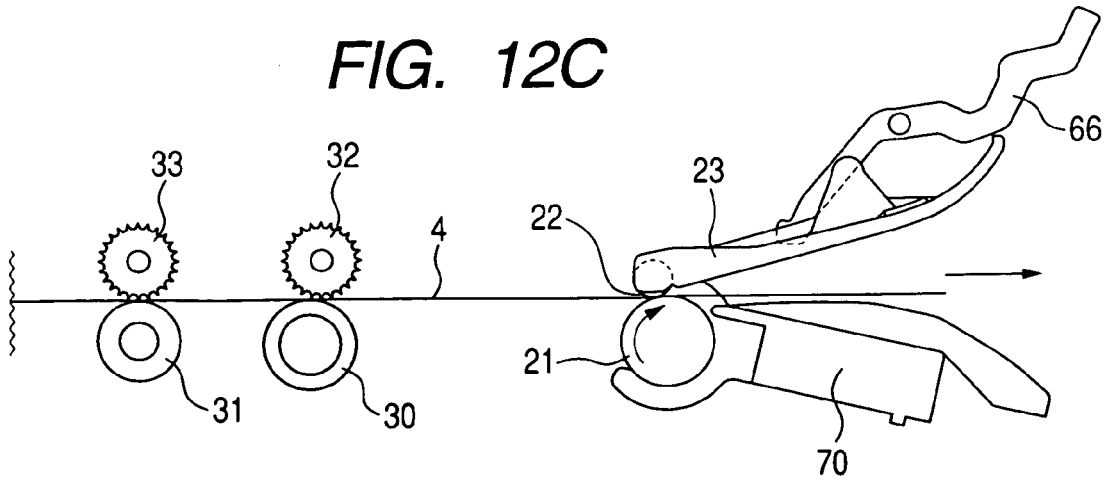

FIGS. 12A to 12C are the schematic side view for explaining the process in which the recording paper is brought into the nip portion of the sheet transport roller 21 again after the recording is performed to the front surface of the recording paper. The automatic both-side recording of the recording paper will be described below referring to FIGS. 12A to 12C. FIG. 12A shows the state in which the first sheet discharge roller 30, the first star gear train 32, the second sheet discharge roller 31, and the second star gear train 33 support recording paper 4 while sandwiching the recording paper 4 after the recording is performed to the front surface of recording paper 4. The first star gear train 32 and the second star gear train 33 are formed by the rotating body which the corresponding sheet discharge roller is pressed against to be rotated. At this point, the lift mechanism is in state of the first position or the second position. When the recording paper 4 proceeds to this state to perform the recording, since the discharge port string (nozzle string) of the recording head 11 can face the recording paper 4 up to the rear end portion of the recording paper 4, the recording can be performed without making the blank space of the lower end in the recording paper 4.

Then, the lift mechanism is moved to the third position shown in FIG. 12B to make the predetermined amount of large gap between the pinch roller 22 and the sheet transport roller 21. Therefore, the rear end of the recording paper 4 is easily brought into the gap, even if the rear end of the recording paper 4 undulates or curls. At this point, the pinch roller holder 23 and the carriage 13 do not interfere with each other, so that the carriage 13 is located at any position in the main scanning direction.

FIG. 12B shows the state in which the recording paper 4 is transported toward the direction of the arrow b in FIG. 2 (hereinafter the transport of the recording paper 4 in the direction of the arrow b in FIG. 2 is referred to as back feed) by rotating the first sheet discharge roller 30 from the state shown in FIG. 12A in the direction of the arrow in FIG. 12B and the recording paper 4 is moved to the position below the pinch roller 22 to be stopped at the position. The reason why the recording paper 4 is stopped at this state is that the recording apparatus of the embodiment adopts the wet type of inkjet recording method. Namely, immediately after the recording operation, the surface on which the recording has been performed (the upper surface in FIGS. 12A to 12C) of the recording paper 4 is in the state in which the surface is wet. When the recording paper 4 is immediately pressed by the pinch roller 22 and the sheet transport roller 21, the ink in transferred to the pinch roller 22, and the ink on the pinch roller 22 is transferred to the recording paper 4 again. As a result, there is a possibility that an ink stain is generated in the recording paper 4.

Whether the ink is transferred to the pinch roller 22 or not, i.e. whether the ink hit in the recording paper 4 is dried or not depends on various conditions. The conditions includes the kind of the recording paper, the kind of the using ink, a method of overstriking the using ink, an amount of using ink hit in the recording paper per unit area (for example, density per unit area of the recorded data), the ambient temperature in which the recording operation is performed, the ambient humidity in which the recording operation is performed, flow velocity of ambient gas in which the recording operation is performed, and the like. When the recording paper having an ink accepting layer to quickly introduce the ink inside the recording paper is used, the ink tends to be quickly dried. When the ink easy to penetrate the recording paper is used, the ink tends to be quickly dried. When the ink system in which the ink generating chemical reaction is used to be solidified by overstriking the ink on the surface of the recording paper is used, the ink tends to be quickly dried.

When the amount of ink hit in unit area is decreased, the ink tends to be quickly dried. When the ambient temperature in which the recording operation is performed is increased, the ink tends to be quickly dried. When the ambient humidity in which the recording operation is performed is decreased, the ink tends to be quickly dried. When the flow velocity of ambient gas in which the recording operation is performed is fastened, the ink tends to be quickly dried. Thus, since the required drying time is determined by the conditions, in the embodiment, the drying time required in performing the recording on the normal service condition (normal recording paper and normal recording operation environment) by using a predetermined ink system is specified to standard time, and the drying time is changed by the predictable condition.

The predictable condition is the amount of ink hit in unit area. Further, when ambient temperature detecting means, ambient humidity detecting means, ambient flow velocity detecting means, and the like are used with the amount of ink hit in unit area, dry standby time can be further predicted in detail. For example, the invention can adopt the method of determining the dry standby time in such a manner that the data received from the host apparatus 308 (FIG. 21) is stored in RAM 312 (FIG. 21), the amount of ink hit in unit area is calculated, and the maximum value of the amount of ink hit in unit area is compared to a predetermined threshold described in ROM 311 (FIG. 21). Namely, in the case where the amount of ink hit in unit area is large, the dry standby time is lengthened. In the case where the amount of ink hit in unit area is small, the dry standby time is shortened. Therefore, the dry standby time depending on the recording pattern can be optimized.

The dry standby time also depends on whether the kind of the ink used for the recording is dye ink or pigment ink. In the case of the dye ink, the dry standby time is shortened because the dye ink is easy to dry. In the case of the pigment ink, the dry standby time is lengthened because the pigment ink is not easy to dry. When the ambient temperature is high, since the ink is easy to dry, the dry standby time is shortened. When the ambient temperature is low, since the ink is not easy to dry, the dry standby time is lengthened. When the ambient humidity is high, since the ink is not easy to dry, the dry standby time is lengthened. When the ambient humidity is low, since the ink is easy to dry, the dry standby time is shortened. In the case of the recording paper having the ink accepting layer on the surface of the recording paper to immediately bring the hit ink inside the recording paper, since the ink is easy to dry on the surface of the recording paper, the dry standby time is shortened. In the case of the recording paper having high water repellency, since the ink is not easy to dry, the dry standby time is lengthened.

It is possible that the recording paper 4 is held at the position shown in FIG. 12A for the dry standby. Further, it is more preferable that the back feed of recording paper 4 is performed to the position shown in FIG. 12B to be held for standby. This is because the recording paper 4 is deformed. When the recording is performed to the recording paper through the wet type inkjet process, sometimes fiber of the recording paper is swollen because the recording paper absorbs moisture and the recording paper stretches. Sometimes a part where the paper stretches and a part where the paper does not stretch are formed in the recording paper. In this case, surface irregularity of the recording paper is remarkably formed. The amount of irregularity depends on elapsed time when the recording paper starts to absorb the moisture, and the amount of irregularity is gradually increased to reach the predetermined amount of deformation.

When the amount of deformation of the end portion of the recording paper is increased as the time elapses, even if the pinch roller 22 is sufficiently released from the sheet transport roller 21, there is a possibility that the end portion of the recording paper interferes with the pinch roller 22 to generate the jam. In order to prevent the jam, after the recording is terminated, the back feed is performed before the irregularity of the recording paper is increased, and the recording paper is moved to the position below the pinch roller 22. For the above-described reason, the back feed of the rear end of the recording paper 4 is performed to the position shown in FIG. 12B to wait until a part of the recording paper where the recording has been performed is dried. The gap between the sheet transport roller 21 and the pinch roller 22 during the release is set to the amount of the deformation of the recording paper after the recording of the front surface.

FIG. 12C shows the state in which the recording paper 4 is being transported toward the automatic both-side unit 2. After a part of the recording paper 4 where the recording has been performed is dried and the ink is not transferred to the pinch roller 22 even if the pinch roller 22 is pressed against the recording paper 4, the lift mechanism is moved to the fourth position as shown in FIG. 10D, and the pinch roller 22 and the sheet transport roller 21 support the recording paper 4 while sandwiching the recording paper 4. In this state, the sheet transport roller 21 is driven to perform the back feed of the recording paper 4. At this point, since the PE sensor lever 66 is rotated upward to be locked, the front end of the PE sensor lever 66 does not break into the recording paper 4 nor scrape against the part where the recording has been performed to peel off.

Since the sheet passing guide 70 is in the down-state, the sheet passing surface substantially becomes even, and the recording paper 4 can be transported in straight line toward the automatic both-side unit 2. In the embodiment, normally the sheet passing guide 70 is in the up-state. The invention is not limited to this state, and it is also possible that the normal state of the sheet passing guide 70 is set to the down-state. Namely, it is also possible that the sheet passing guide 70 is configured to be moved to the first position during the sheet supply operation from the main ASF 37. The recording paper having high rigidity can be smoothly inserted by the above configuration when the recording paper having the high rigidity is inserted from the sheet discharge roller side. The termination of the front surface recording of the recording paper 4 to the transport process of the recording paper 4 to the automatic both-side unit 2 was described above.

Figure 13:
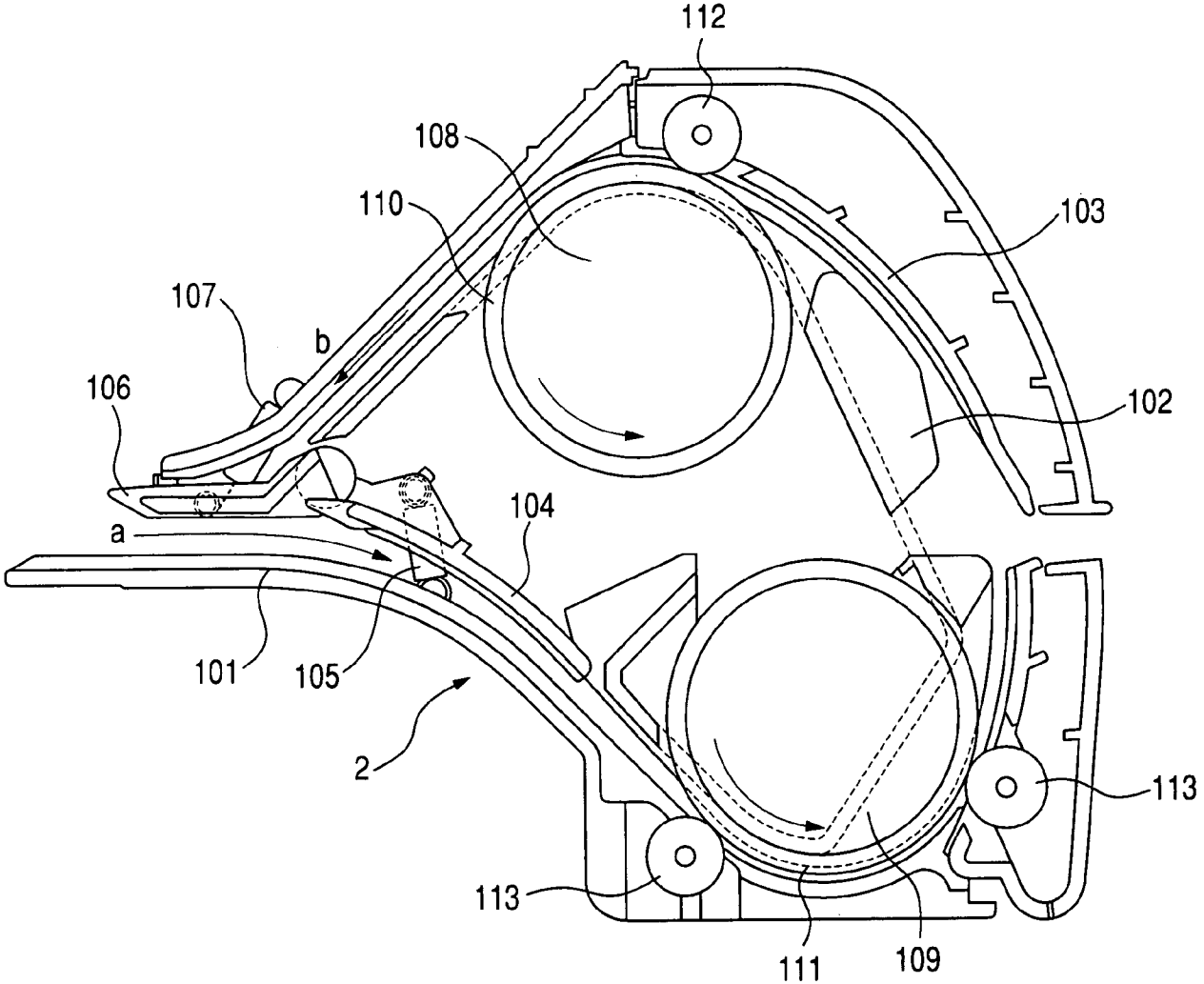
FIG. 13 is a schematic sectional side view showing a configuration of an automatic both-side unit (automatic inversion unit, paper inversion unit) of the both-side recording apparatus according to the embodiment of the invention.

FIG. 13 is the schematic sectional side view showing an installation state of the sheet passing path and the sheet transport roller in the automatic both-side unit 2 which is of the paper inversion unit or the automatic inversion unit. A recording paper transport mode inside the automatic both-side unit 2 will be described referring to FIG. 13. In FIG. 13, the numeral 101 designates a both-side unit frame constituting a part of a structure of the automatic both-side unit 2 and a sheet transport path, the numeral 102 designates an inner guide which is fixed to the inside of the both-side unit frame 101 and constitutes a part of the sheet transport path, the numeral 103 designates a rear cover which is openably and closably arranged at the back of the both-side unit frame 101 and constitutes a part of the sheet transport path, the numeral 105 designates a changeover flap spring biasing the changeover flap 104 toward the predetermined direction, the numeral 107 designates an outlet flap spring biasing the outlet flap 106 toward the predetermined direction, the numeral 110 designates a both-side roller rubber A which is a rubber portion of the both-side roller A 108, and the numeral 111 designates a both-side roller rubber B which is a rubber portion of the both-side roller B 109.

When the recording paper 4 is transported to the automatic both-side unit 2 from the state shown in FIG. 12C, the introduction path can be clearly determined in only one, because the outlet flap 106 is biased to the position shown in FIG. 13 by the action of the outlet flap spring 107. Therefore, the recording paper 4 proceeds toward the direction of an arrow a. In the case where the recording paper 4 abuts on the changeover flap 104 which is of the movable flap and the normal both-side recording can be performed to the recording paper 4, because the load of the changeover flap spring 105 is set so that the changeover flap 104 is not rotated, the recording paper 4 proceeds along the sheet passing path between the changeover flap 104 and the both-side unit frame 101. Then, the recorded surface (front surface) of the recording paper 4 abuts on the both-side roller rubber B 111 of the both-side roller B 109, and the recording paper 4 is supported by the both-side roller B 109 and the both-side pinch roller B 113 while sandwiched in the direction in which the unrecorded surface (reverse surface) abuts on the both-side pinch roller B 113 made of polymer resin having high lubricity.

At this point, the circumferential speeds of the both-side roller A 108, the both-side roller B 109, and the sheet transport roller 21 are set by the driving mechanism described later so that the both-side roller A 108, the both-side roller B 109, and the sheet transport roller 21 are substantially rotated at the same speed, so that the recording paper 4 is transported without generating a slide between the recording paper 4 and the both-side roller B 109. Since circumferential speeds of these rollers are substantially the same, the recording paper 4 is not loosened or the recording paper 4 is not tensioned. When the proceeding direction of the recording paper 4 is changed by the both-side roller B 109, the recording paper 4 proceeds along the rear cover 103, and similarly the recording paper 4 is supported by the both-side roller rubber A 110 of the both-side roller A 108 and the both-side pinch roller A 112 while sandwiched.

The proceeding direction of the recording paper 4 is changed by the both-side roller A 108 again, and the recording paper 4 is transported toward the direction of an arrow b in FIG. 13. The both-side roller A 108 the both-side roller B 109 constitutes the reverse roller for inverting the surfaces of the recording paper 4 or reversing the transport direction of the recording paper 4. When the recording paper 4 directly proceeds, the front end of the recording paper 4 abuts on the outlet flap 106. Because the outlet flap 106 is biased by the outlet flap spring 107 having the very weak load, the recording paper 4 pushes away the outlet flap 106 to go out from the automatic both-side unit 2. Because the sheet passing path length in the automatic both-side unit 2 is set so that the rear end of the recording paper 4 passes through below the outlet flap 106 when the front end of the recording paper 4 goes out from the outlet flap 106, the front end and the rear end of the recording paper 4 never scrape with each other.

Although the detail flow chart is described later, the length of the recording paper 4 can be measure by the PE sensor lever 66 when the recording is performed to the surface of the recording paper 4. Therefore, in the case where the recording paper which is shorter than the distance between the sheet transport roller 21 and the both-side roller B 109 or the distance between the both-side roller A 108 and the sheet transport roller 21 or the recording paper which is longer than the distance around the sheet passing path from the outlet flap 106 to the outlet flap 106 is inserted, a warning is given at a stage in which the recording of the surface is terminated, and the recording paper 4 is discharged without transporting the recording paper 4 to the automatic both-side unit 2.

The reason why the recorded surface of the recording paper 4 is transported while the recorded surface faces the both-side roller rubber A 110 or the both-side roller rubber B 111 will be described. The both-side roller rubber A 110 and the both-side roller rubber B 111 are the driving side, and the both-side pinch roller A 112 and the both-side pinch roller B 113 are the coupled driving side, so that the recording paper 4 is transported while following the driving roller side, and the coupled driving side is rotated by the friction force between the recording paper 4 and the roller. At this point, it is necessary that the shaft loss of the rotating shaft which journal the both-side pinch roller A 112 and the both-side pinch roller B 113 is sufficient small. However, when the shaft loss is increased by some kind of a cause, there is possibility that the slide is generated between the recording paper 4 and the both-side pinch roller A 112 or the both-side pinch roller B 113. The region where the recording is performed in the recording paper 4 is dried to a degree that the ink is not transferred by abutting on the roller. However, when the recording paper 4 is scraped, there is also a possibility that the ink is removed from the surface of the recording paper 4.

When the slide is generated between the recorded surface of the recording paper 4 and the both-side pinch roller A 112 or the both-side pinch roller B 113 while the recorded surface is in contact with the rollers, there is a possibility that the ink is removed from the recorded surface of the recording paper 4. In order to prevent the ink removal, in the embodiment, the driving side member is arranged so as to abut on the recorded surface (front surface) side, and the coupled driving member is arranged so as to abut on the unrecorded surface (reverse surface) side. The following reason can be also cited as another reason on the arrangement. Namely, since the both-side roller A 108 or the both-side roller B 109 on the driving side has the restriction of a rending radius of the recording paper 4, the diameter can not be formed lower than a certain degree. However, since the diameters of the both-side pinch roller A 112 and the both-side pinch roller B 113 can be formed in the dimension smaller than the both-side roller A 108 or the both-side roller B 109, in order to design the compact automatic both-side unit 2, the diameter of the both-side pinch roller A 112 or the both-side pinch roller B 113 is often designed in the small dimension.

Basically the ink is not transferred from the recorded surface of the recording paper 4 to the roller side. However, sometimes the very small amount of ink is transferred and the roller abutting on the recorded surface becomes dirty with the ink. In the case of the roller having the smaller diameter, contact frequency of an outer periphery of the roller with the recording paper is increased, and the soiling speed is fastened compared with the roller having the larger diameter, so that the roller having the smaller diameter is disadvantageous to the soil. In the embodiment, from the viewpoints of miniaturization of the apparatus and the soil of the roller, the both-side roller A 108 and the both-side roller B 109 which have the larger diameter are arranged on the side where the roller abuts on the recorded surface (front surface) of the recording paper.

Further, the following reason can be also cited as another reason on the arrangement. Namely, in the case where the pair of rollers in which one roller is driven supports the recording paper while sandwiching the recording paper and transports the recording paper, in order to ensure the accurate amount of transport, in many cases, the roller on the driving side is made of the material having a high friction coefficient, the roller on the coupled driving side is made of the material having the low friction coefficient, and either the roller on the driving side or the roller on the coupled driving side is made of the elastic material to obtain the large area of the nip portion (nip area). Usually the roller on the driving side is made of the rubber materials (rubber-like elastic body). The rubber materials obtain the high friction coefficient at relatively low cost and have the high elasticity. Means in which polishing is performed onto the surface made of rubber including elastomers to intentionally make the minute irregularity of polishing marks is often used in order to increase transport force. In this case, the coupled driving side is usually made of the polymer resin having the relatively small friction coefficient.

In the case where the surface of the rubber materials having the minute irregularity and the surface of the polymer resin having the flat and smooth surface are compared, the soil of the ink adheres to both the surfaces of the rollers when the surfaces abut on the recorded surface of the recording paper. In the surface of the rubber materials having the minute irregularity, the small mount of soil is transferred to the recording paper because the minute irregularity holds the soil. On the other hand, in the surface of the polymer resin having the flat and smooth surface, the soil is removed from the surface of the polymer resin to transfer the recording paper again. Therefore, it is advantageous that the rubber materials abut on the recorded surface of the recording paper. In the embodiment, the roller made of the rubber materials is arranged on the side which abuts on the recorded surface (front surface) of the recording paper and the roller made of the polymer resin materials is arranged on the side which abuts on the unrecorded surface (reverse surface) of the recording paper. Up to this point, the reverse operation for performing the both-side recording of the normal recording paper has described.

For the case in which the automatic both-side recording is not performed and the recording is performed to the recording medium having the high rigidity, the operation of the automatic both-side unit 2 will be described below. It is assumed that, for example, the recording medium having the high rigidity is the thick paper whose thickness ranges from 2 mm to 3 mm or the circular or irregular-shaped recording medium which is mounted on a predetermined tray. Since the recording medium has high rigidity, the recording paper can not be bent to a degree that the recording medium follows the diameter of the both-side roller of the automatic both-side unit 2 and the both-side recording can not be performed. However, there is a possibility that the recording is performed to the recording medium having the high rigidity while the automatic both-side unit 2 is attached to the recording apparatus. Since the sheet supply can not be also performed by utilizing the main ASF in the case of the recording medium having the high rigidity, the straight sheet passing path is used. This allows the recording medium to be supplied from the sheet discharge roller side toward the sheet transport roller 21 side. For this case, the operation of the automatic both-side unit 2 will be described below.

Figure 14A:
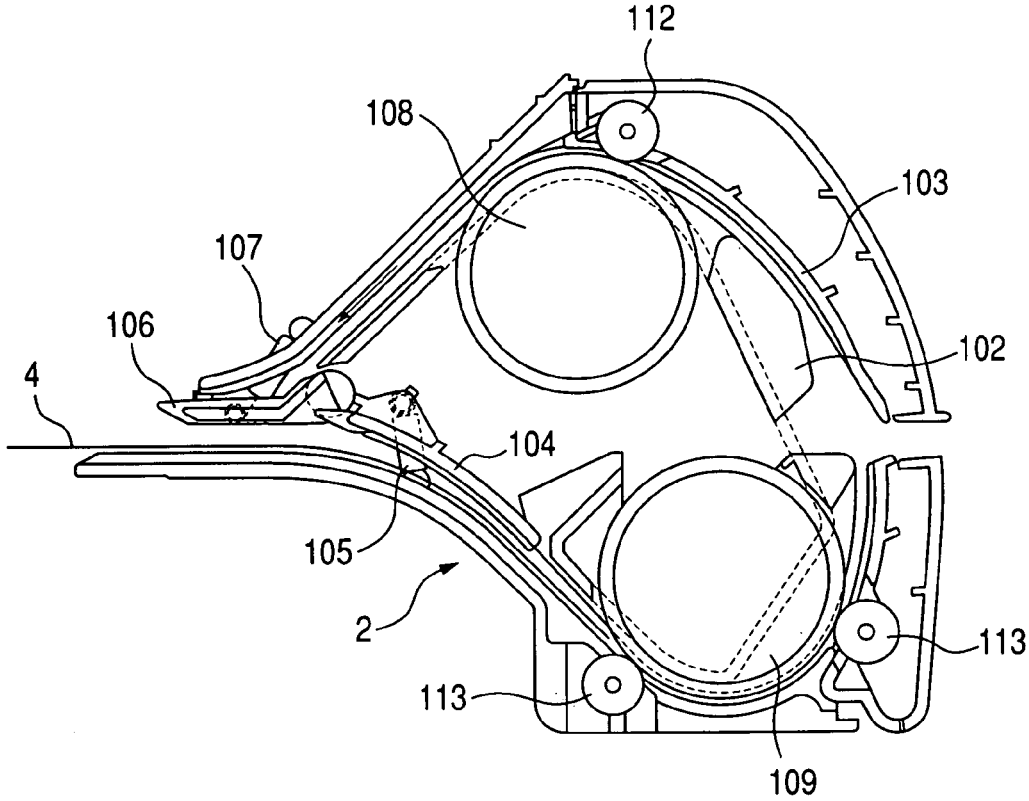
FIGS. 14A and 14B are a schematic sectional side view showing operation of a flap in the automatic both-side unit of the both-side recording apparatus according to the embodiment of the invention.
Figure 14B:
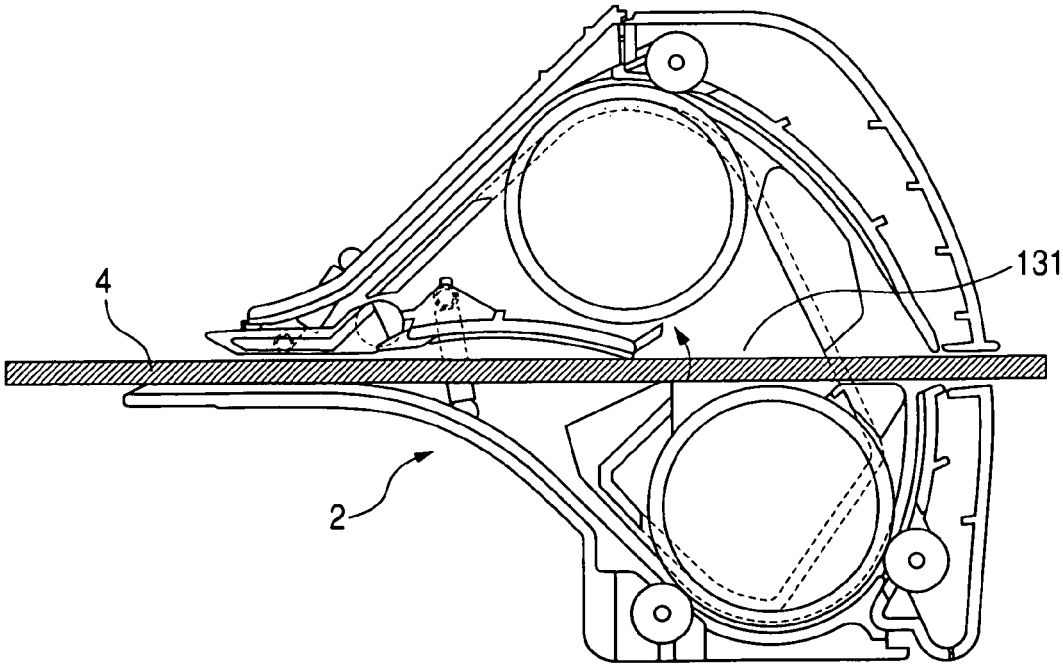

FIGS. 14A and 14B are the schematic sectional side view for explaining the operation of the changeover flap 104. FIG. 14A shows the case in which the automatic both-side recording is performed with the normal recording paper. In this case, the changeover flap spring 105 continues to bias the changeover flap 104 to the stopper against the pressing force of the recording paper 4, so that the recording paper 4 is guided to the sheet passing path which reverses the recording paper 4.

FIG. 14B shows the state in which the recording medium having the high rigidity (including the recording paper) is used. When the recording medium 4 having the high rigidity is transported to the automatic both-side unit 2, the recording medium passes through below the outlet flap 106 to abut on the changeover flap 104. In the changeover flap spring 105, the spring load is set to a degree that, when the recording medium having the high rigidity is inserted to press the changeover flap 104, the changeover flap 104 is retracted by the pressing force of the recording medium, so that the changeover flap spring 105 is rotated in the counterclockwise direction (arrow direction) in FIG. 14B to be retracted as the recording medium having the high rigidity proceeds. Therefore, the recording medium having the high rigidity is guided to a retracting path 131 which is of a second sheet passing path provided between the both-side roller A 108 and the both-side roller B 109. Because a hole (through hole, opening) is made in the region corresponding to the retracting path 131 of the rear cover 103, even if the long recording medium having the high rigidity is used, the recording medium does not interfere the automatic both-side unit 2 to restrict the transport.

Figure 22:
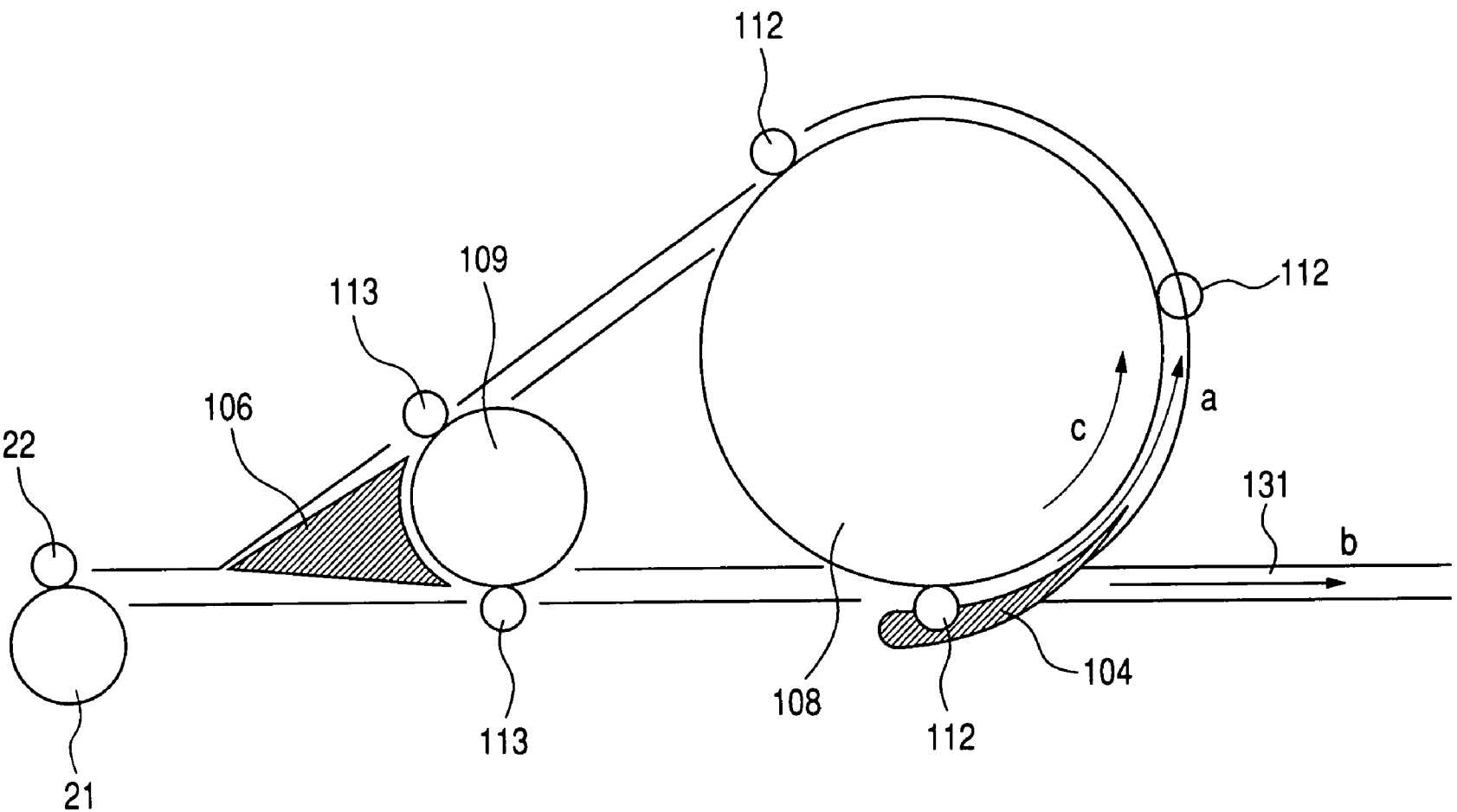
FIG. 22 is a schematic sectional side view showing another configuration of automatic both-side unit of the both-side recording apparatus according to the embodiment of the invention.

The invention is not limited to the configuration described above referring to FIG. 14B. Namely, in realizing the invention, it is not always necessary to provide the retracting path 131 between the two upper and lower both-side rollers 108 and 109, and the following configuration can be performed. FIG. 22 is the schematic sectional side view showing the automatic both-side unit in which the both-side roller having the large diameter is arranged above the substantially horizontal path. In FIG. 22, the changeover flap 104 is biased to the position shown in FIG. 22 by the changeover flap spring (not shown), and the spring force (pressing force) of the changeover flap spring is set to the load so that the changeover flap 104 can be rotated when the recording medium having the high rigidity abuts on the changeover flap 104. In FIG. 22, the components corresponding to those shown in FIG. 13 and FIGS. 14A and 14B are indicated by the same reference numeral, and the detail description of the same component is omitted.

In the case of the recording paper having the low rigidity, the recording paper proceeds toward the direction of an arrow a by rotating the both-side roller A 108 in the direction of an arrow c in FIG. 22. In the case of the recording medium having the high rigidity, the recording medium pushes away the changeover flap 104 to proceed to the retracting path 131 in the direction of an arrow b in FIG. 22. Accordingly, even if the long recording medium having the high rigidity is used, the recording medium does not interfere with the automatic both-side unit to restrict the transport. In the automatic both-side unit of the invention, one-side recording can be performed to the recording medium (including the recording paper) which can not be bent due to the high rigidity without removing the automatic both-side unit. Up to this point, the automatic both-side unit 2 having the two sheet passing paths has described.

Figure 15:
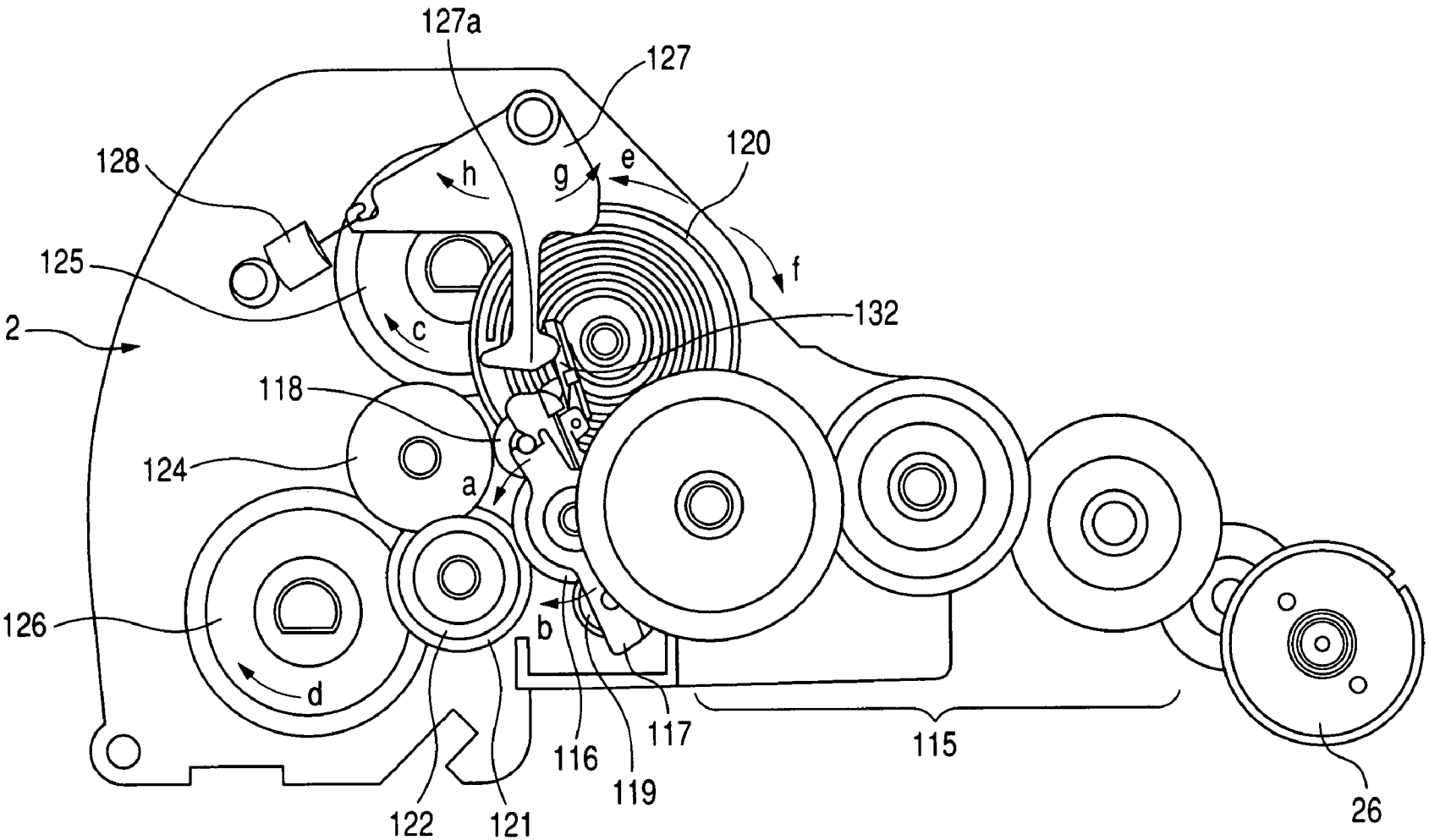
FIG. 15 is a schematic sectional side view showing an automatic both-side unit driving mechanism of the both-side recording apparatus according to the embodiment of the invention.

Then, the driving mechanism of the rollers in the automatic both-side unit 2 will be described. FIG. 15 is the schematic sectional side view showing the configuration of the driving mechanism of the rollers in the automatic both-side unit 2 while the embodiment (FIG. 1) of the recording apparatus to which the invention is applied is viewed from the side opposite to FIG. 2. In FIG. 15, the numeral 115 designates a both-side transfer gear train which transfers the power from the LF motor 26 to a both-side sun gear 116, the both-side sun gear 116 is located in the center of a both-side pendulum arm 117, the both-side pendulum arm 117 can rock about the both-side sun gear 116, the numeral 118 designates a both-side planet gear A which is rotatably attached to the both-side pendulum arm 117 and engages the both-side sun gear 116, and the numeral 119 designates a both-side planet gear B.

In FIG. 15, the numeral 120 designates a spiral grove gear engaging the both-side sun gear 116 through the idler, the numeral 121 designates a reverse rotation delay gear A engaging the both-side planet gear, the numeral 122 designates a reverse rotation delay gear B which is coaxial with to the reverse rotation delay gear A 121, the numeral 123 designates a reverse rotation delay gear spring which gives the biasing force between the reverse rotation delay gear A 121 and the reverse rotation delay gear B 122, the numeral 124 designates a both-side roller idler gear connecting the two both-side roller gears, the numeral 125 designates a both-side roller gear A fixed to the both-side roller A 108, the numeral 126 designates a both-side roller gear B fixed to the both-side roller B 109, the numeral 127 designates a stop arm which engages a groove of the spiral groove gear 120 to be rocked, the numeral 128 designates a stop arm spring which centers the stop arm 127, and the numeral 132 designates a both-side pendulum arm spring attached to the both-side pendulum arm 117.

As described above, in the embodiment, the driving force of the automatic both-side unit 2 is obtained from the LF motor 26 which drives the sheet transport roller 21. According to the above configuration, when the sheet transport roller 21 and the both-side roller A 108 or the both-side roller B 109 cooperate to transport the recording paper, the start or stop timing and sheet transport speed are substantially completely synchronized with each other. The driving force from the LF motor 26 is transferred to the both-side sun gear 116 through the both-side transfer gear train 115. The rockable both-side pendulum arm 117 is attached to the both-side sun gear 116, and the both-side planet gear A 118 and the both-side planet gear B 119 are attached to the both-side pendulum arm 117.

Since the appropriate amount of frictional force acts between the both-side sun gear 116 and the both-side pendulum arm 117, the both-side pendulum arm 117 is rocked in accordance with the rotating direction of the both-side sun gear 116. At this point, assuming that the direction in which the LF motor 26 is rotated in the direction in which the sheet transport roller 21 transports the recording paper toward the sheet discharge direction is set to the forward direction and the direction in which the sheet transport roller 21 transports the recording paper to the automatic both-side unit 2 side is set to the reverse direction, when the LF motor 26 is rotated in the forward direction, the both-side sun gear 116 is rotated in the direction of the arrow a in FIG. 15. The both-side pendulum arm 117 is also basically rocked in the direction of the arrow a in FIG. 15 with the rotation of the both-side sun gear 116.

Then, the both-side planet gear A 118 engages the both-side roller idler gear 124 to rotate the both-side roller idler gear 124. As the both-side roller idler gear 124 is rotated, the both-side roller gear A 125 is rotated in the direction of the arrow c in FIG. 15 and the both-side roller gear B 126 rotated in the direction of the arrow d in FIG. 15. The direction of the arrow c and the direction of the arrow d in FIG. 15 are one in which the both-side roller A 108 and the both-side roller B 109 transport the recording paper in the automatic both-side unit 2 respectively.

When the LF motor is rotated in the reverse direction, the both-side sun gear 116 is rotated in the direction of the arrow b in FIG. 15. The both-side pendulum arm 117 is also basically rocked in the direction of the arrow b in FIG. 15 with the rotation of the both-side sun gear 116. Then, the both-side planet gear B 119 engages the reverse rotation delay gear A 121. In the reverse rotation delay gear A 121 and the reverse rotation delay gear B 122, a projection is protruded from a thrust surface opposite to each other. Assuming that the reverse rotation delay gear B 122 is fixed, when the reverse rotation delay gear A 121 is rotated one turn, the projections act as a clutch engaging each other.

Before the both-side planet gear B 119 engages the reverse rotation delay gear A 121, the reverse rotation delay gear A 121 and the reverse rotation delay gear B 122 are biased toward the direction in which the projection are separated from each other by the reverse rotation delay gear spring 123, so that the reverse rotation delay gear A B 122 starts the rotation after the reverse rotation delay gear A 121 is substantially rotated one turn from the start of the rotation. Thus, an interval from the start of the rotation in the reverse direction of the LF motor 26 to the start of the rotation of the reverse rotation delay gear B 122 becomes a delay interval when the both-side roller A 108 and the both-side roller B 109 are stopped.

When the reverse rotation delay gear B 122, the both-side roller gear A 125 is rotated in the direction of the arrow c in FIG. 15 through the both-side roller idler gear 124, and the both-side roller gear B 126 is rotated in the direction of the arrow d in FIG. 15 through the both-side roller idler gear 124. These rotating directions are the same as the rotating direction when the LF motor 26 is rotated in the forward direction. The above described mechanism can always rotate the both-side roller A 108 and the both-side roller B 109 in the sheet transport direction independently of the rotating direction of the LF motor 26.

The action of the spiral groove gear 120 will be described below. In the spiral groove gear 120, a gear surface is formed on the outer periphery, and the cam is formed on one end face. The spiral groove having caterpillers in the innermost periphery and the outermost periphery is cut in the cam. In the embodiment, because the spiral groove gear 120 is directly connected to the both-side sun gear 116 through the idler gear, the spiral groove gear 120 is rotated in the same direction as the both-side sun gear 116 in synchronization with the both-side sun gear 116. Because the groove of the spiral groove gear 120 engages a follower pin 127*a* which is of a part of the stop arm 127, the stop arm 127 is rocked with the rotation of the spiral groove gear 120. For example, when the spiral groove gear 120 is rotated in the direction of an arrow e in FIG. 15, the follower pin 127*a* is brought in the inner periphery, so that the stop arm 127 is rocked in the direction of an arrow g in FIG. 15. Even if the spiral groove gear 120 continues to rotate in the direction of the arrow e in FIG. 15, since the follower pin 127*a* enters the caterpiller of the innermost periphery, the stop arm 127 stops at the predetermined position.

On the contrary, when the spiral groove gear 120 is rotated in the direction of an arrow f in FIG. 15, the follower pin 127*a* is moved toward the outer periphery, so that the stop arm 127 is rocked in the direction of an arrow h in FIG. 15. When the spiral groove gear 120 continues to rotate in the direction of the arrow f in FIG. 15, the follower pin 127*a* enters the caterpiller of the outermost periphery, so that the stop arm 127 stops at the predetermined position. The stop arm spring 128 is attached to the stop arm 127 so that the follower pin 127*a* is smoothly moved from the caterpillers of the innermost periphery and the outermost periphery to the spiral groove, when the rotating direction of the spiral groove gear 120 is changed. The stop arm spring 128 centers the stop arm 127 with respect to the proximity in the center of the moving range of the stop arm 127.

The stop arm 127 performing the above operation acts the both-side pendulum arm spring 132 attached to the both-side pendulum arm 117. The both-side pendulum arm spring 132 attached to the both-side pendulum arm 117 is the elastic member expanded in the direction of the stop arm 127. The front end of the both-side pendulum arm spring 132 is always located in the radial direction of the spiral groove gear 120 rather than the stop arm 127.

When the LF motor is rotated in the forward direction, the following action is given by the above positional relationship. Namely, when the LF motor 26 is rotated in the reverse direction to transport the recording paper 4 to the automatic both-side unit 2 and inverts the recording paper 4 to return the recording paper 4 to the sheet transport roller 21, the stop arm 127 is rotated in the caterpiller of the outermost periphery of the spiral groove gear 120. Then, the stop arm 127 is moved toward the inner periphery of the spiral groove gear 120 while the recording of the reverse surface is performed by rotating the LF motor 26 in the forward direction. When the LF motor 26 is rotated in the forward direction, since the power transfer is performed by rocking the both-side pendulum arm 117 in the direction of the arrow a in FIG. 15, the stop arm 127 abuts on the both-side pendulum arm spring 132 on the way of the stop arm 127 toward the inner periphery.

When the LF motor 26 is further rotated in the forward direction, since the stop arm 127 is further moved to the inner periphery to elastically deform the both-side pendulum arm spring 132, an attitude of the both-side pendulum arm 117 is determined by the balance among the force acting in the direction of an pressure angle in the case where the gears of the both-side planet gear A 118 and the both-side roller idler gear 124 engages with each other, the force rocking the both-side pendulum arm 117 in the direction of the arrow a in FIG. 15, and the force of repulsion of the both-side pendulum arm spring 132. In the embodiment, since the force of repulsion of the both-side pendulum arm spring 132 is set small, even if the stop arm 127 is located in the caterpiller of the innermost periphery, the power transfer between the both-side planet gear A 118 and the both-side roller idler gear 124 can be continued only by elastically deforming the both-side pendulum arm spring 132.

Even if the LF motor 26 becomes the stopped state while the rotation and stop are repeated by the intermittently driving, the tooth surfaces of the both-side planet gear A 118 and the both-side roller idler gear 124 still engage with each other, so that the engagement between the both-side planet gear A 118 and the both-side roller idler gear 124 is never disengaged. However, when the recording of the reverse surface of the recording paper 4 is terminated and the power transfer to the automatic both-side unit 2 becomes unnecessary, it is preferable to cut the power in order to reduce the load of the LF motor 26. Therefore, the following means is performed in the case where the power transfer is cut.

The LF motor 26 is slightly rotated in the reverse direction, while the stop arm 127 enters the caterpiller of the innermost periphery and the both-side pendulum arm spring 132 is elastically deformed. Although the moment of the both-side pendulum arm 117 in the direction of the arrow b in FIG. 15 by the repulsion of the both-side pendulum arm spring 132 is stopped by the engagement between the both-side planet gear A 118 and the both-side roller idler gear 124, since the slight rotation of the LF motor 26 in the reverse direction gives the rotation which disengages the gears, the both-side pendulum arm 117 is rotated in the direction of the arrow b in FIG. 15.

Once the both-side pendulum arm 117 is rotated in the direction of the arrow b in FIG. 15, the both-side pendulum arm spring 132 elastically deformed returns to the original shape. Further, even if the LF motor 26 is rotated in the forward direction, the both-side pendulum arm spring 132 interferes with the stop arm 127. Therefore, the both-side pendulum arm 117 can not be rocked until the both-side planet gear A 118 engages the both-side roller idler gear 124. As a result, as long as the predetermined amount of rotation of the LF motor 26 in the reverse direction is not performed from this state, the driving force is not transferred to the both-side pendulum arm 117 and after stages in the automatic both-side unit 2. In the driving up to the both-side pendulum arm 117, since the gear train is merely rotated, the load applied to the LF motor is small, and the load is substantially equal to the load in the case where the automatic both-side unit 2 is not attached.

In the case where the LF motor 26 is rotated in the reverse direction from the state in which the stop arm 127 is located in the caterpiller of the innermost periphery, no action is exerted on the both-side pendulum arm spring 132 and the stop arm 127, so that the power can be transferred to the reverse rotation delay gear A 121 as described above. Up to this point, the outline of the driving mechanism of the rollers in the automatic both-side unit 2 has been described.

Figure 16A:
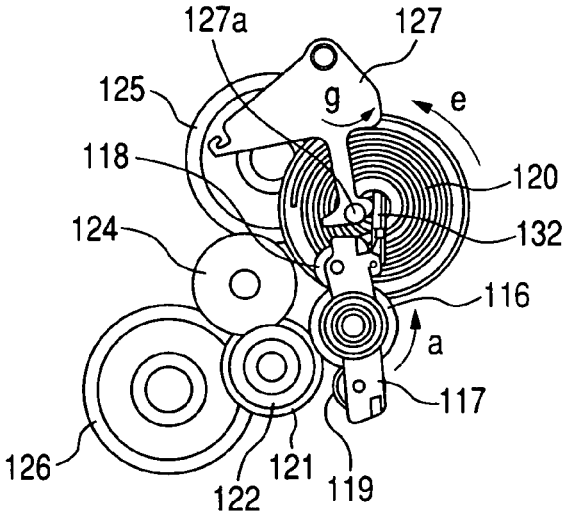
FIGS. 16A, 16B, 16C, 16D, 16E and 16F are a schematic sectional side view sequentially showing the operational state of the automatic both-side unit driving mechanism of the both-side recording apparatus according to the embodiment of the invention.
Figures 20, 20A:
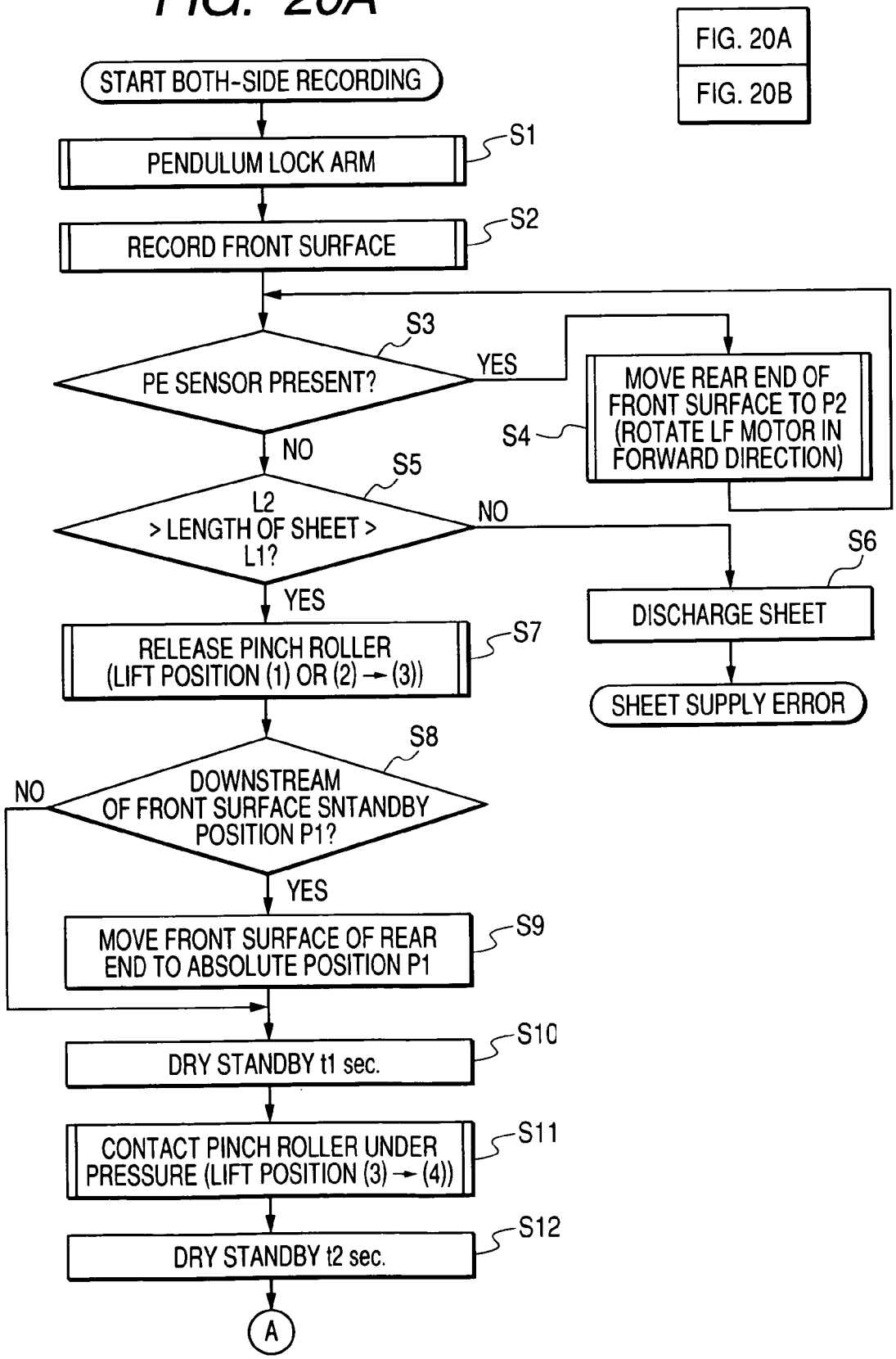
FIG. 20 which is composed of FIG. 20A and 20B are flowcharts showing a sequence of automatic both-side recording operation of the both-side recording apparatus according to the embodiment of the invention.
Figure 20B:
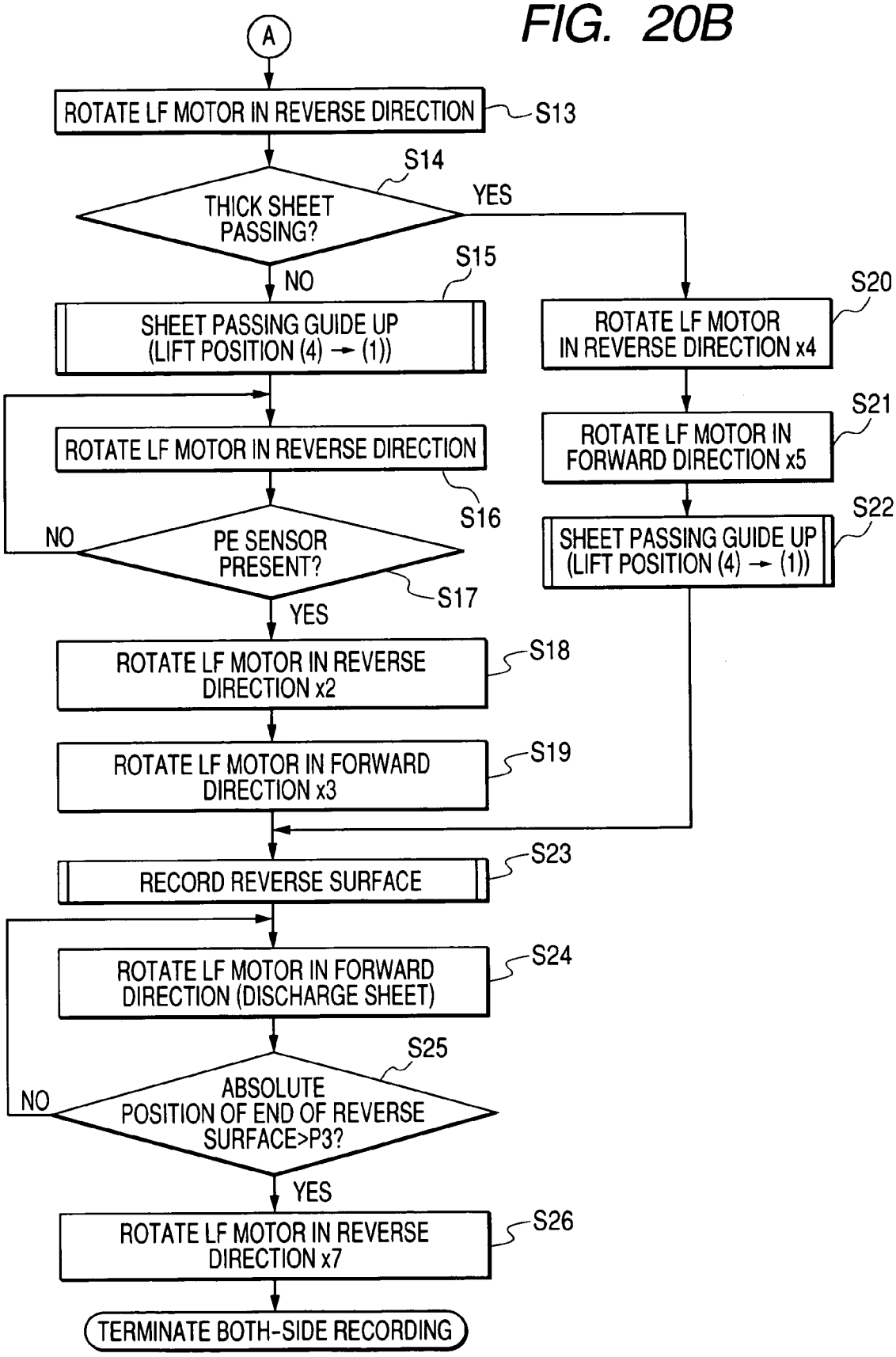

FIGS. 16A to 16F are the schematic sectional side view for explaining the operation of the driving mechanism of the rollers in the automatic both-side unit 2, and FIGS. 20A and 20B are the flowcharts showing the operational sequence of the automatic both-side recording. The operation of the driving mechanism of the rollers in the automatic both-side unit 2 and the operation of the automatic both-side recording will be described in detail below referring to FIGS. 16A to 16F and the flow chart shown in FIGS. 20A and 20B. In FIGS. 16A to 16F, 20A and 20B, when the automatic both-side recording is started, sheet supply of the recording paper 4 is performed in Step S1. For example, the recording paper 4 is supplied from the main ASF 37 toward the sheet transport roller 21. In Step S2, the recording of the front surface is performed. This operation is similar to the case of the one-side recording. At this point, the state of the driving mechanism of the rollers is shown in FIG. 16A.

FIG. 16A shows the state in which the LF motor 26 is being rotated in the forward direction after the driving mechanism of the automatic both-side unit 2 is initialized. Namely, FIG. 16A shows the state in which the recording operation of the front surface is being performed during the automatic both-side recording, the state in which the normal recording operation is being performed while the automatic both-side recording is not used, or the like. Since the follower pin 127*a* of the stop arm 127 is located in the caterpiller of the innermost periphery of the spiral groove gear 120, when the both-side pendulum arm 117 is rocked in the direction of the arrow a in FIG. 15, the both-side pendulum arm 117 abuts on the stop arm 127, and the both-side pendulum arm 117 can not be rotated any more. Further, since the both-side planet gear A 118 can not engage the both-side roller idler gear 124, the driving force from the LF motor 26 is not transferred to the both-side roller gear A 125 and the both-side roller gear B 126. In this state, the both-side roller A 108 and the both-side roller B 109, in which the shaft loss is generated by receiving the pressure of the both-side pinch roller A 112 or the both-side pinch roller B 113, are not rotated, so that the load applied to the LF motor 26 is small.

In Step S3, it is confirmed whether the rear end of the recording paper can be detected by the PE sensor 67 or not at the point that the recording of the front surface is terminated. At this point, when the PE sensor detects the presence of the recording paper 4, since the rear end of the front surface of the recording paper 4 can not be detected yet, in Step S4, the LF motor 26 is still rotated in the forward direction. The recording paper 4 is moved until the rear end of the front surface of the recording paper 4 passes through the PE sensor 66 to reach a position p2 slightly in front of the PE sensor lever 67. In Step S5, the length of the recording paper 4 is calculated from the amount of transport of the recording paper 4 since the PE sensor 66 detects the front end of the front surface of the recording paper 4 until the PE sensor 67 detects the rear end of the front surface of the recording paper 4.

As described above, in the case where the length of the recording paper 4 is shorter than a predetermined length L1, because the recording paper 4 can not reach the roller between the sheet transport roller 21 and the both-side roller B 109 or between the both-side roller A 108 and the sheet transport roller 21, it is necessary that the recording paper 4 having the length shorter than the predetermined length L1 is removed from the automatic both-side recording operation. In the case where the length of the recording paper 4 is longer than a predetermined length L2, because the recorded surfaces of the recording paper 4 interfere with each other in the sheet passing path from the sheet transport roller 21 to the automatic both-side unit 2, it is necessary that the recording paper 4 having the length longer than the predetermined length L2 is removed from the automatic both-side recording operation. In the case where the judgment that the recording paper 4 is removed from the automatic both-side unit 2 is made by the condition of Step S5, the operational sequence proceeds to Step S6, and the LF motor 26 is rotated in the forward direction to directly remove the recording paper 4. In the case where the length of the recording paper 4 meets the condition of Step S5, the operational sequence proceeds to Step S7, and the lift mechanism is set to the third position to release the pinch roller 22. The release of the pinch roller 22 from the sheet transport roller 21 is performed after the first predetermined time or the third predetermined time elapsed since the surface recording is terminated.

In Step S8, it is confirmed whether the rear end of the front surface of the recording paper 4 has been already transported to the downstream side of a position p1 near the pinch roller 22. In the case where the rear end of the recording paper 4 has been already transported to the downstream side, in Step S9, the LF motor 26 is rotated in the reverse direction to perform the back feed of the recording paper 4 until the rear end of the front surface is moved to the position p1 so that the recording paper 4 is supported by the sheet transport roller 21 and the pinch roller 22 while sandwiched when the pinch roller 22 is returned to the pressing state. At this point, the driving mechanism of the rollers is in the state shown in FIG. 16B. From Step S2 to Step S8, it is desirable that the operation is not stopped as much as possible and Step S9 is performed before the recording paper 4 is deformed as described before. In the case where the rear end of the front surface is located on the upstream side of the position p 1, when the pinch roller 22 is directly pressed, since the pinch roller 22 and the sheet transport roller 21 can securely support the recording paper while sandwiching the recording paper, the operational sequence proceeds to Step S10.

Figure 16D:
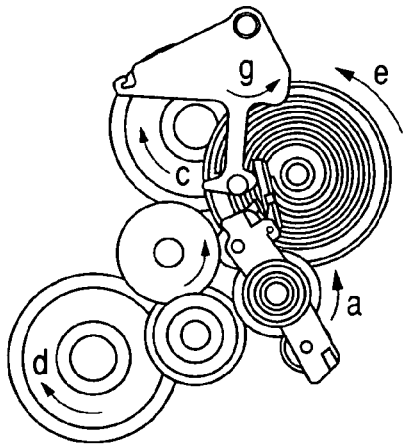
Figure 16B:
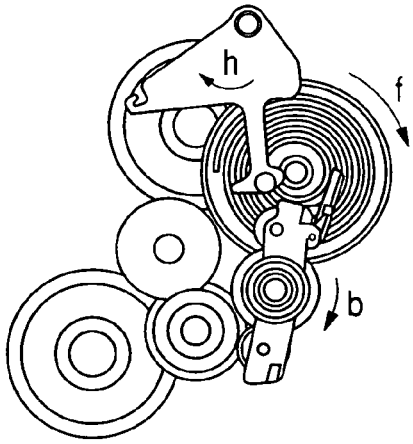
Figure 16E:
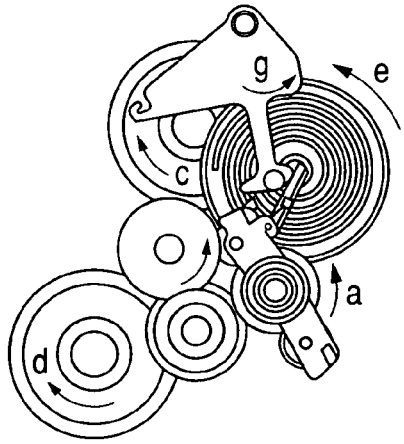

FIG. 16B shows the state immediately after the rotation in the reverse direction of the LF motor 26 is started. Namely, FIG. 16B shows the case immediately after the back feed is started after the front surface recording of the automatic both-side recording is terminated, the case in which the LF motor 26 is rotated in the reverse direction in order to adjust the start position after the sheet supply from the main ASF 37, or the like. There is no obstacle preventing the both-side pendulum arm 117 from rocking in the direction of the arrow b in FIG. 15, so that the both-side planet gear B 119 engages the reverse rotation delay gear A 121. Although the reverse rotation delay gear A 121 starts the rotation with the engagement between the both-side planet gear B 119 and the reverse rotation delay gear A 121, because the driving force is not transferred to reverse rotation delay gear B 122 until the reverse rotation delay gear A 121 is substantially rotated one turn, the both-side roller idler gear 124 is not rotated, and the both-side roller A 108 and the both-side roller B 109 are not operated.

Therefore, the load which the LF motor 26 is applied is still small in this state. The reason why this state is set is that the rotation of the both-side roller B 109 is not required until the front end of the recording paper 4 reaches the both-side roller B 109, because there is a distance between the sheet transport roller 21 and the both-side roller B 109 when the back feed of the recording paper 4 is performed during the automatic both-side recording. Further, another reason is that the both-side roller A 108 or the both-side roller B 109 is not caused to be unnecessarily rotated during adjusting the start positioning the normal recording.

In Step S10, the time when the operational sequence stands by until the recorded ink on the front surface of the recording paper 4 is dried is provided. As described above, since the required drying time is varied dependent on the some factors, dry standby time t1 (second predetermined time) can be set to a variable parameter. Specifically, the dry standby time t1 is determined in consideration of the kind of the recording paper, the kind of the using ink, a method of overstriking the using ink, the amount of using ink hit in the recording paper per unit area, the ambient temperature, the ambient humidity, the flow velocity of ambient gas, and the like. The second predetermined time is longer than the first predetermined time. In Step S11, the lift mechanism is set to the fourth position. This allows the sheet transport roller 21 and the pinch roller 22 to support the recording paper 4 while sandwiching the recording paper 4 again.

In Step S12, dry standby time t2 (fourth predetermined time) is provided. In the case where the dry standby time t1 is performed in Step S10, it is also possible that the dry standby time t2 is not used. It is also possible that the dry standby time t2 is set to t2=0 and the operational sequence proceeds to the next step. For example, the dry standby time t2 is used in the case where the recording operation is not performed in the rear end portion of the recording paper 4 and the blank space is present. In this case, there is no problem, even if the dry standby time t1 is set to t1=0 in Step S10 and the control is performed so that the pinch roller 22 is pressed against the blank space. However, when the back feed is immediately performed to transport the recording paper 4, there is a possibility that the ink before drying is transferred to the pinch roller 22, so that the dry standby time t2 is used at this point. The fourth predetermined time is longer than the third predetermined time.

In Step S13, the LF motor 26 is rotated in the reverse direction to perform the back feed of the recording paper 4 by a predetermined amount x1. In Step S13, the recording paper 4 is transported to the automatic both-side unit 2 to invert the recording paper 4. After Step S13, the front end of the reverse surface returns to the position slightly in front of the sheet transport roller 21. The driving mechanism of the rollers up to Step S13 is shown in FIG. 16C.

Figure 16C:
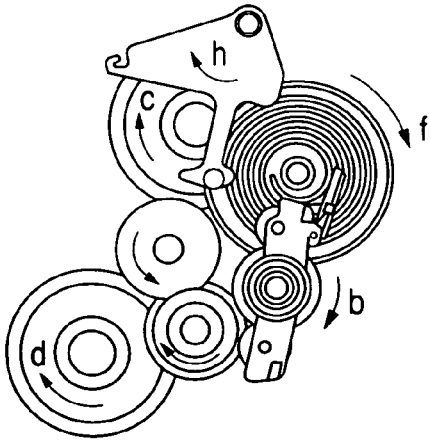
Figure 16F:
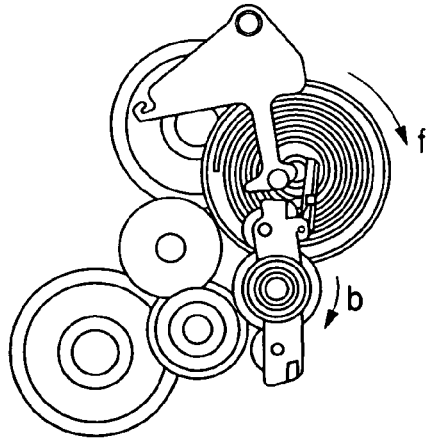

FIG. 16C shows the state in which the LF motor 26 further continues to rotate in the reverse direction. Namely, FIG. 16C shows the state in which the back feed of the recording paper 4 is performed to invert the recording paper 4 by the automatic both-side unit 2. After the state shown in FIG. 16B, when the reverse rotation delay gear A 121 is substantially rotated one turn, the projection protruded toward the thrust direction of the reverse rotation delay gear A 121 engages the projection of reverse rotation delay gear B 122 provided in opposite direction to the projection of reverse rotation delay gear A 121, which allows the reverse rotation delay gear A 121 and the reverse rotation delay gear B 122 to be rotated in an integrated manner. When the reverse rotation delay gear B 122 starts to rotate, since the reverse rotation delay gear B 122 always engages the both-side roller idler gear 124, the both-side roller idler gear 124, the both-side roller gear A 125, and the both-side roller gear B 126 are rotated. Therefore, the both-side roller A 108 is rotated in the direction of the arrow c in FIG. 15, and the both-side roller B 109 is rotated in the direction of the arrow d in FIG. 15.

Then, the so-called registration operation in the case where the nip portion of the sheet transport roller 21 and the pinch roller 22 supports the front end of the reverse surface while sandwiching the front end of the reverse surface will be described. In Step S14, the control is changed on the basis of whether the recording paper 4 is the paper having the low rigidity or the paper having the high rigidity. The judgment of the rigidity of the recording paper 4 can be performed by the kind of the recording paper which a user set by printer driver, or the judgment of the rigidity can be performed by the detecting means for measuring the thickness of the recording paper. The control is divided into the two kinds of the control. This is because behavior depends on the rigidity of the recording paper when the recording paper 4 is bent to form the loop.

Figure 18A:
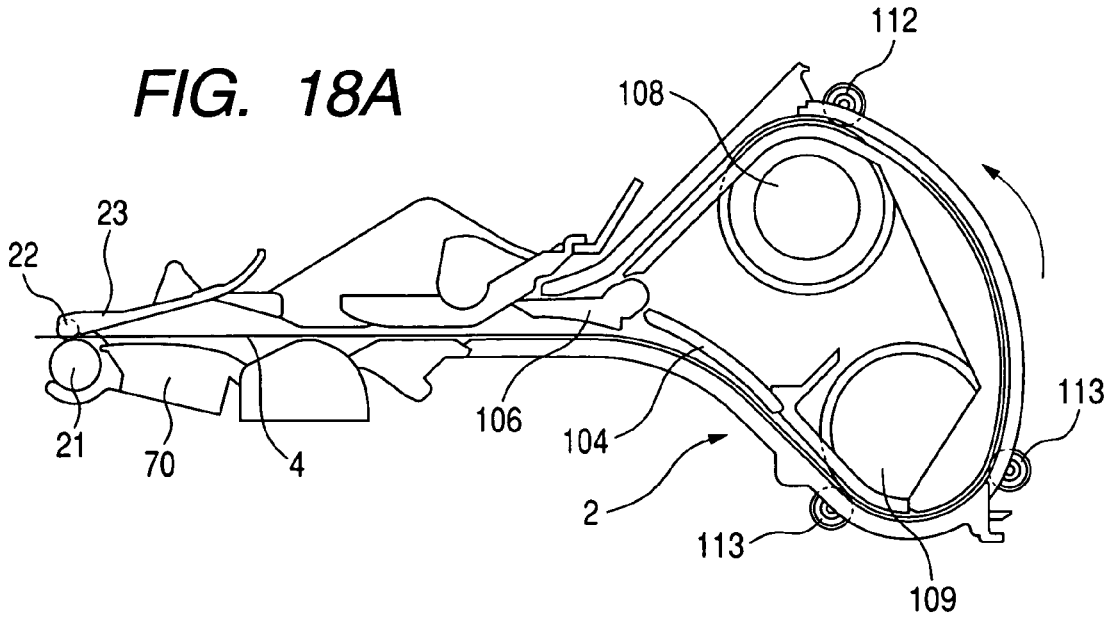
FIGS. 18A, 18B, and 18C are a schematic sectional side view showing reverse-surface front-end registration operation in the case where a thin recording sheet is used in the both-side recording apparatus according to the embodiment of the invention.
Figure 18B:
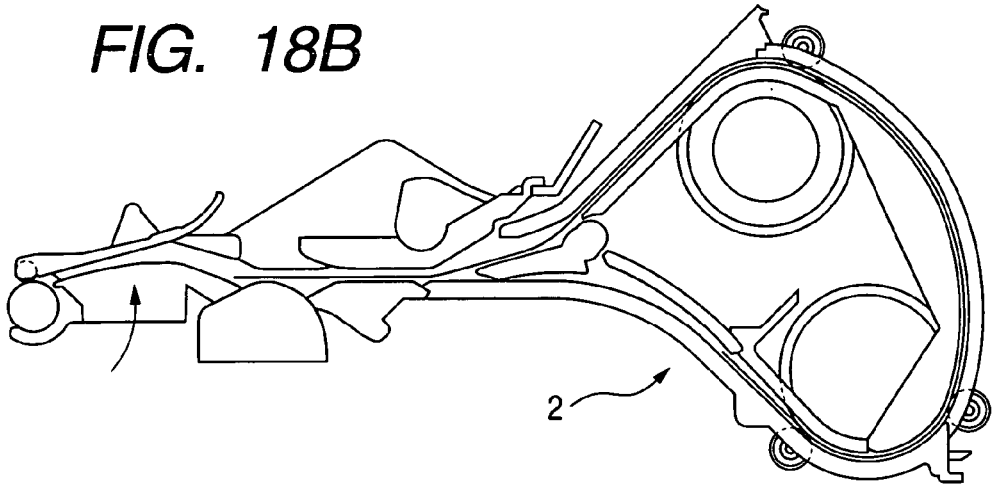
Figure 18C:
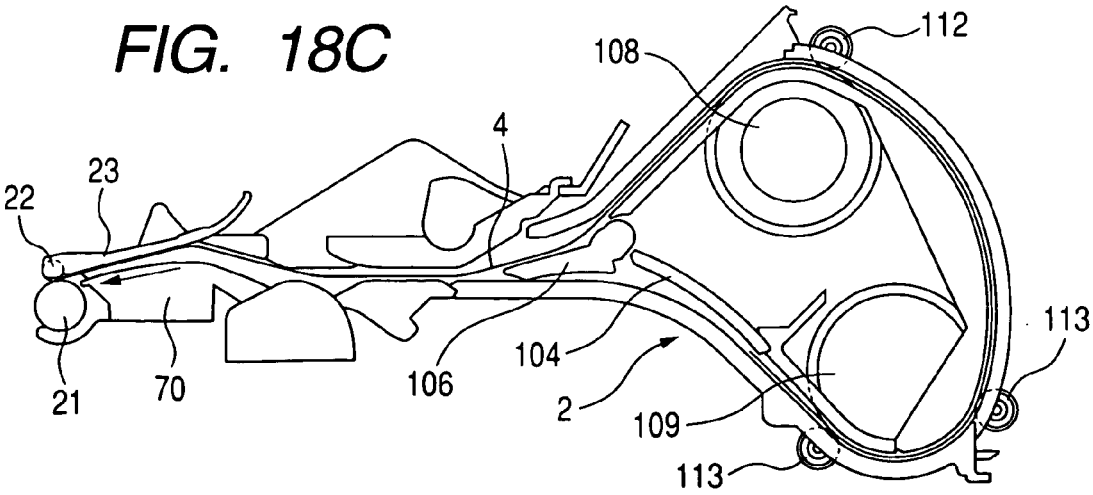

At first, the case in which the thin recording paper has the relatively low rigidity will be described. FIGS. 18A to 18C are the schematic sectional side view showing the registration operation of the front end of the reverse surface in the case the thin recording paper is used. In FIGS. 20A and 20B and FIGS. 18A to 18C, in Step S13, the sheet paper inversion transport of FIGS. 18A to 18C is performed by rotating the LF motor 26 in the reverse direction. After Step S13, the front end of the reverse surface of the recording paper returns to the proximity of the sheet passing guide 70. In the case of the thin recording paper, the operational sequence proceeds to Step S15. In Step S15, the lift mechanism is operated to be moved to the first position. This allows the sheet passing guide 70 to be raised.

FIG. 18B shows the state in which Step S15 is terminated. AS described above, since the sheet transport roller 21 and the pinch roller 22 are arranged on the side of the first sheet discharge roller 30 while the center of the pinch roller 22 is offset relative to the center of the sheet transport roller 21, the nip portion of the sheet transport roller 21 and the pinch roller 22 slightly has the angle relative to the substantially horizontal line in which the recording paper 4 is transported. The front end of the reverse surface of the recording paper 4 can be smoothly guided to the declined nip portion by returning the sheet transport guide 70 to the raised position before the registration operation. In Step S16, the LF motor 26 is rotated in the reverse direction to further transport the recording paper 4 toward the sheet transport roller 21. In Step S17, the PE sensor 67 detects the front end of the reverse surface of the recording paper 4. When the PE sensor 67 can detect the front end of the reverse surface, the operational sequence proceeds to Step S18.

In Step S18, the recording paper 4 is transported by a distance x2 slightly longer than the distance between the detection position of the front end of the reverse surface by the PE sensor 67 and the sheet transport roller 21. As a result, the front end of the reverse surface of the recording paper 4 reaches the nip portion of the sheet transport roller 21 and the pinch roller 22, and a part of the recording paper 4 which is excessively transported is bent to form the loop. FIG. 18C shows the state in which Step S18 is terminated. Although the gap of the sheet passing path in the height direction is decreased by setting the sheet passing guide 70, since the recording paper 4 has the relatively low rigidity, the loop is easily formed to push the recording paper 4. Therefore, the front end of the reverse surface of the recording paper 4 follows the nip portion of the sheet transport roller 21 and the pinch roller 22 to become parallel to the sheet transport roller 21, and the registration operation is completed. In Step S19, the rotating direction of the LF motor 26 is changed to the rotation in the forward direction, the front end of the reverse surface of the recording paper 4 is supported by the nip portion while sandwiched, and the front end of the reverse surface is transported by a predetermined distance x3 to complete the start of preparation of reverse surface recording.

Figure 19A:
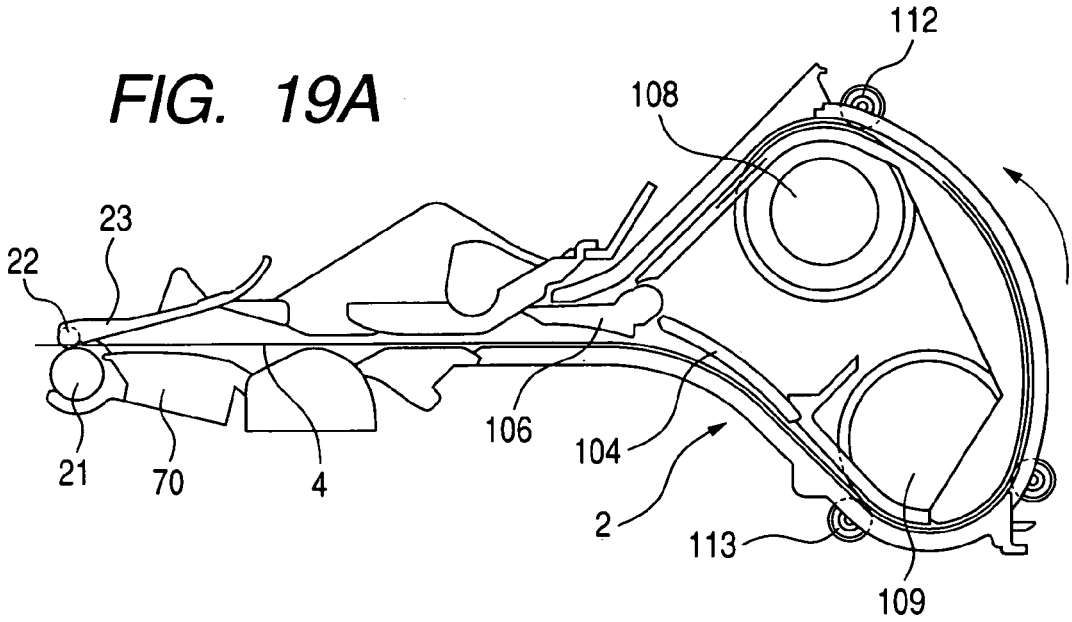
FIGS. 19A, 19B, and 19C are a schematic sectional side view showing the reverse-surface front-end registration operation in the case where a thick recording sheet is used in the both-side recording apparatus according to the embodiment of the invention.
Figure 19B:
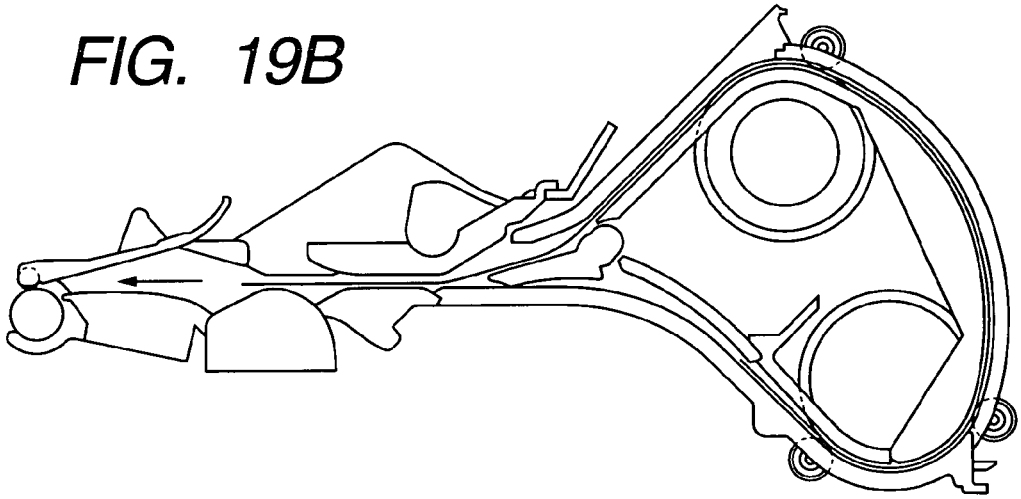
Figure 19C:
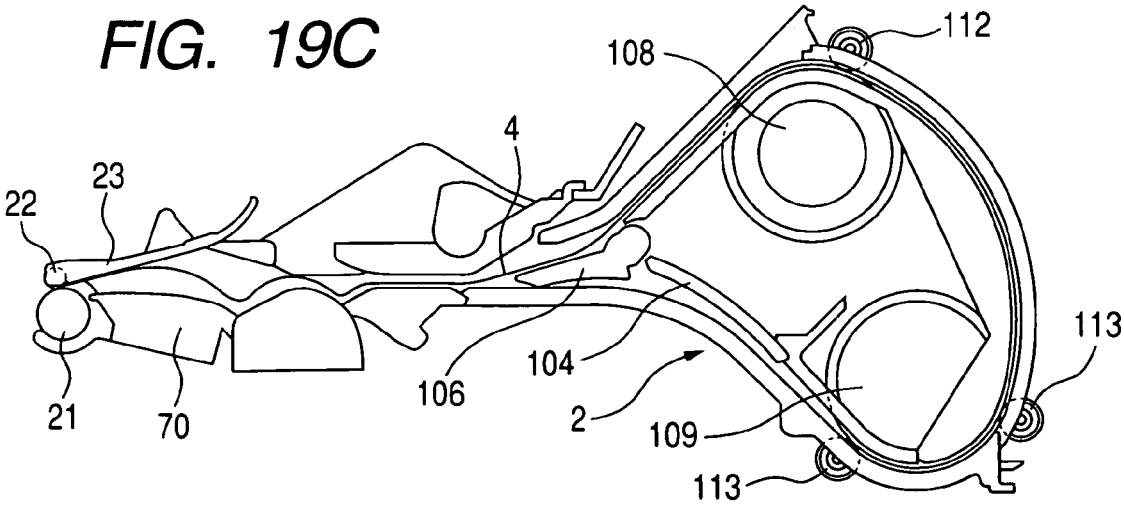

Then, the case in which the thick recording paper (recording medium) has the relatively high rigidity will be described. FIGS. 19A to 19C are the schematic sectional side view showing the registration operation of the front end of the reverse surface in the case the thick recording paper is used. FIG. 19A shows the state on the way of Step S13, and FIG. 19B shows the state in which Step S13 is terminated. In Step S20, the LF motor 26 is rotated in the reverse direction while the sheet passing guide 70 is left at the lowered position, and the recording paper 4 is transported by a distance x4 slightly longer than the distance between the front end of the reverse surface of the recording paper 4 stopped at the position in Step S13 and the nip of the sheet transport roller 21. Therefore, similarly to the thin recording paper, the front end of the reverse surface of the recording paper 4 reaches the nip portion of the sheet transport roller 21 which is reversely rotated, and a part of the recording paper 4 which is compressed forms the loop, so that the front end of the reverse surface of the recording paper 4 becomes parallel to the sheet transport roller 21 and the registration operation is completed. FIG. 19C shows the state in which Step S20 is terminated.

In Step S21, the rotating direction of the LF motor 26 is changed to the forward direction, the front end of the reverse surface of the recording paper 4 is supported by the nip portion while sandwiched, the front end of the reverse surface is transported by the predetermined distance x3, and the start of the reverse surface recording is prepared. In Step S19 or Step S21, the LF motor 26 which has been rotated in the reverse direction changes the rotating direction to the forward direction. At this point, the both-side pendulum arm 117 is rocked in the direction of the arrow a in FIG. 15. Therefore, the engagement between the both-side planet gear B 119 and the reverse rotation delay gear A 121 is disengaged. The reverse rotation delay gear A 121 and the reverse rotation delay gear B 122 engage with each other by the projections during the rotation of the LF motor 26 in the reverse direction. At the same time, the reverse rotation delay gear spring 124 which is of the helical torsion coil spring sandwiched by the reverse rotation delay gear A 121 and the reverse rotation delay gear B 122 is compressed. The reverse rotation delay gear spring 124 is expand in such a manner that the reverse rotation delay gear A 121 becomes free, so that the reverse rotation delay gear A 121 is substantially rotated one turn to return to the initial state.

In Step S22, the lift mechanism is set to the first position, and the preparation of the start of the reverse surface recording is completed. In the case where the thick recording paper is used, the reason why the sheet passing guide 70 is set to the lowered position during the registration operation will be described below. In the case where the loop is formed in a manner shown in FIG. 18C similar to the thin recording paper, since the recording paper has the high rigidity, the recording paper 4 is transported along the pinch roller holder 23 before reaching the nip portion. Therefore, after the recording paper reaches the nip portion, even if the recording paper is further transported to try to generate the loop, since the space where the loop is generated has been already eliminated, the loop is not generated. Consequently, there is a possibility that the good registration operation is not performed. That is why the sheet passing guide 70 is set to the lowered position.

When the loop is not generated, sag is not formed in the recording paper 4 which is simultaneously nipped between the position at the both-side roller A 108 and the position at the sheet transport roller 21. In the case where the mechanism such as the both-side pendulum arm 117 is used for the driving mechanism of the both-side rollers like the embodiment, the time when the both-side pendulum arm 117 is rocked becomes necessary during the interval from the reverse rotation of the LF motor 26 in Step S21 to the forward rotation of the LF motor 26 in Step S21, and the both-side roller A 108 and the both-side roller B 109 are topped during the interval.

Since the sheet transport roller 21 is directly connected to the LF motor 26, there is no stop interval. Consequently, contradiction is generated in the sheet transport speed. When the sag of the recording paper is generated, the contradiction of the sheet transport speed can be absorbed by taking the margin of the sag during Step S21. On the other hand, in the case of no sag, the contradiction of the sheet transport speed can not be absorbed, and the sheet transport roller 21 side forcedly tries to transport the recording paper. However, since rear portion of the recording paper 4 is supported by the both-side roller A 108 and the both-side pinch roller 112 while sandwiched, sometimes actually the recording paper 4 is not transported. This causes the amount of transport of the front end of the reverse surface of the recording paper 4 to go out of adjustment, and sometimes the blank space in the upper end portion of the reverse surface becomes shorter than the expected length. In order to solve the above problem, the gap in the height direction between the pinch roller holder 23 and the sheet transport roller 21 is sufficiently formed by lowering the sheet passing guide 70, and the loop generation space is secured. Therefore, even in the thick recording paper having the relatively high rigidity is used, the good registration operation can be performed.

In Step S23, the reverse surface recording of the recording paper 4 is performed. In the most cases, the rear end of the reverse surface of the recording paper 4 is still supported by the both-side roller A 108 and the both-side pinch roller 112 while sandwiched. At this point, when the rotation of the both-side roller A 108 is stopped, since the load pulling the recording paper backward is generated, there is a possibility that the accuracy of the sheet transport is worsened. Therefore, in the embodiment, the driving of the both-side roller A 108 is configured so as to continue in at least the interval when the rear end of the reverse surface the recording paper 4 is supported by the both-side roller A 108 and the both-side pinch roller 112 while sandwiched. The driving mechanism of the both-side rollers is in the state shown in FIG. 16D.

FIG. 16D is the schematic sectional side view showing the operational state of the driving mechanism of the rollers in the automatic both-side unit 2 while the LF motor 26 is being rotated in the forward direction after the inversion operation of the recording paper. When the LF motor 26 changes the rotation from the state shown in FIG. 16C to the forward direction, the both-side pendulum arm is rocked in the direction of the arrow a in FIG. 15. At this point, the stop arm 127 is rocked in the direction of the arrow h in FIG. 15. Even if the both-side pendulum arm 117 is rocked in the direction of the arrow a in FIG. 15, the both-side pendulum arm spring 132 never abuts on the stop arm 127, so that the both-side planet gear A 118 engages the both-side roller idler gear 124 to transfer the driving force.

When the rotation of the LF motor 26 in the forward direction is continued, the follower pin 127*a* is guided by the spiral groove gear 120 to be moved to the inner periphery, and the stop arm 127 is rocked in the direction of the arrow g in FIG. 15. On the way of rocking, the stop arm 127 abuts on the both-side pendulum arm spring 132 to deform the both-side pendulum arm spring 132. The force rocking the both-side pendulum arm 117 in the direction of the arrow b in FIG. 15 acts on the both-side pendulum arm 117 by reaction force generated by the deformation of the both-side pendulum arm spring 132. However, because the engaging force between the tooth surfaces of the gears is stronger than the rocking force while the driving force is transferred between the both-side planet gear A 118 and the both-side roller idler gear 124, the engagement between the both-side planet gear A 118 and the both-side roller idler gear 124 is not disengaged, and the driving is continued. FIG. 16C shows this state.

AS described above, even if the LF motor 26 is intermittently driven while the rotation and the stop are repeated, the tooth surfaces of the gears of the both-side planet gear A 118 and the both-side roller idler gear 124 engages with each other, so that the engagement between the both-side planet gear A 118 and the both-side roller idler gear 124 is never disengaged. Further, when the recording operation of the reverse surface of the recording paper 4 is continued and the LF motor 26 is rotated in the forward direction, the follower pin 127*a* reaches the innermost periphery of the spiral groove gear 120. In this case, the driving mechanism of the both-side rollers is in the state shown in FIG. 16E. At this point, the both-side pendulum arm spring 132 becomes the state of maximum displacement. However, since the load of the both-side pendulum arm spring 132 is set so that the engaging force between the tooth surfaces of the gears is larger than the force rocking the both-side pendulum arm 117, the engagement between the gears which continues to rotate the LF motor 26 in the forward direction is never disengaged. When the recording operation of the reverse surface of the recording paper 4 is terminated, the operational sequence proceeds to Step S24.

In Step S24, the sheet discharge operation is performed. The sheet discharge operation discharges the recording paper 4 onto a sheet discharge tray (not shown). The sheet discharge operation is performed in such a manner that the rotation of the LF motor 26 in the forward direction is continued and the recording paper 4 is transported outside the recording unit main body 1 by the second sheet discharge roller 31. In Step S25, an absolute position of the front end of the reverse surface is checked. This is because sometimes the follower pin 127*a* does not reach the innermost periphery of the spiral groove gear 120 in the case where the short recording paper is used. Even in such cases, when the reverse surface recording operation of the recording paper 4 is terminated, the follower pin 127*a* is configured so as to always come to the innermost periphery of the spiral groove gear 120 by rotating the LF motor 26 by the predetermined length.

In Step S26, the initialization of the driving mechanism of the both-side rollers is performed. As described above, since the force charged by the both-side pendulum arm spring 132 is held by the engagement between the both-side planet gear A 118 and the both-side roller idler gear 124, the engagement is disengaged by rotating the LF motor 26 by the very small amount in the reverse direction. Namely, when the LF motor 26 is rotated in the reverse direction, since the both-side pendulum arm 117 tries to be rocked in the direction of the arrow b in FIG. 15, the engagement between the both-side planet gear A 118 and the both-side roller idler gear 124 is disengaged, and the both-side pendulum arm 117 is rocked in a stroke in the direction of the arrow b in FIG. 15 by the force in which the both-side pendulum arm spring 132 returns to the original state. The driving mechanism of the both-side rollers is in the state shown in FIG. 16F.

In this state, since the both-side pendulum arm spring 132 returns to the original state, in the case where the LF motor 26 is rotated in the forward direction, the both-side pendulum arm 117 tries to be rocked in the direction of the arrow a in FIG. 15. However, since the follower pin 127*a* enters the innermost periphery of the spiral groove gear 120, the both-side pendulum arm spring 132 abuts on the stop arm 127, and the both-side planet gear A 118 can not engage the both-side roller idler gear 124. Even if the LF motor is further rotated in the forward direction, since the follower pin 127*a* continues to rotate in the innermost periphery of the spiral groove gear 120, the both-side roller A 108 and the both-side roller B 109 are never driven. As described above, since the reverse rotation delay gear A 121 is initialized in Step S19 or Step S21, each initialization of the driving mechanism of the both-side rollers is terminated up to Step S26. Up to this point, the automatic both-side recording operation is terminated. In the case where the automatic both-side recording operation is continuously performed, the same operational sequence can be repeated.

In the embodiment, although the elastic abutment relationship between the both-side pendulum arm 117 and the stop arm 127 is realized by the action of the both-side pendulum arm spring 132, the invention is not limited to the embodiment, and the following configuration can be also used. FIGS. 17A to 17E are the schematic sectional side view showing the operational state of the driving mechanism of the rollers in the automatic both-side unit 2. The both-side pendulum arm 117 shown in FIGS. 17A to 17E includes an arm having the low elasticity, and the arm can abut on the stop arm 127. The operation of this configuration will be briefly described below.

Figure 17A:
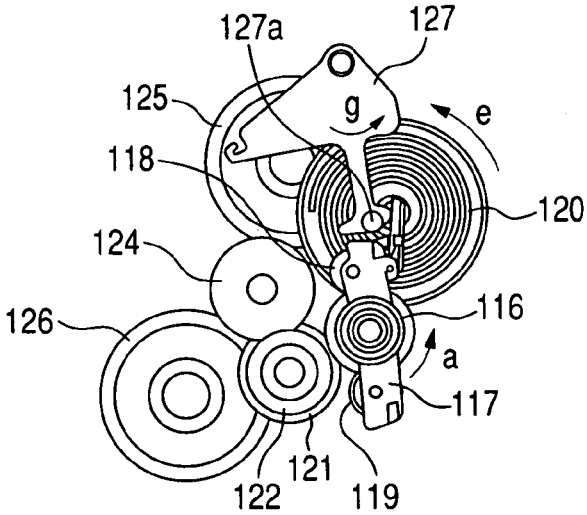
FIGS. 17A, 17B, 17C, 17D and 17E are a schematic sectional side view sequentially showing another operational state of the automatic both-side unit driving mechanism of the both-side recording apparatus according to the embodiment of the invention.
Figure 17D:
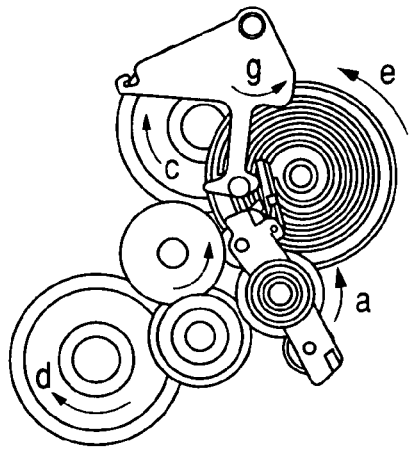
Figure 17B:
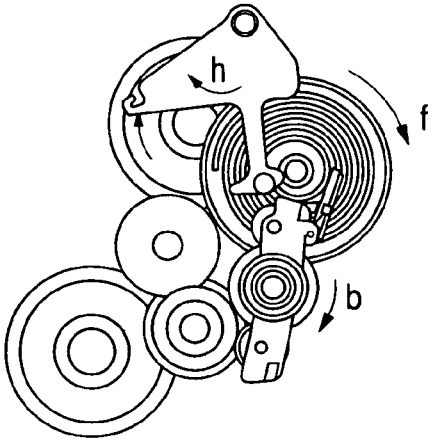
Figure 17E:
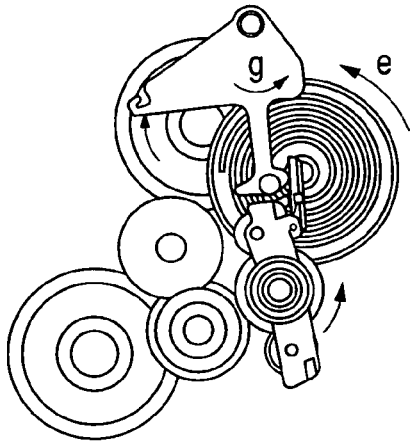
Figure 17C:
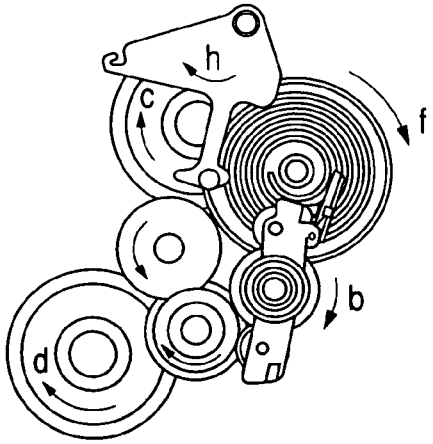

Since the operations from FIG. 17A to FIG. 17C are similar to the operations from FIG. 16A to FIG. 16C, the description is omitted here. FIG. 17D shows the state in which the stop arm 127 is moved toward the inner peripheral direction of the spiral groove gear 120 to abut on the arm of the both-side pendulum arm 117. Since the arm of the both-side pendulum arm 117 has the low elasticity, when the stop arm is pressed by the stop arm 127, the force rotating the both-side pendulum arm 117 in the direction of the arrow b in FIG. 15 acts. The force acts in the direction in which the engagement between the both-side planet gear A 118 and the both-side roller idler gear 124 is disengaged.

The force disengaging the engagement balances with the pressure acting between the tooth surfaces of the both-side planet gear A 118 and the both-side roller idler gear 124 and the elastic and sliding forces of the gears. However, the force disengaging the engagement is increased as the follower pin 127*a* is moved to the inner periphery, the force disengaging the engagement overcomes the force between the tooth surfaces and forcedly disengages the engagement between the both-side planet gear A 118 and the both-side roller idler gear 124. At the same time when the engagement is disengaged, the both-side roller A 108 and the both-side roller B 109 stop to rotate. FIG. 17E shows this state. The timing when the rotation of the roller is stopped is performed at a proper time after the rear end of the reverse surface of the recording paper 4 passes through the both-side roller A 108 in Step S23.

After the disengagement between gears, even if the LF motor 26 is rotated in the forward direction, the stop arm 127 prevents the both-side pendulum arm 117 from rocking in the direction of the arrow a in FIG. 15, so that the automatic both-side unit 2 is not driven until the LF motor 26 is rotated by the predetermined amount in the reverse direction. Similarly to the first embodiment, since the initialization of the reverse rotation delay gear A 121 is performed in Step S19 or Step S21, At this point, the initialization of the driving mechanism of the rollers in the automatic both-side unit 2 is completed. Therefore, the load rotating the both-side roller A 108 and the both-side roller B 109 during the recording operation of the reverse surface can be eliminated, and the rotational load can be decreased. Up to this point, another embodiment the driving mechanism of the rollers in the automatic both-side unit 2 was described.

The invention is not limited to another embodiment, and it is also possible to configure the control in which the positions of the lift mechanism are changed. Namely, in another embodiment, although the sheet passing guide 70 is in up-state during the normal standby state, it is possible that the sheet passing guide 70 is in down-state during the normal standby state. Specifically, the control in which the normal lift mechanism is set to the third position and the lift mechanism is moved from the third position to the first position before Step S1 is added to the configuration. Further, it is also possible that the control in which the lift mechanism is moved from the first position to the third position after Step S26 is added to the configuration. This configuration is preferable to the case in which the thick paper is supplied from the sheet discharge roller side, because the pinch roller 22 is released in the standby state. Up to this point, the automatic both-side recording operation along the flow chart showing the operational sequence was described.

Specific forms of the invention cited below are described in the above-described embodiments. Specific Form 1: A both-side recording apparatus with a sheet transport mechanism having a pair of sheet transport rollers including a sheet transport roller and a pinch roller pressed against the sheet transport roller, at least one pair of sheet discharge rollers arranged on the downstream side of the sheet transport roller in a transport direction, and a pair of sheet discharge rollers including a rotating body pressed against the roller, characterized in that a recording medium can be transported to a position where a rear end of the recording medium is released from the pair of sheet transport rollers when a first surface is recorded at first, and then the recording paper is transported to a paper inversion unit in such a manner that the sheet transport roller is pressed into contact with the pinch roller again to further continue the transport in the reverse direction after the sheet transport roller and the pinch roller are released to transport the recording medium toward a reverse direction of the first surface recording by the pair of sheet discharge rollers.

The configuration of Specific Form 1 provides the both-side recording apparatus in which the recording can be performed without the blank space in the overall range of the recording medium because the recording can be performed while the recording medium is transported until the recording medium is released once from the sheet transport, and the sheet transport roller and the pinch roller can securely support the recording medium while sandwiching the recording medium and the paper jam can be securely prevented because the recording medium is transported toward the reverse direction while the pinch roller is released to make the gap between the pinch roller and the sheet transport roller.

Specific Form 2: A both-side recording apparatus according to Specific Form 1, wherein a gap between the sheet transport roller and the pinch roller is set larger than an amount of deformation of the recording medium after the first surface of the recording medium is recorded. The configuration of Specific Form 2 obtains the effect that the recording medium can be transported to the gap between the sheet transport roller and the pinch roller, the sheet transport roller and the pinch roller can securely support the recording medium while sandwiching the recording medium again, and the paper jam can be securely prevented.

Specific Form 3: A both-side recording apparatus according to Specific Form 1 or Specific Form 2, wherein the transportation of the recording medium is started toward the reverse direction after a predetermined time elapsed from termination of the recording of the first surface in the recording medium. The configuration of Specific Form 3 obtains the effect that the ink soil of the sheet transport roller or the pinch roller or the soil of the recording paper itself can be eliminated by sufficiently drying the ink on the first surface.

Specific Form 4: A both-side recording apparatus as in any one of Specific Forms 1 to 3, wherein a second predetermined time is longer than a first predetermined time, when the recording medium is transported to a paper inversion unit in such a manner that the sheet transport roller and the pinch roller are released after the first predetermined time elapsed from the termination of the recording of the first surface in the recording medium, a rear end of the first surface is transported toward the reverse direction beyond a nip portion of the sheet transport roller, the transport of the recording medium is stopped for the second predetermined time, and then the sheet transport roller is pressed into contact with the pinch roller again to further continue the transport in the reverse direction. The configuration of Specific Form 4 provides the both-side recording apparatus in which the recording medium can be transported to the gap between the sheet transport roller and the pinch roller before the recording medium is deformed by absorbing the ink and the like and the paper jam can be securely prevented because the rear end of the first sheet is transported toward the reverse direction beyond the nip portion of the sheet transport roller after the shorter first predetermined time elapsed.

Specific Form 5: A both-side recording apparatus as in any one of Specific Forms 1 to 3, wherein a fourth predetermined time is longer than a third predetermined time, when the recording medium is transported to the paper inversion unit in such a manner that the sheet transport roller and the pinch roller are released after the third predetermined time elapsed from the termination of the recording of the first surface in the recording medium, the rear end of the first surface is transported toward the reverse direction beyond the nip portion of the sheet transport roller, said sheet transport roller is pressed into contact with the pinch roller again, the transport of the recording medium is stopped for the fourth predetermined time, and then the transport of the recording medium in the reverse direction is resumed. The configuration of Specific Form 5 provides the both-side recording apparatus in which, in the case where there is the blank space in the rear end of the first surface, the pinch roller is pressed against the blank space and the pinch roller waits for the fourth predetermined time, therefore, the amount of deformation of the recording paper caused by absorbing the ink and the like can be decreased and the paper jam can be securely prevented. Specific Form 6: A both-side recording apparatus as in any one of Specific Forms 1 to 5, wherein the recording is performed to the recording paper by inkjet recording means for discharging ink from a discharge port.

Specific Form 7: A both-side recording apparatus as in any one of Specific Forms 1 to 6, wherein the total time from the termination of the recording of the first surface to the termination of the second predetermined time or the fourth predetermined time can be changed by density per unit area of data recorded in the first surface. Specific Form 8: A both-side recording apparatus as in any one of Specific Forms 1 to 6, wherein the total time from the termination of the recording of the first surface to the termination of the second predetermined time or the fourth predetermined time can be changed by a kind of the ink used in the recording. Specific Form 9: A both-side recording apparatus as in any one of Specific Forms 1 to 6, wherein the total time from the termination of the recording of the first surface to the termination of the second predetermined time or the fourth predetermined time can be changed by conditions of atmosphere such as ambient temperature and ambient humidity.

Specific Form 10: A both-side recording apparatus as in any one of claims 1 to 6, wherein the total time from the termination of the recording of the first surface to the termination of the second predetermined time or the fourth predetermined time can be changed by the kind of the recording medium. The configurations of Specific Forms 6 to 10 obtain the effect that the recording medium in which the recording is performed to the first surface can be efficiently dried by changing the dry standby time according to atmosphere of the recording apparatus such as the amount of using ink hit in the recording paper per unit area, the kind of the ink, the ambient temperature, and the ambient humidity or the kind of the recording paper, and the dry standby time can be reduced to shorten the recording operation time by cutting out the unnecessary drying processing.

In the above embodiments, the serial type recording apparatus in which the recording is performed while the recording head as the recording means is moved in the main scanning direction was described as an example. However, the invention can be also applied to the line type recording apparatus which uses the line type recording means having the length covering a total width or a part of the recording medium and perform the recording only by the sub-scanning (paper transport), and the same effect can be achieved. The invention can be freely carried out independently of the number of recording means. The invention can be also applied to the recording apparatus using one recording means, the recording apparatus for color recording which utilizes the plurality of recording means using different color inks, the recording apparatus for gradation recording which utilizes the plurality of recording means using the inks having the same color and different densities, and the recording apparatus in which the above recording apparatuses are combined, and the same effect can be achieved.

In the case where the recording apparatus is the inkjet recording apparatus, the invention can be applied to any arrangement of the recording head and the ink tank such as the configuration using the changeable head cartridge in which the recording head and the ink tank are integrated and the configuration in which the recording head and the ink tank are individually formed and connected with a tube for ink supply, and the same effect can be achieved. In the case where the recording apparatus is the inkjet recording apparatus, in addition to the recording apparatus using the inkjet recording head in which the ink is discharged by utilizing the thermal energy, the invention can be also applied to the recording apparatus utilizing the other ink discharge methods, e.g. the recording apparatus using the inkjet recording head in which the ink is discharged by using the electromechanical transducer body such as a piezoelectric element, and the same operation and effect can be achieved.

As can be seen from the above description, according to the invention, the both-side recording apparatus in which the recording can be performed without the blank space in the overall range of the recording medium because the recording can be performed while the recording medium is transported until the recording medium is released once from the sheet transport, and the sheet transport roller and the pinch roller can securely support the recording medium while sandwiching the recording medium and the paper jam can be securely prevented because the recording medium is transported toward the reverse direction while the pinch roller is released to make the gap between the pinch roller and the sheet transport roller can be provided.

What is claimed is:

1. A both-side recording apparatus with a sheet transport mechanism having a sheet transport roller and a pinch roller pressed against the sheet transport roller, a sheet discharge roller arranged on the downstream side of the sheet transport roller in a transport direction, and a rotating body pressed against the sheet discharge roller, characterized in that a recording medium is transported to a position where a rear end of the recording medium is released from the sheet transport roller when a first surface is recorded at first, and then the recording medium is transported to a paper inversion unit in such a manner that the recording medium is transported by the sheet discharge roller toward a reverse direction while the sheet transport roller and the pinch roller are separated so that the recording medium moves between the sheet transport roller and the pinch roller without contacting with the pinch roller, and then the pinch roller is pressed into contact with the recording medium again to further continue the transport in the reverse direction.

2. A both-side recording apparatus according to claim 1, wherein a gap between the sheet transport roller and the pinch roller is set larger than an amount of deformation of the recording medium after the first surface of the recording medium is recorded.

3. A both-side recording apparatus according to claim 1, wherein the transportation of the recording medium is started toward the reverse direction after a predetermined time elapsed from termination of the recording of the first surface of the recording medium.

4. A both-side recording apparatus according to claim 1, wherein a second predetermined time is longer than a first predetermined time, when the recording medium is transported to a paper inversion unit in such a manner that the sheet transport roller and the pinch roller are released after the first predetermined time elapsed from the termination of the recording of the first surface in the recording medium, a rear end of the first surface is transported toward the reverse direction beyond a nip portion of the sheet transport roller, the transport of the recording medium is stopped for the second predetermined time, and then the sheet transport roller is pressed into contact with the pinch roller again to further continue the transport in the reverse direction.

5. A both-side recording apparatus according to claim 1, wherein a fourth predetermined time is longer than a third predetermined time, when the recording medium is transported to the paper inversion unit in such a manner that the sheet transport roller and the pinch roller are released after the third predetermined time elapsed from the termination of the recording of the first surface in the recording medium, the rear end of the first surface is transported toward the reverse direction beyond the nip portion of the sheet transport roller, the sheet transport roller is pressed into contact with the pinch roller again, the transport of the recording medium is stopped for the fourth predetermined time, and then the transport of the recording medium in the reverse direction is resumed.

6. A both-side recording apparatus as in any one of claims 1 to 5, wherein the recording is performed to the recording paper by inkjet recording means for discharging ink from a discharge port.

7. A both-side recording apparatus as in any one of claims 1 to 5, wherein the total time from the termination of the recording of the first surface to the termination of the second predetermined time or the fourth predetermined time can be changed by density per unit area of data recorded on the first surface.

8. A both-side recording apparatus as in any one of claims 1 to 5, wherein the total time from the termination of the recording of the first surface to the termination of the second predetermined time or the fourth predetermined time can be changed based on a kind of ink used in the recording.

9. A both-side recording apparatus as in any one of claims 1 to 5, wherein the total time from the termination of the recording of the first surface to the termination of the second predetermined time or the fourth predetermined time can be changed based on conditions of atmosphere such as ambient temperature and ambient humidity.

10. A both-side recording apparatus as in any one of claims 1 to 5, wherein the total time from the termination of the recording of the first surface to the termination of the second predetermined time or the fourth predetermined time can be changed based on the kind of recording medium.

11. A both-side recording apparatus including:

a first transport roller which transports a sheet of a recording medium toward a predetermined transport direction;

a pinch roller which cooperates with the first transport roller to support the sheet while sandwiching the sheet;

recording means for using a recording head discharging ink on the downstream side of the first transport roller in the transport direction to perform the recording to the sheet transported by the first transport roller;

a second transport roller which transports the sheet on the downstream side of the recording means in the transport direction;

separating means for separating the pinch roller from the first transport roller;

control means for controlling the first transport roller, the second transport roller, and the separating means;

a rotating body which cooperates with the second transport roller to support the sheet while sandwiching the sheet; and inversion means which inverts the sheet transported by the first transport roller toward the direction opposite to the transport direction and transports the sheet to the first transport roller, characterized in that a sheet is transported to a position where a rear end of the sheet is released from the first transport roller when a first surface is recorded at first, and then the sheet is transported to the inversion means in such a manner that the sheet is transported by the second transport roller toward a reverse direction while the first transport roller and the pinch roller are separated so that the sheet moves between the first transport roller and the pinch roller without contacting with the pinch roller, and then the pinch roller is pressed into contact with the sheet again to further continue the transport in the reverse direction.

12. A both-side recording apparatus according to claim 11, wherein the recording is performed by the recording means while the rear end of the sheet is located on the downstream side of the nip of the first transport roller and the pinch roller, the sheet is transported in the reverse direction of the transport direction by the second transport roller until the rear end of the sheet passes between the first transport roller and the pinch roller, the sheet is temporarily stopped, and then the first transport roller and the pinch roller support the sheet while sandwiching the sheet and transport the sheet to the inversion means.

13. A both-side recording apparatus according to claim 11, wherein the recording is performed by the recording means while the rear end of the sheet is located on the downstream side of the nip of the first transport roller and the pinch roller, the sheet is transported in the reverse direction of the transport direction by the second transport roller until the rear end of the sheet passes between the first transport roller and the pinch roller, the sheet is stopped for a predetermined time, and then the first transport roller and the pinch roller support the sheet while sandwiching the sheet and transport the sheet to the inversion means.

14. A both-side recording apparatus according to claim 11, wherein the recording is performed by the recording means so that a blank space remains in a rear end portion of the sheet while the rear end of the sheet is located on the downstream side of the nip of the first transport roller and the pinch roller, the sheet is transported in the reverse direction of the transport direction by the second transport roller until the rear end of the sheet passes between the first transport roller and the pinch roller, then the sheet is stopped for a predetermined time while the blank portion of the sheet is sandwiched by the first transport roller and the pinch roller, and then the sheet is transported to the inversion means.

* * * * *

UNITED STATES PATENT AND TRADEMARK OFFICE

CERTIFICATE OF CORRECTION

PATENT NO. : 7,222,955 B2
APPLICATION NO. : 10/824411
DATED : May 29, 2007
INVENTOR(S) : Tetsuyo Ohashi et al.

It is certified that error appears in the above-identified patent and that said Letters Patent is hereby corrected as shown below:

COLUMN 4:
Line 24, “perform” should read --performs--.

COLUMN 7:
Line 2, “return” should read --returns--.

COLUMN 9:
Line 24, “the recording paper” should be deleted.

COLUMN 10:
Line 9, “an” should read --a--.
Line 20, “can not” should read --cannot--.

COLUMN 11:
Line 40, “to” should be deleted.
Line 44, “prefer” should read --preferred--.

COLUMN 12:
Line 51, “a partially side view” should read --partial side views--.

COLUMN 13:
Line 33, “When” should read --when--.
Line 60, “partially side view” should read --partially side views--.

COLUMN 14:
Line 12, “partially” should read --partial--.
Line 14, “When” should read --when--.
Line 26, “partially side view” should read --partial side views--.
Line 34, “mined” should read --mine--.

COLUMN 15:
Line 17, “partially side view” should read --partial side views--.
Line 23, “cone” should read --come--.

COLUMN 18:
Line 46, “view” should read --views--.

UNITED STATES PATENT AND TRADEMARK OFFICE

CERTIFICATE OF CORRECTION

PATENT NO. : 7,222,955 B2
APPLICATION NO. : 10/824411
DATED : May 29, 2007
INVENTOR(S) : Tetsuyo Ohashi et al.

It is certified that error appears in the above-identified patent and that said Letters Patent is hereby corrected as shown below:

COLUMN 22:
Line 25, “A 108” should read --A 108 and--.
Line 41, “measure” should read --measured--.
Line 66, “sufficient” should read --sufficiently--.

COLUMN 24:
Line 31, “can not” should read --cannot--.
Line 33, “can not” should read --cannot--.
Line 37, “can not” should read --cannot--.
Line 44, “view” should read --views--.

COLUMN 25:
Line 38, “can not” should read --cannot--.
Line 41, “has” should read --has been--.

COLUMN 27:
Line 15, “above described” should read --above-described--.

COLUMN 28:
Line 18, “an” should read --a--.
Line 20, “engages” should read --engage--.
Line 60, “can not” should read --cannot--.

COLUMN 29:
Line 42, “can not” should read --cannot--.
Line 43, “can not” should read --cannot--.
Line 57, “can not” should read --cannot--.

COLUMN 30:
Line 3, “can not” should read --cannot--.

COLUMN 31:
Line 14, “positioning” should read --positioning of--.
Line 18, “the” (second occurrence) should be deleted.
Line 22, “the” (1st and 3rd occurrence) should be deleted.

COLUMN 32:
Line 27, “view” should read --views--.
Line 40, “AS” should read --As--.

UNITED STATES PATENT AND TRADEMARK OFFICE

CERTIFICATE OF CORRECTION

PATENT NO. : 7,222,955 B2
APPLICATION NO. : 10/824411
DATED : May 29, 2007
INVENTOR(S) : Tetsuyo Ohashi et al.

It is certified that error appears in the above-identified patent and that said Letters Patent is hereby corrected as shown below:

COLUMN 33:
Line 17, “view” should read --views--.
Line 55, “expand” should read --expanded--.

COLUMN 34:
line 28, “can not” should read --cannot--.
Line 45, “the” (first occurrence) should be deleted.

COLUMN 35:
Line 23, “AS” should read --As--.
Line 26, “engages” should read --engage--.

COLUMN 36:
Line 18, “can not” should read --cannot--.

COLUMN 37:
Line 12, “At” should read --at--.

Signed and Sealed this

Fourth Day of December, 2007

JON W. DUDAS
*Director of the United States Patent and Trademark Office*